US007206426B1

(12) United States Patent
Julstrom et al.

(10) Patent No.: US 7,206,426 B1
(45) Date of Patent: Apr. 17, 2007

(54) MULTI-COIL COUPLING SYSTEM FOR HEARING AID APPLICATIONS

(75) Inventors: Steven D. Julstrom, Chicago, IL (US); Mead Killion, Elk Grove Village, IL (US)

(73) Assignee: Etymotic Research, Inc., Elk Grove Village, IL (US)

( * ) Notice: Subject to any disclaimer, the term of this patent is extended or adjusted under 35 U.S.C. 154(b) by 211 days.

(21) Appl. No.: 10/816,119

(22) Filed: Apr. 1, 2004

Related U.S. Application Data

(63) Continuation-in-part of application No. 10/356,290, filed on Jan. 31, 2003, which is a continuation-in-part of application No. 09/752,806, filed on Dec. 28, 2000, now Pat. No. 6,694,034.

(60) Provisional application No. 60/459,865, filed on Apr. 1, 2003, provisional application No. 60/225,840, filed on Aug. 16, 2000, provisional application No. 60/174,958, filed on Jan. 7, 2000.

(51) Int. Cl.
*H04R 25/00* (2006.01)

(52) U.S. Cl. ..... 381/331; 381/315; 381/322

(58) Field of Classification Search ..... 381/312, 381/315, 322, 326, 327, 328, 329, 330, 331; 455/107; 607/57
See application file for complete search history.

(56) References Cited

U.S. PATENT DOCUMENTS 4,920,570 A 4/1990 West et al.
5,557,673 A * 9/1996 Ginzburg ..... 381/312
5,737,430 A * 4/1998 Widrow ..... 381/313
5,796,821 A 8/1998 Crouch et al.
5,824,022 A 10/1998 Zilberman et al.
5,835,610 A 11/1998 Ishige et al.
6,101,258 A 8/2000 Killion et al.
6,112,103 A 8/2000 Puthuff
6,307,945 B1 10/2001 Hall
6,320,959 B1 11/2001 Crouch et al.
6,516,075 B1 * 2/2003 Jacobs et al. ..... 381/331
6,694,034 B2 2/2004 Julstrom et al.
2001/0055386 A1 12/2001 Waldron et al.

(Continued)

FOREIGN PATENT DOCUMENTS

WO WO 01/52597 A1 7/2001

OTHER PUBLICATIONS

Valente, Michael, Hearing Aids: Standards, Options, and Limitations, Thieme Medical Publishers, Inc.

(Continued)

*Primary Examiner*—Sinh Tran
*Assistant Examiner*—Brian Ensey
(74) *Attorney, Agent, or Firm*—McAndrews, Held & Malloy, Ltd.

(57) ABSTRACT

Disclosed herein is a hearing improvement device using a multi-coil coupling system and methods for operating such a device. In an embodiment according to the present invention an array microphone may be used to provide highly directional reception. The received audio signal may be filtered, amplified, and converted into a magnetic field for coupling to a telecoil in a conventional hearing aid. Multiple transmit inductors may be used to effectively couple to both in-the-ear and behind-the-ear type hearing aids, and an additional embodiment is disclosed which may be used with an earphone, for users not requiring a hearing aid.

30 Claims, 42 Drawing Sheets

U.S. PATENT DOCUMENTS

2002/0141545 A1 10/2002 Segovia
2003/0152243 A1 8/2003 Julstrom et al.

OTHER PUBLICATIONS

Skinner, Margaret W., Hearing Aid Evaluation, Remediation of Communication Disorders Series, 1988 by Prentice Hall.
Studebaker, Gerald A. and Bess, Fred H., Monographs In Contemporary Audiology, The Vanderbilt Hearing-Aid Report, 1982, pp. 91-93.
Audex, The Chaamp, http://www.audex.com/chaamp.html.
Sennheiser Electronic Corporation, EZI 120 Induction Coupler.
Amplifiers for Cell Phones, Using TTY or Voice Carry Over with Cell Phones.
Hatis Products- Products: BTE Product Line, Hearing Aid Telephone Interconnect Systems, http://www.hatiscom/products.shtml.
Japanese Advertisement, Panasonic Hearing Aid Accessory.
Ross, Mark Ph.D., Telecoil and Telephones, http//www.hearingresearch.org/Dr.Ross/telecoil_and_telephones.htm, pp. 1-7, Apr. 29, 2003.
Ross, Mark Ph.D., Beyond Hearing Aids, http//www.hearingresearch.org/Dr.Ross/telecoil_and_telephones.htm, pp. 1-17, Apr. 29, 2003.
Hearing Loop, Getting hard of hearing people "in the loop", http://www.hearingloop.org/, pp. 1-2, Apr. 29, 2003.
Myers, David G. PhD., The Hearing Review, The Coming Audiocoil Revolution, http://www.assistiveaudio.com, pp. 1-8, Apr. 29, 2003.
Wilson, Beth J., Beyond Hearing BTE, Why Don't Cell Phones Work With Hearing Aids, http://www.geocities.com/Heartland/Prairie/4727/bbhcellemi.htm,pp. 1-2, Apr. 29, 2003.
Boswell, Susan, Beyond Hearing BTE, Finding A HAC Cell Phone, http;//www.geocities.com/Heartland/Prairie/4727/bbhcellsurvey.htm, pp. 1-3, Apr. 29, 2003.
Brosman, Floyd Wesley, Telecoils and the Magnetic Loop, Copyright 2002, http://www.saywhatclub.com/newletter/jun02/wes.htm, pp. 1-2, Apr. 29, 2003.
Revit, Larry, Proper Use of Telecoils: It's As Easy As 1,2,3 . . . 4, http://www.frye.com/library/applciation/larry04.htmml, pp. 1-2, Apr. 29, 2003.
Pennsylvania SHHH Self Help For Hard of Hearing People, Position on Telecoils, http://trfn.clpgh.org/shhh/Position/tcoil.htm, pp. 1-3, Apr. 29, 2003.
Davidson, Stephanie A. and Noe, Colleen M., American Journal of Audiology/vol. 3/ No. 2 Jul. 1994, Programmable Telecoil Responses: Potential Advantages for Assistive Listening Device Fittings, pp. 1-6, Apr. 29, 2003.
Hard of Hearing Advocates, Summer Edition, People Working Together for Solutions, Sep. 5, 2002, Telcoils In Hearing Aids in the USA, http://www.hohadvocates.org/telecoils.htm, pp. 1-5, Apr. 29, 2003.
Mutech International Co.,Inc., specification P/NO, PH1-BPI, Sep. 25, 2002, 2 pages.
Mutech International Co., Inc., specification P/N YA-180643C, Mar. 8, 20012 pages.
Mutech International Co., Inc., specification, Oct. 1, 2002, 1 page.
Centrum Sound Offers Oticon System, The Hearing Journal, Oct. 1993 vol. 46, No. 10.
Public-Use Hearing Device From Four Point Design, The Hearing Journal, Apr. 1992, vol. 45, No. 4.
Portable Handsfree for Hearing Aid Users, ENTNews, vol. 10 No. 2, May/Jun. 2001.

* cited by examiner

2301a

*Four cellphones* (Nokia 6310i, Siemens S46, Motorola T720, Analog Motorola Star-Tac)

*Siemens S46 inside*

Siemens S46 modified with 1 inductor (initial try) Fig. 39
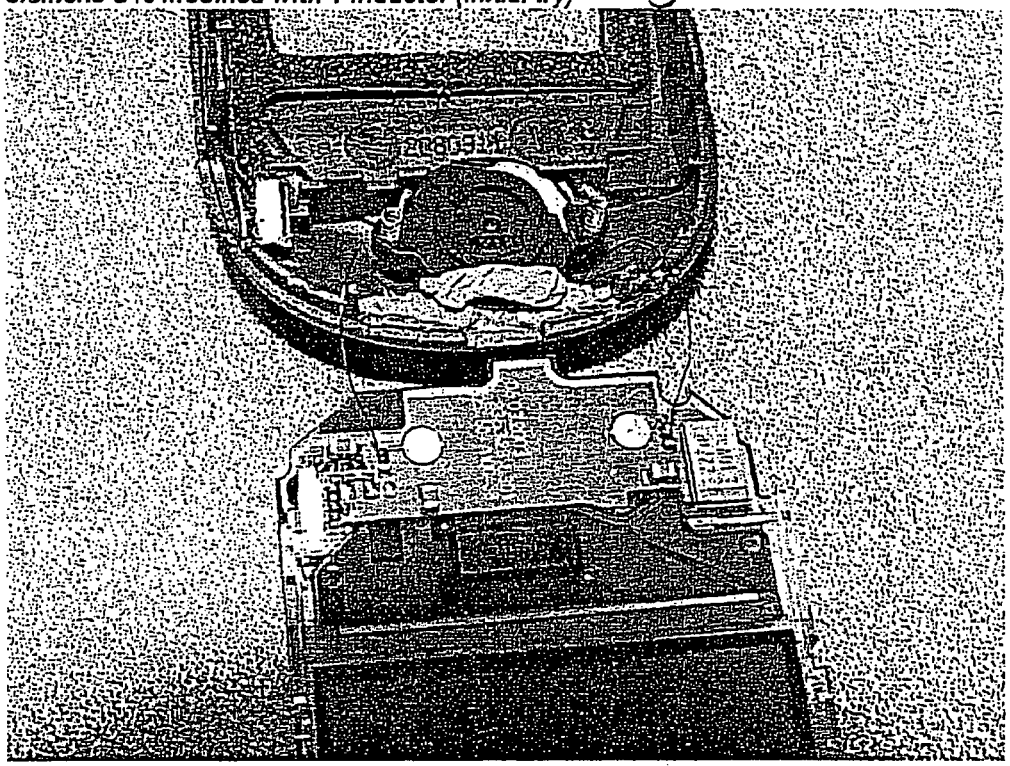
Siemens S46 with final 3 inductors Fig. 40
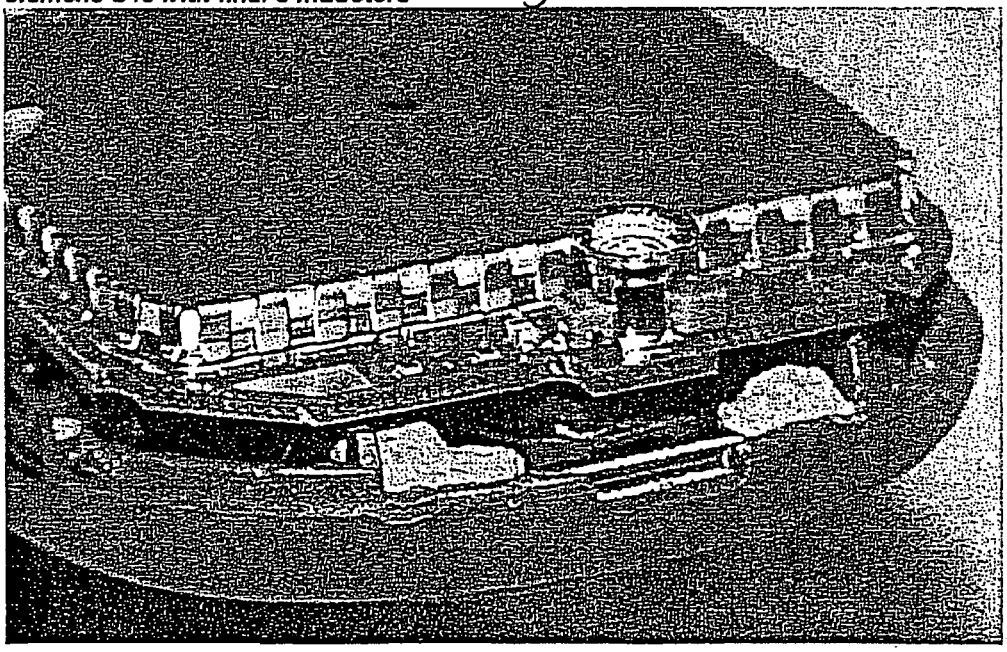

Nokia 6310i - modified with 4 inductors

Nokia 6310i - modified with 4 inductors; closeup

*Motorola Star-Tac (older analog, piezo transdueer) - modified with 1 inductor*

*RF-proof listening setup*

MULTI-COIL COUPLING SYSTEM FOR HEARING AID APPLICATIONS

CROSS-REFERENCE TO RELATED APPLICATIONS/INCORPORATION BY REFERENCE

The present application claims the benefit of priority of U.S. Provisional Patent Application having Ser. No. 60/459,865, filed on Apr. 1, 2003, and hereby incorporates herein by reference the complete subject matter thereof, in its entirety.

The present application also hereby incorporates herein by reference the complete subject matter of U.S. Provisional Patent Applications having Ser. No. 60/174,958, filed Jan. 7, 2000, Ser. No. 60/225,840, filed on Aug. 16, 2000, in their respective entireties.

The present application is also a continuation in part of U.S. Non-Provisional Application having Ser. No. 10/356,290 entitled "Multi-Coil Coupling System for Hearing Aid Applications" filed on Jan. 31, 2003, which is hereby incorporated herein by reference, in its entirety.

The present application is also a continuation in part of U.S. Non-Provisional Application having Ser. No. 09/752,806 entitled "Transmission Detection and Switch System for Hearing Improvement Applications" filed on Dec. 28, 2000 now U.S. Pat. No. 6,694,034, which is hereby incorporated herein by reference, in its entirety.

The present application also hereby incorporates herein by reference the complete subject matter of U.S. Pat. No. 6,009,311, issued on Dec. 28, 1999, in its entirety.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

Numerous types of hearing aids are known and have been developed to assist individuals with hearing loss. Examples of hearing aid types currently available include behind the ear (BTE), in the ear (ITE), in the canal (ITC), and completely in the canal (CIC) hearing aids. In many situations, however, hearing impaired individuals may require a hearing solution beyond that which can be provided by such a hearing aid using an internal microphone alone. For example, hearing impaired individuals often have great difficulty carrying on normal conversations in noisy environments, such as parties, meetings, sporting events, etc., involving a high level of background noise. In addition, hearing impaired individuals also often have difficulty listening to audio sources located at a distance from the individual or to several audio sources located at various distances from the individual and at various positions relative to the individual.

The characteristics and location of a hearing aid internal microphone often results in excessive pickup of ambient acoustical noise. In the past, this has often been overcome by the direct magnetic coupling of a speech signal into a telecoil, which is often incorporated internally in hearing aids. The telecoil's original purpose was to pick up the stray magnetic field from conventional telephone receivers, which often, although not always, had sufficient strength for efficient direct coupling of the telephone signal. The telecoil's use has expanded to use a receiver in "room loop" systems, where a large room is "looped" with sufficient audio signal-driven cabling to create a reasonably uniform, generally vertically oriented magnetic field within the room. The telecoil has also been used to receive magnetically coupled audio signals from special "neck loops" and thin "silhouette" style "tele-couplers" that fit behind the ear, next to a BTE aid.

A common problem with prior art tele-couplers of the neck loop and silhouette styles has been the difficulty of bathing the telecoil in a magnetic field that is both of sufficient strength and sufficient uniformity in relation to typical relative tele-coupler/telecoil positionings to ensure a predictable, consistent audio coupling at a volume level adequate for comfortable use and that can consistently overcome environmental magnetic noise interference. Additionally, silhouette style tele-couplers, which are generally designed with BTE aids in mind, have not successfully achieved sufficient field strength at the greater distances needed to reach the ITE telecoils, or provided an appropriate field orientation for optimum coupling.

Further, the net frequency response obtained with prior art tele-coupler/telecoil systems has been uncontrolled, unpredictable, and not generally uniform. The combination of the non-uniform frequency characteristics of the field produced by the typical transmitting inductor and the non-uniform frequency response of the typical receiving telecoil results in unsatisfactory overall frequency response for the user.

Further limitations and disadvantages of conventional and traditional approaches will become apparent to one of skill in the art, through comparison of such systems with aspects of the present invention as set forth in the remainder of the present application and with reference to the drawings.

SUMMARY OF THE INVENTION

Aspects of the present invention may be found in a hearing improvement device comprising a microphone for tranducing a sound field into a first electrical signal, an amplifier for amplifying the first electrical signal into a second electrical signal, and at least one inductor for converting the second electrical signal into a magnetic field for coupling to at least one telecoil of a hearing aid. The microphone may be amplified and coupled through the at least one inductor to the hearing aid.

In an embodiment according to the present invention, the hearing aid may comprise one of a behind-the-ear (BTE) hearing, an in-the-ear (ITE) hearing aid, an in-the-canal (ITC) hearing aid, and a completely-in-the-canal (CIC) hearing aid.

In an embodiment according to the present invention, the microphone may comprise an output connected to an input of a high-pass filter. The high pass filter may be used to reduce low-frequency components of an electrical signal and avoid excessive low-frequency coupling to the hearing aid.

In an embodiment according to the present invention, the at least one inductor may comprise two inductors. The first inductor may be an in-the-ear (ITE) transmit inductor and the second inductor may be a behind-the-ear (BTE) transmit inductor. A switch may be provided to at least one of enable the first inductor and disable the second inductor, enable the second inductor and disable the first inductor, enable the first and second inductors, and disable the first and second inductors.

In an embodiment according to the present invention, the magnetic field emanating from the hearing improvement device may comprise approximately 30 mA/meter at 1 kHz, wherein 1 kHz lies in range of frequencies comprising human speech.

In an embodiment according to the present invention, the hearing improvement device may be adapted to operate on an ear of a user by an earhook. The hearing improvement device may be positioned one of adjacent a user's outer ear and adjacent the user's head.

In an embodiment according to the present invention, the hearing improvement device may comprise one of an in-the-ear (ITE) transmit inductor and a behind-the-ear (BTE) transmit inductor positioned to magnetically couple with a vertically-oriented telecoil located within one of an ITE hearing aid and a BTE hearing aid. Lines of magnetic flux generated by one of the ITE transmit inductor and the BTE transmit inductor may be arranged primarily vertically in a region within which one of the ITE hearing aid and the BTE hearing aid may be located to optimize interaction with the vertically oriented telecoil located within one of the ITE hearing aid and the BTE hearing aid.

In an embodiment according to the present invention, the at least one inductor may comprise one of an in-the-ear (ITE) transmit inductor and a behind-the-ear (BTE) transmit inductor positioned to magnetically couple with a vertically-oriented telecoil located within one of an ITE hearing aid and a BTE hearing aid. Field strength of at least one of the ITE transmit inductor and the BTE transmit inductor may be maximized by providing a core of at least one of the ITE transmit inductor and the BTE transmit inductor being sized to be contained within a limitation of space and orientation available in at least one of behind a user's outer ear and between the user's outer ear and the user's head.

In an embodiment according to the present invention, the at least one inductor may comprise one of an in-the-ear (ITE) transmit inductor and a behind-the-ear (BTE) transmit inductor positioned to magnetically couple with a vertically-oriented telecoil located within one of an ITE hearing aid and a BTE hearing aid. At least one of the ITE transmit inductor and the BTE transmit inductor may comprise a coil. The wire gauge and number of turns of the coil may be chosen to give inductance and resistance values allowing peak current. Peak current may comprise a level of current sufficient to drive an iron core of at least one of the ITE transmit inductor and the BTE transmit inductor to a saturation edge.

In an embodiment according to the present invention, the at least one inductor may comprise one of an in-the-ear (ITE) transmit inductor and a behind-the-ear (BTE) transmit inductor positioned to magnetically couple with a vertically-oriented telecoil located within one of an ITE hearing aid and a BTE hearing aid. At least one of the ITE transmit inductor and the BTE transmit inductor may comprise a coil. The coil may comprising windings. The windings of at least one of the ITE transmit inductor and the BTE transmit inductor may be used for coupling to telecoils of at least one of the ITE hearing aid and the BTE hearing aid.

In an embodiment according to the present invention, the at least one inductor may comprises one of an in-the-ear (ITE) transmit inductor and a behind-the-ear (BTE) transmit inductor positioned to magnetically couple with a vertically-oriented telecoil located within one of an ITE hearing aid and a BTE hearing aid. At least one of the ITE transmit inductor and the BTE transmit inductor may comprise a coil. The coil may comprise windings. At least one of the ITE transmit inductor and the BTE transmit inductor may be divided into two windings spaced a distance apart by a winding gap. The two windings may be positioned on a common core. The two windings may be adapted to improve uniformity of the magnetic fields induced by at least one of the ITE transmit inductor and the BTE transmit inductor.

In an embodiment according to the present invention, the at least one inductor may comprise one of an in-the-ear (ITE) transmit inductor and a behind-the-ear (BTE) transmit inductor positioned to magnetically couple with a vertically-oriented telecoil located within one of an ITE hearing aid and a BTE hearing aid. At least one of the ITE transmit inductor and the BTE transmit inductor may comprise a coil. The coil may comprise windings. The windings of at least one of the ITE transmit inductor and the BTE transmit inductor may extend as close as practical to an end of the core to maintain a uniform field near ends of the core.

In an embodiment according to the present invention, the at least one inductor may comprise an inductor pair positioned to magnetically couple with a vertically-oriented telecoil located within one of an ITE hearing aid and a BTE hearing aid. At least one of inductors of the inductor pair may comprise a coil comprising at least two windings spaced a distance apart by winding gaps. Winding gaps of each inductor of the inductor pair may permit inductors to overlap within respective winding gaps to minimize thickness of the inductor pair.

In an embodiment according to the present invention, the hearing improvement device may produce a flat frequency response at an output of a receiving telecoil. Frequency-dependent drive voltage response may compensate for a combined frequency response. A transmit inductor drive voltage may produce a flat receiving telecoil frequency response. The overall magnetic coupling response may be uniform over a speech frequency range.

In an embodiment according to the present invention, the at least one inductor may comprise an inductor pair. Each inductor of the inductor pair may comprise at least two windings spaced a distance apart by a winding gap. The winding gaps of each inductor of the inductor pair may permit one inductor of the inductor pair to overlap another inductor of the inductor pair at respective winding gaps of each inductor. The overlapped inductors may avoid buildup of field strength near a center of each inductor that would occur with a continuous winding. The overlapped inductors may provide a magnetic field adapted to couple to a variety of hearing aids types comprising a range of receiving telecoil positions.

In an embodiment according to the present invention, the hearing improvement device may be positioned adjacent to the hearing aid. The hearing improvement device may be located behind an ear and next to the head of a user providing coupling of a magnetic field generated by a transmit inductor coil within the hearing improvement device to a receiving telecoil located within the hearing aid having uniform magnetic coupling strength over a range of telecoil positions within the hearing aid.

In an embodiment according to the present invention, the hearing aid may be one of connected via a wired connection to the hearing improvement device and connected wirelessly to the hearing improvement device.

In an embodiment according to the present invention, the hearing improvement device may be adapted to connect to one of one earphone and two earphones.

Aspects of the present invention may be found in a hearing improvement device comprising a wireless mobile handset for converting a radio frequency signal into an electrical signal and at least one inductor for converting the electrical signal into a magnetic field for coupling to at least one telecoil of a hearing aid.

In an embodiment according to the present invention, the wireless mobile handset may comprise a cellphone. The hearing improvement device may facilitate efficient coupling of received audio signals from the cellphone to the telecoil in a hearing aid of a user.

In an embodiment according to the present invention, the at least one inductor may comprise a plurality of inductors arranged in an array. The array of inductors may be disposed within the wireless mobile handset. The wireless mobile handset may comprise a cellphone. The array of inductor may be adapted to couple audio signals from the cellphone to the telecoil in a hearing aid of a user via one of a wired or wireless connection.

In an embodiment according to the present invention, the wireless mobile handset may comprise a cellphone. The cellphone may be one of an analog cellular telephone and a digital cellular telephone.

In an embodiment according to the present invention, the cellphone may be adapted to operate according to at least one a code division multiple access (CDMA) standard, a time division multiple access (TDMA) standard, and a global system for mobile communications (GSM) standard.

In an embodiment according to the present invention, the hearing aid may comprise one of a behind-the-ear (BTE) hearing, an in-the-ear (ITE) hearing aid, an in-the-canal (ITC) hearing aid, and a completely-in-the-canal (CIC) hearing aid.

In an embodiment according to the present invention, the at least one inductor may comprise a plurality of inductors.

In an embodiment according to the present invention, the hearing improvement device may be adapted to generate magnetic fields comprising approximately 30 mA/meter at 1 kHz, wherein 1 kHz lies in range of frequencies comprising human speech.

In an embodiment according to the present invention, the at least one inductor may comprise at least one transmit inductor positioned to magnetically couple with a vertically-oriented telecoil located within the hearing aid. Lines of magnetic flux may be generated by the at least one transmit inductor are arranged primarily vertically in a region within the hearing aid to optimize interaction with the vertically oriented telecoil located within the hearing aid.

In an embodiment according to the present invention, the at least one inductor may comprise at least one transmit inductor positioned to magnetically couple with a vertically-oriented telecoil located within the hearing aid. Field strength of the transmit inductor may be maximized by providing a core being sized to be contained within a limitation of space and orientation available in the wireless mobile handset.

In an embodiment according to the present invention, the at least one inductor may comprise at least one transmit inductor positioned to magnetically couple with a vertically-oriented telecoil located within the hearing aid. The at least one transmit inductor may comprise a coil. The wire gauge and number of turns of the coil may be chosen to give inductance and resistance values allowing peak current. Peak current may comprise a level of current sufficient to drive an iron core of the at least one transmit inductor to a saturation edge.

In an embodiment according to the present invention, the at least one inductor may comprise at least one transmit inductor positioned to magnetically couple with a vertically-oriented telecoil located within the hearing aid. The at least one transmit inductor may comprise a coil. The coil may comprise windings. The at least one transmit inductor may be divided into at least two windings spaced a distance apart by a winding gap. The at least two windings may be positioned on a common core. The at least two windings may be adapted to improve uniformity of the magnetic field induced by the at least one transmit inductor.

In an embodiment according to the present invention, the at least one inductor may comprise at least one transmit inductor positioned to magnetically couple with a vertically-oriented telecoil located within the hearing aid. The at least one transmit inductor may comprise a coil. The coil may comprise windings. The windings of the at least one transmit inductor may be adapted to extend close to ends of a core of the transmit inductor to maintain a uniform field near ends of the core.

In an embodiment according to the present invention, the at least one inductor may comprise at least two transmit inductors positioned to magnetically couple with a vertically-oriented telecoil located within the hearing aid. The at least two transmit inductors may comprise coils. The coils may comprise windings. The windings may be divided into at least two windings spaced a distance apart by winding gaps on each of the at least two transmit inductors. The winding gaps may permit one transmit inductor to overlap a center of another transmit inductor to minimize thickness of an inductor pair while allowing the one transmit inductor to be positioned to couple with the at least one telecoil in the hearing aid.

In an embodiment according to the present invention, the hearing improvement device may produce a flat frequency response at an output of a receiving telecoil. Frequency-dependent drive voltage response may compensate for a combined frequency response. A transmit inductor drive voltage may produce a flat receiving telecoil frequency response. Overall magnetic coupling response may be uniform over a speech frequency range.

In an embodiment according to the present invention, the at least one inductor may comprise an inductor pair. Each inductor of the inductor pair may comprise a coil having at least two windings spaced a distance apart by a winding gap. The winding gap of each inductor of the inductor pair may permit one inductor of the inductor pair to overlap another inductor of the inductor pair at the winding gap of each inductor. The overlapped inductors may avoid buildup of magnetic field strength near a center of each inductor that would occur with a continuous winding. The overlapped inductors may provide a magnetic field adapted to couple to a variety of hearing aids types comprising a range of receiving telecoil positions.

In an embodiment according to the present invention, when the wireless mobile handset is positioned adjacent to the ear of a user wearing the hearing aid, the wireless mobile handset may provide a coupling magnetic field generated by a transmit inductor coil within the wireless mobile handset to a receiving telecoil located within the hearing aid and have uniform magnetic coupling strength over a range of telecoil positions within the hearing aid.

These and various other advantages and features of novelty which characterize the invention are pointed out with particularity in the claims annexed hereto and that form a part hereof. However, for a better understanding of the invention, its advantages, and the objects obtained by its use, reference should be made to the drawings which form a further part hereof, and to accompanying descriptive matter, in which there are illustrated and described specific examples of an apparatus in accordance with the invention.

BRIEF DESCRIPTION OF SEVERAL VIEWS OF THE DRAWINGS

FIG. 39 is a photograph illustrating a close-up view of modifications to the cellphone illustrated in FIG. 38 according to an embodiment of the present invention;

FIG. 40 is a photograph illustrating another close-up view of modifications to the cellphone illustrated in FIG. 38 according to an embodiment of the present invention;

DETAILED DESCRIPTION OF THE INVENTION

Figure 1:
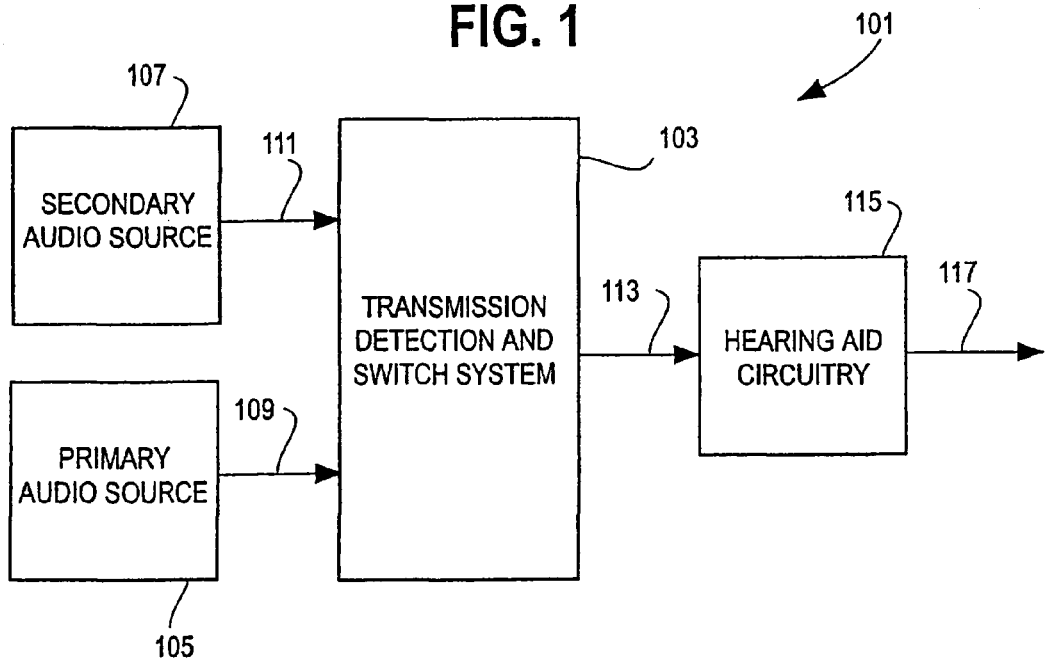
FIG. 1 is a block diagram of a hearing improvement system according to an embodiment of the present invention.

FIG. 1 is a block diagram of an overall hearing improvement system 101 according to the present invention. A transmission detection and switch system 103 may receive signals from both a primary audio source 105 and a secondary audio source 107. The primary audio source 105 may be, for example, a directional or omnidirectional microphone located in a hearing aid. The secondary audio source 107 may be, for example, a directional microphone/transmitter mounted on eyeglasses (or otherwise supported by a hearing aid user), a television or stereo transmitter, a telephone, or a microphone/transmitter combination under the control of a talking user. In an embodiment according to the present invention, secondary audio source 107 may utilize a wireless transmission scheme for transmission of signals to the transmission detection and switch system 103. In another embodiment according to the present invention, the secondary audio source 107 may be wired to the transmission detection and switch system 103.

In operation, the transmission detection and switch system 103, which may or may not be located within the hearing aid, may select one of signals 109 and 111 (from the primary and secondary audio sources 105 and 107, respectively), and may feed the selected signal as an input 113 to hearing aid circuitry 115. Hearing aid circuitry 115, which may be, for example, a hearing aid amplifier and speaker, may in turn generate an audio output 117 for transmission into the ear canal of the hearing aid user.

In one embodiment according to the present invention, when the secondary audio source 107 is selected for transmission into the ear canal of the hearing aid user, the primary audio source 105, i.e., the hearing aid microphone, may be completely shut off. In this case, the hearing aid user may not hear audio received by the primary audio source 105. In another embodiment according to the present invention, however, even when the secondary audio source is selected, the primary audio source 105 may not be completely shut off. Instead, the primary audio source 105 may only be attenuated and the hearing aid user may still be able to hear background or room sounds when listening to the secondary audio source 107. Attenuation of the primary audio source 105 may enable the hearing aid user to listen to the secondary audio source 107 while retaining a room sense or orientation provided to the hearing aid user by the primary audio source 105.

Figure 2:
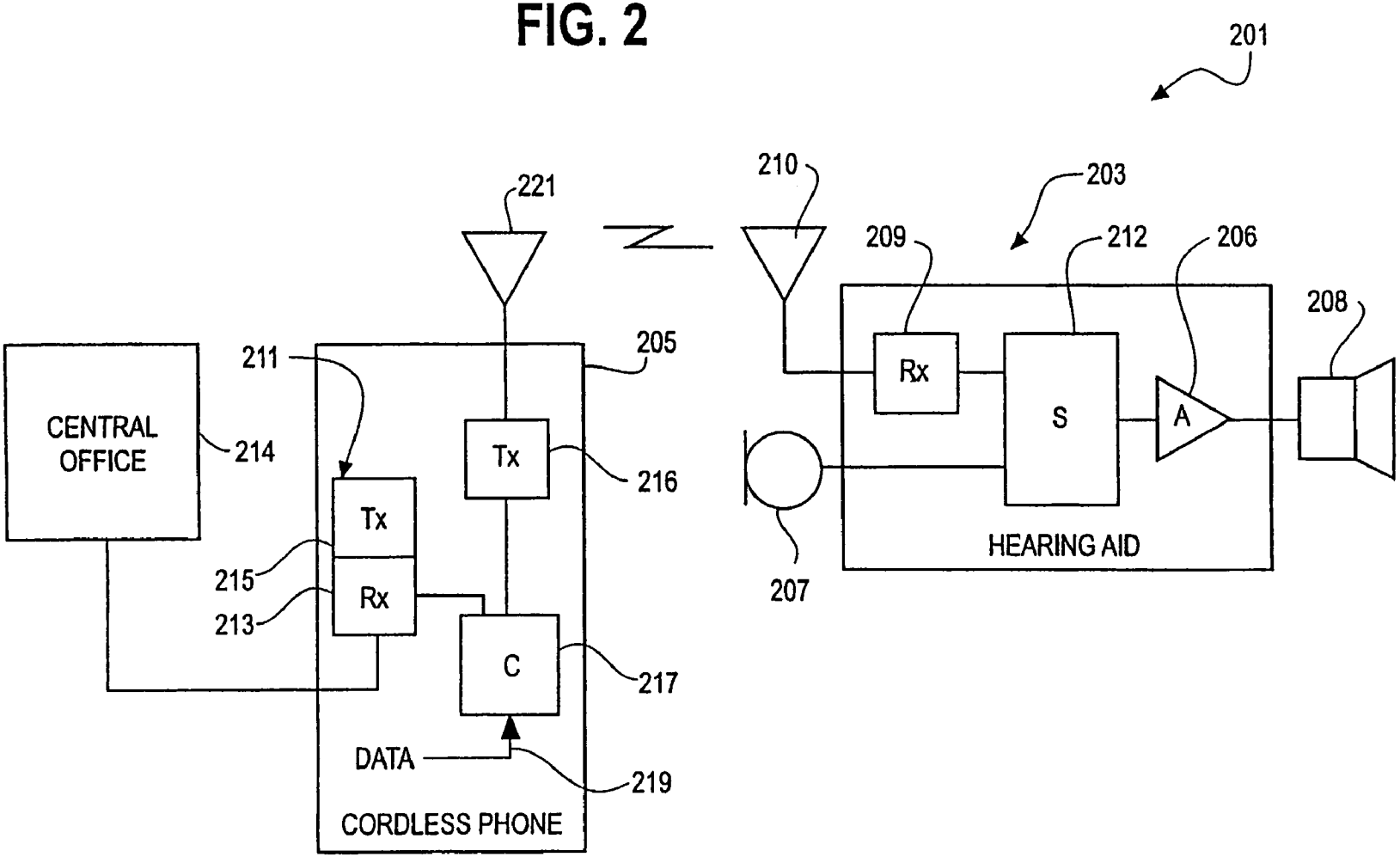
FIG. 2 is a block diagram of a hearing improvement system in accordance with an embodiment of the present invention.

FIG. 2 is a block diagram of a more specific embodiment of an overall hearing improvement system in accordance with the present invention. The system 201 may comprise a hearing aid 203, which may be one of several types of hearing aids currently available, such as, for example, the BTE, ITE, ITC, and CIC hearing aids mentioned above. The hearing aid 203 may comprise a housing incorporating a microphone 207, which may either be a directional microphone, an omni-directional microphone, or a switchable combination of the two. In any case, the microphone 207 may act as a primary audio source for the hearing aid 203.

The hearing aid 203 may also comprises a receiver 209 and associated circuitry for receiving wireless signals via an aerial 210. The receiver 209 and aerial 210 combination may be, for example, a radio frequency receiver and antenna, or an inductive coil. The hearing aid 203 may further comprise circuitry 212 performing signal detecting, signal selecting, and combining functionality. The circuitry 212 may select either signal received by the hearing aid microphone 207 or by the receiver 209, as discussed more completely herein. The selected signal (or combined signal, if applicable) may be fed to a hearing aid amplifier 206, which may amplify the selected signal, and then to a speaker 208, which may convert the selected signal into audio, and transmit the audio into the ear canal of a hearing aid user.

In addition to the hearing aid 203, the system 201 of FIG. 2 may further comprise a telephone 205 acting as a secondary audio source for the hearing aid 203. The telephone 205 may be hard wired to a traditional telephone network for two-way voice communication via a central office 214. The telephone 205 may comprise a transceiver 211 having both a receiver 213 component for receiving voice audio signals from the central office 214 and a transmitter 215 component for transmitting voice audio signals to the central office 214.

The telephone 205 may also comprise a second transmitter 216 and associated circuitry, as well as signal combiner circuitry 217, and a data input 219. The transmitter 216 may be operatively coupled to the signal combiner circuitry 217, which in turn may be operatively coupled to the receiver 213 and the data input 219. Data input 219 may receive data from, for example, a keyboard of the telephone 205 (not shown), memory within the telephone 205, an external computer, etc., connected to the telephone 205, or from the central office 214. In any case, such data may be, for example, hearing aid programming information.

The combiner circuitry 217 of the telephone 205 may transmit audio signals received by the receiver 213 and/or data signals received at the data input 219, to the transmitter 216. Signals received by the transmitter 216 from the combiner circuitry 217 may be transmitted wirelessly to the hearing aid 203 via an aerial 221. The transmitter 216 and aerial 221 combination may similarly be, for example, a radio frequency transmitter and antenna or an inductive coil.

In operation, the telephone 205 may be brought into proximity of the ear of a hearing aid user. The circuitry 212 of the hearing aid 203 may detect wireless signals being transmitted by the wireless transmission subsystem of the telephone 205. The hearing aid user then, if selection of the wireless signals is applicable, may hear, directly via the speaker 208 of the hearing aid 203, signals that would otherwise have been picked up via microphone 207 of the hearing aid 203 via a speaker of the telephone 205.

The wireless subsystem of the telephone 205 may be continuously activated, manually activated by a user, or may be automatically activated when the telephone 205 rings, (i.e., and is removed from the base unit, receives voice data, or senses that the telephone is in proximity of the hearing aid 203). In addition, the wireless subsystem of the telephone 205 may also assist the hearing aid user to hear the telephone ring. For example, the wireless scheme may broadcast a higher power signal that may be received by the receiver 209 of the hearing aid 203 indicating to the wearer that the telephone 205 is ringing.

In any event, the telephone 205 of system 201 of FIG. 2 may include two communication subsystems respectively communicating on two separate and distinct networks, namely the traditional hardwired telephone network and a low powered personal wireless network involving the hearing aid 203.

Figure 3:
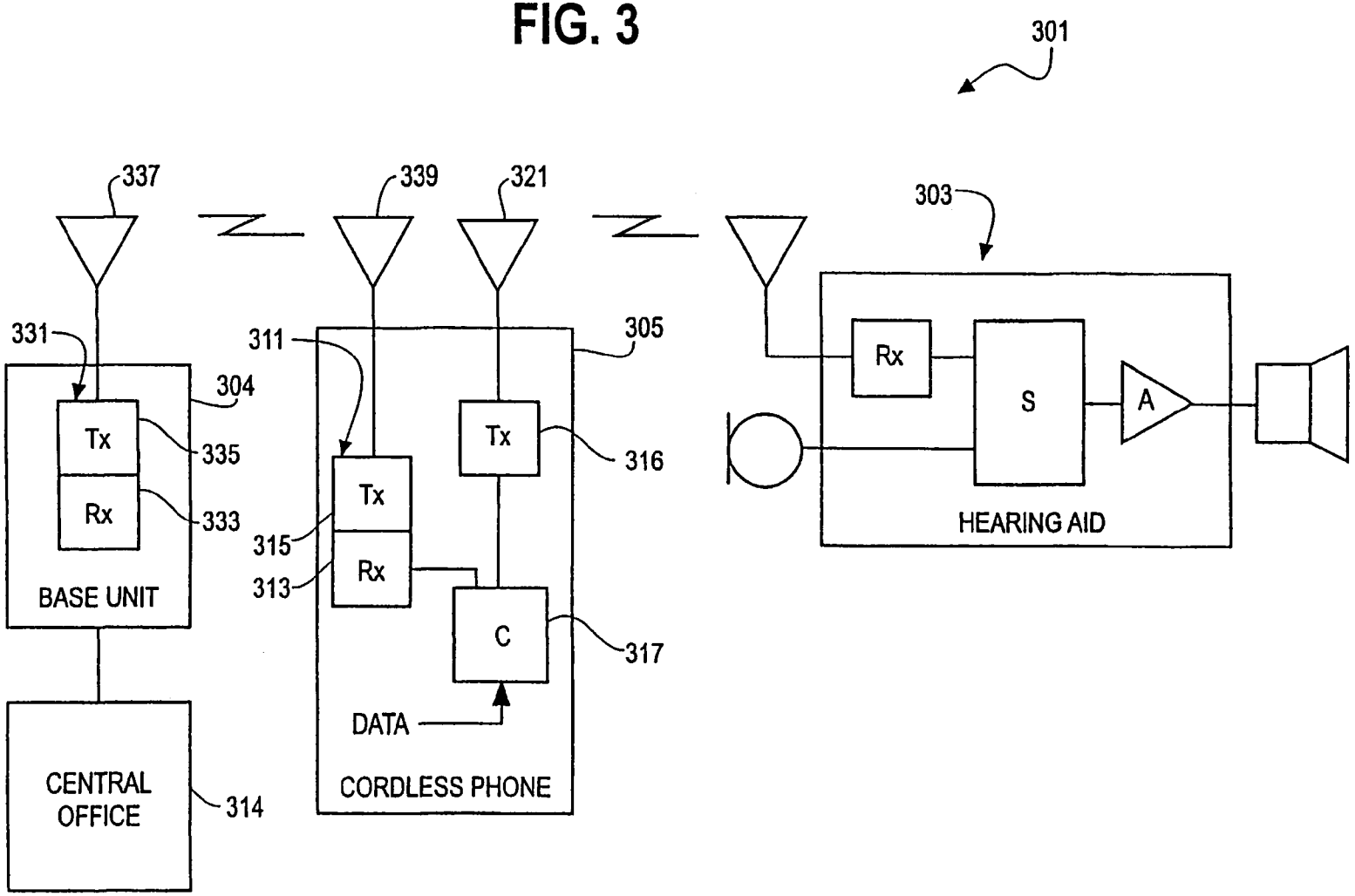
FIG. 3 is a block diagram of a hearing improvement system in accordance with an embodiment of the present invention.

FIG. 3 is a block diagram of another more specific embodiment of an overall hearing improvement system in accordance with the present invention. The system 301 of FIG. 3 is similar to the system 201 of FIG. 2, in that hearing aid 303 of FIG. 3 may have similar components and functionality as the hearing aid 203 discussed above with respect to FIG. 2. However, in the system 301 of FIG. 3, the secondary audio source may be different.

More specifically, the system 301 of FIG. 3 may comprise a cordless telephone 305 rather than a corded telephone as mentioned in FIG. 2. The cordless telephone 305 may have the same component(s) comprising the wireless subsystem for communication with the hearing aid as those found in the corded telephone in FIG. 2. Instead of being hardwired to a central office 314, however, the telephone 305 of FIG. 3 may have a second wireless subsystem for communicating with a base unit 304, which itself may be hardwired to the central office 314.

The base unit 304 may comprise a wireless transceiver 331 having a receiver 333 and a transmitter 335 component, as well as an aerial 337, which may be, for example, an antenna. The cordless telephone 305 may similarly comprise a wireless transceiver 311 having a receiver 313 component and a transmitter 315 component, as well as an aerial 339, which likewise may be, for example, an antenna. Signals received by the receiver 335 from the central office 314 may be transmitted by the transmitter 335 via the aerial 337 to the cordless telephone 305. The receiver 313 of the cordless telephone 305 may receive the signals via the aerial 339. The signals may then be transmitted to signal combiner circuitry 317 of the cordless telephone 305. The signals may then be transmitted via transmitter 316 and aerial 321 of the cordless telephone 305 to the hearing aid 303.

Similar to the telephone 205 of FIG. 2, the telephone 305 of FIG. 3 may include two communication subsystems respectively communicating on two separate and distinct networks. This time, however, the communication subsystems may both (at least partially) be wireless. The telephone 305 may communicate on two personal wireless networks, namely a higher powered one within a home or other premises (which in turn is hardwired to the main telephone network), and a lower powered one involving the hearing aid 303. In all other respects, however, the telephone 305 may have the same functionality as that discussed above with respect to telephone 205 of FIG. 2.

Figure 4:
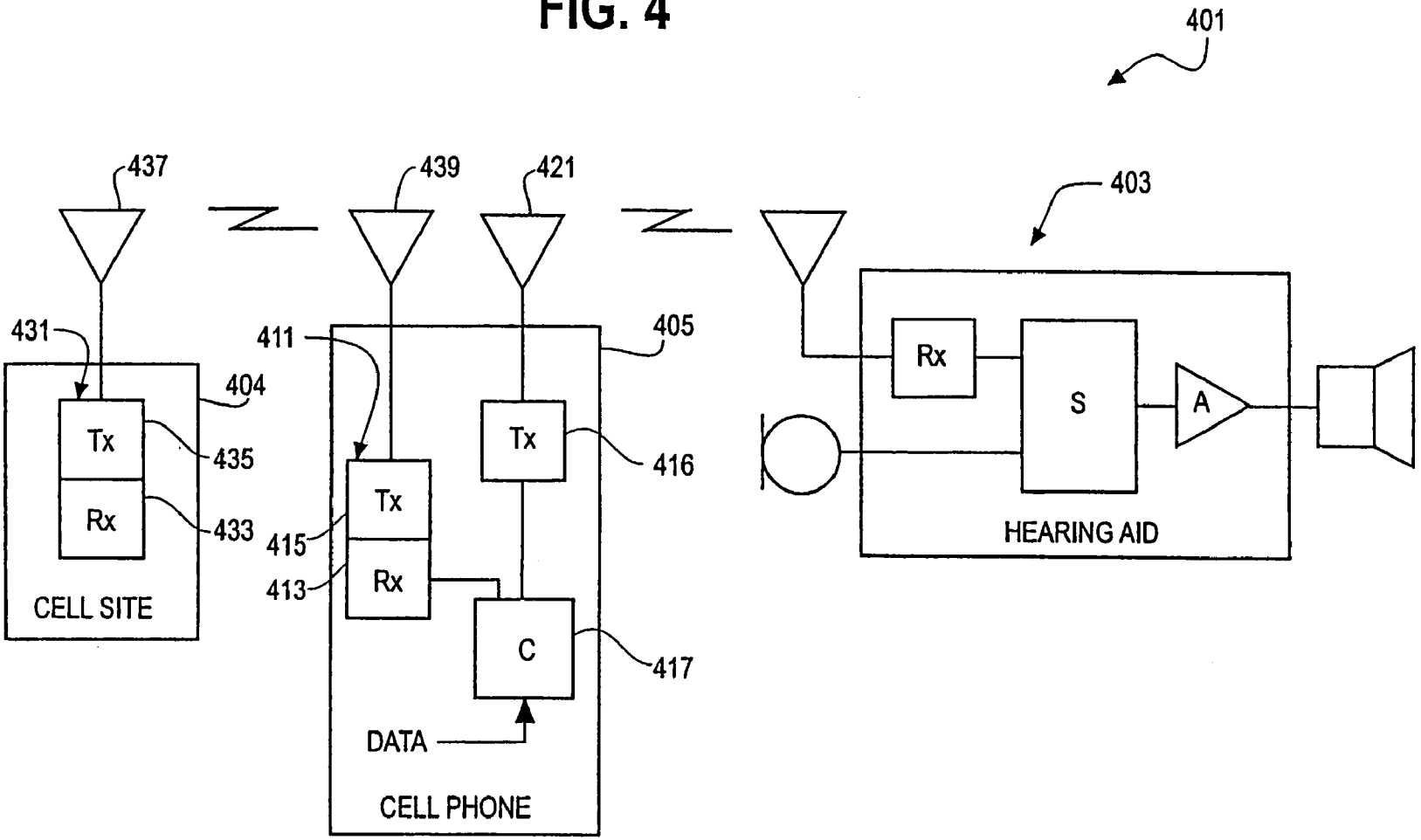
FIG. 4 is a block diagram of a hearing improvement system in accordance with an embodiment of the present invention.

FIG. 4 is a block diagram of a further more specific embodiment of an overall hearing improvement system in accordance with the present invention. The system 401 of FIG. 4 is similar to the system 301 of FIG. 3, in that hearing aid 403 of FIG. 4 may have the same components and functionality of the hearing aid 203 discussed above with respect to FIG. 2. Again, however, in the system 401 of FIG. 4, the secondary audio source may be different.

More specifically, in FIG. 4, the secondary audio source may be a cellular telephone 405. Like the cordless telephone in FIG. 3, the cellular telephone 405 may have the same component(s) comprising the wireless subsystem for communication with the hearing aid as those found in the corded telephone in FIG. 2. Instead of wirelessly communicating with a base unit that is hardwired to a central office, however, the cellular telephone 405 may communicate with a cell site 404 on a wide area cellular network.

The cell site 404 may comprise a wireless transceiver 431 having a receiver 433 and a transmitter 435 component, as well as an aerial 437, which may be, for example, an antenna. The cellular telephone 405 may similarly comprise a wireless transceiver 411 having a receiver 413 component and a transmitter 415 component, as well as an aerial 439, which likewise may be, for example, an antenna. Signals received via the wide area cellular network by the receiver 435 of the cell site 404 may be transmitted by the transmitter 435 via the aerial 437 to the cellular telephone 405. The receiver 413 of the cellular telephone 405 may receive the signals via the aerial 439, which signals may then be transmitted to signal combiner circuitry 417 of the cellular telephone 405. The signals may then be transmitted via transmitter 416 and aerial 421 of the cellular telephone 405 to the hearing aid 403.

Similar to the telephones 205 and 305 of FIGS. 2 and 3, respectively, the telephone 405 of FIG. 4 may include two communication subsystems respectively communicating on two separate and distinct networks. This time, however, the communication subsystems may both be entirely wireless. The cellular telephone 405 not only may communicate on a high-powered wide area cellular network, but also a lower powered one involving the hearing aid 403. In all other respects, however, the telephone 405 may have the same functionality as that discussed above with respect to telephone 205 of FIG. 2.

Figure 5:
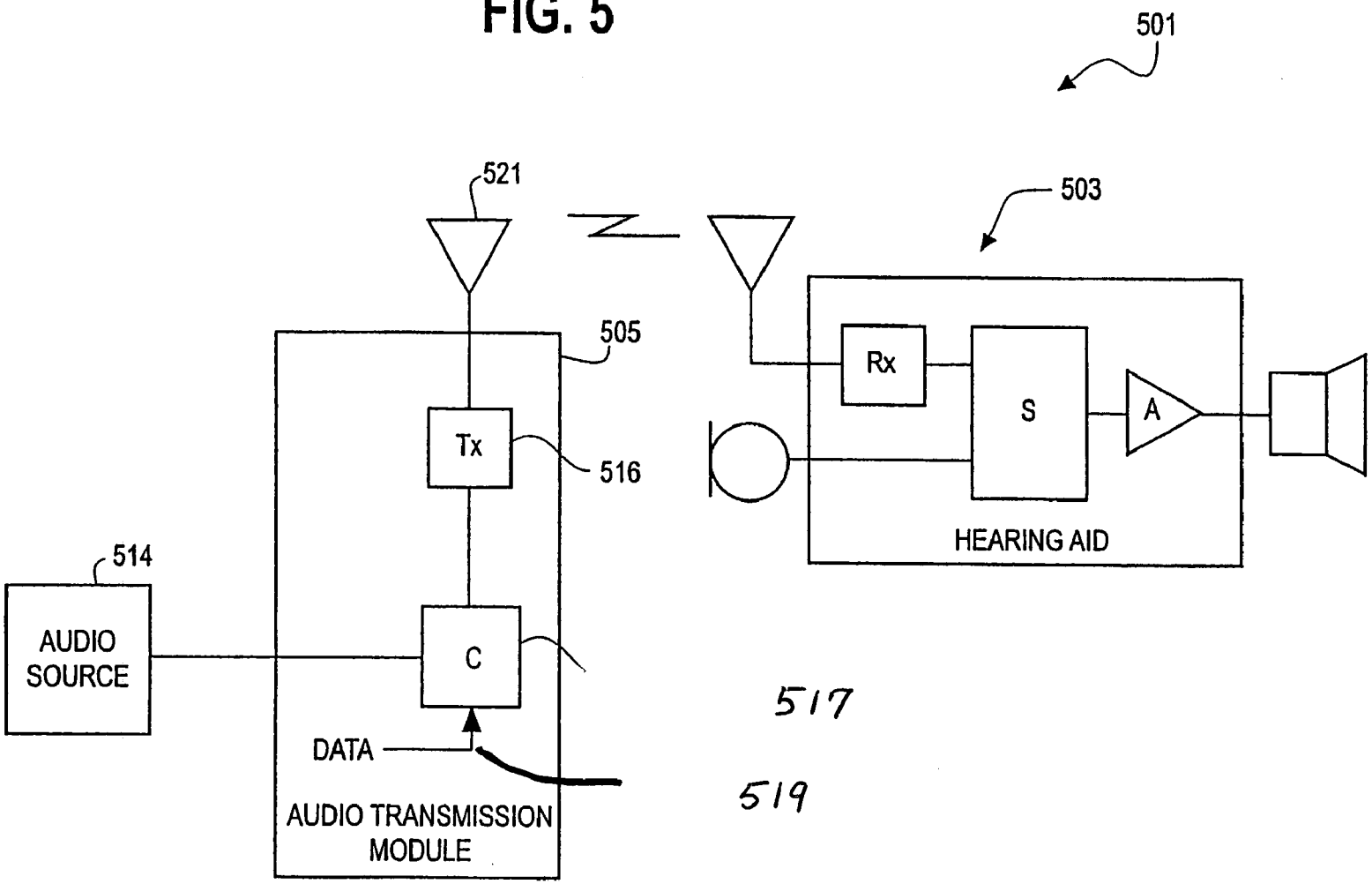
FIG. 5 is a block diagram of a hearing improvement system in accordance with an embodiment of the present invention.

FIG. 5 is a block diagram of a still further more specific embodiment of an overall hearing improvement system in accordance with the present invention. The system 501 of FIG. 5 may be similar to the systems 301 of FIG. 3 and 401 of FIG. 4, in that hearing aid 503 of FIG. 5 may have the same components and functionality of the hearing aid 203 discussed above with respect to FIG. 2. In the system 501 of FIG. 5, however, the secondary audio source may be different altogether.

More specifically, the secondary audio source of FIG. 5 may be an audio transmission module 505. The audio transmission module may comprise signal combiner circuitry 517 hardwired to an audio source 514. The audio source 514 may be, for example, a stereo or other home entertainment system, movie audio at a movie theatre, car audio, etc. The combiner circuitry 517 of the module 505 may transmit audio signals received by the receiver from the audio source 514 and/or data signals received at the data input 519, to the transmitter 516. Signals received by the transmitter 516 from the combiner circuitry 517 may be transmitted wirelessly to the hearing aid 503 via an aerial 521. The transmitter 516 and aerial 521 combination may be, for example, a radio frequency transmitter and antenna, or an inductive coil.

The audio transmission module 505 may, for example, be located in the seat back of a chair proximate the head position of a person sitting in the chair or in a head-rest of a chair. In operation, the hearing aid user may bring the user's ear into proximity of the transmission module 505. The circuitry of the hearing aid 503 may detect wireless signals being transmitted by the audio transmission module 505. The hearing aid user then, if selection of the wireless signals is applicable, may hear directly from the audio source 514 signals that would otherwise have been picked up via microphone of the hearing aid 503 from audio in the listening room.

The wireless subsystem of the audio transmission module 505 may be continuously activated, manually activated by a user, or may be automatically activated when the module 505 receives audio data or senses that the hearing aid 503 has been brought in proximity of the module 505.

Figure 6:
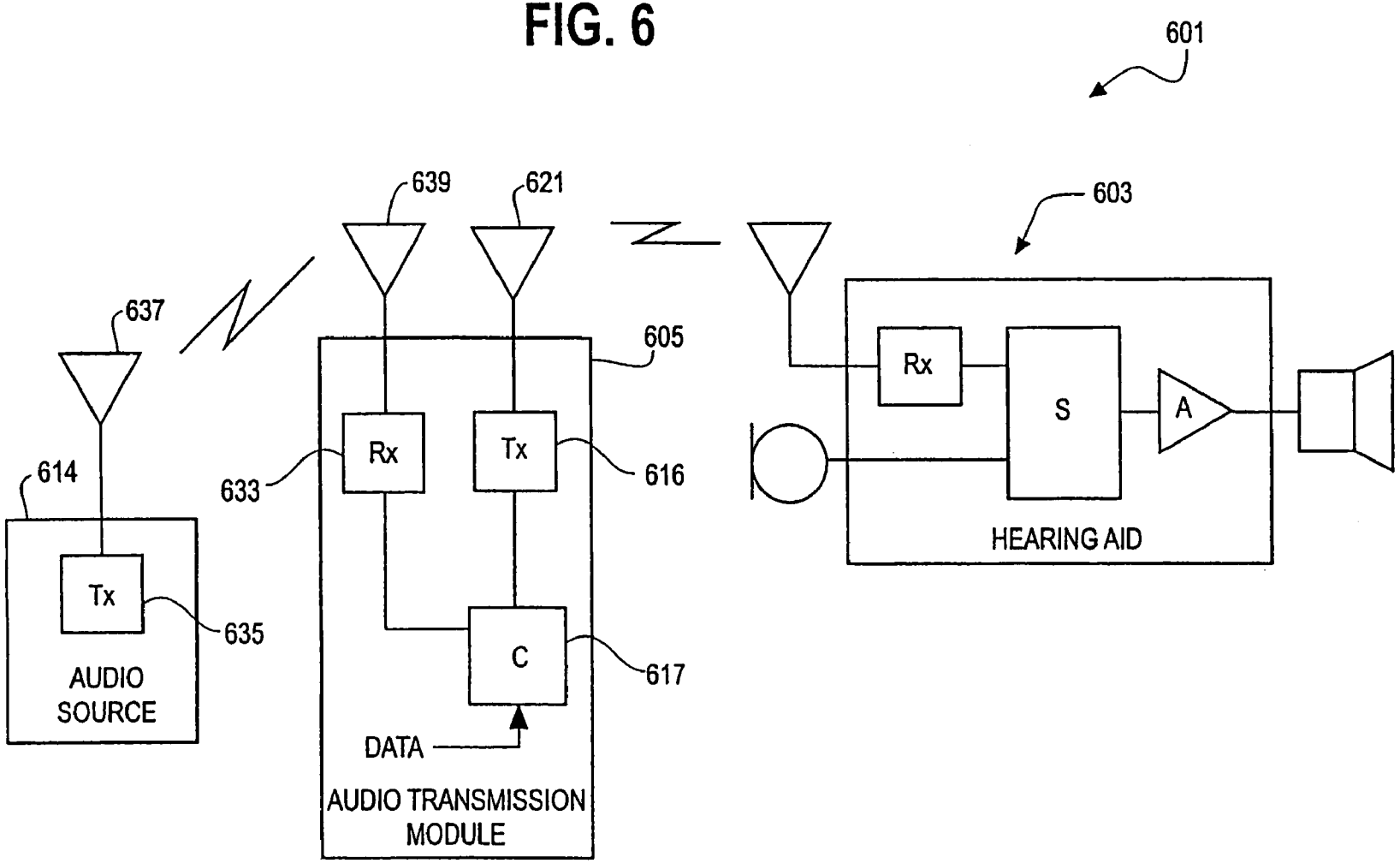
FIG. 6 is a block diagram of hearing improvement system in accordance with an embodiment of the present invention.

FIG. 6 is a block diagram of yet another more specific embodiment of an overall hearing improvement system in accordance with the present invention. The system 601 of FIG. 6 may be similar to the system 501 of FIG. 5, in that hearing aid 603 of FIG. 6 may have the same components and functionality of the hearing aid 203 discussed above with respect to FIG. 2. In addition, the secondary audio source of FIG. 6 may be an audio transmission module 605, similar to audio transmission module 505 of FIG. 5. This time, however, the audio transmission module 605 may not be hard wired to the audio source. Instead, communication between the audio source 614 and audio transmission module 605 may be wireless.

The audio transmission module 605 may have the same component(s) comprising the wireless subsystem for communication with the hearing aid as those found in the audio transmission module 505 of FIG. 5. The audio transmission module 605, however, may further comprise a receiver 633 component and an aerial 639, which may be, for example, an antenna, for wirelessly receiving audio signals from the audio source 614. The audio source 614 may comprise a transmitter 635 and an aerial 637, which similarly may be, for example, an antenna.

In operation, the audio source 614 may transmit audio signals via the aerial 637 to the audio transmission module 605. Signals received by the receiver 633 of the audio transmission module 605 from the audio source 614 may be transmitted to combiner circuitry 617, which may forward the audio signals to the transmitter 616. Those signals may be transmitted wirelessly to the hearing aid 603 via the aerial 621. Again, the transmitter 616 and aerial 621 combination may be, for example, a radio frequency transmitter and antenna or an inductive coil.

Because the audio transmission module 605 may be wireless (and thus may not to be wired to the audio source 614), the audio transmission module 605 may be located just about anywhere in a room or premises within range of the audio source 614. In addition, the audio transmission module 605, like the cordless telephone of FIG. 3, may operate on two separate personal wireless networks, a higher powered one involving the audio source 614 and a lower powered one involving the hearing aid 603. Aside from wireless receipt of signals from the audio source 614, the audio transmission module 605 may operate in the same manner as the audio transmission module 505 of FIG. 5.

Figure 7:
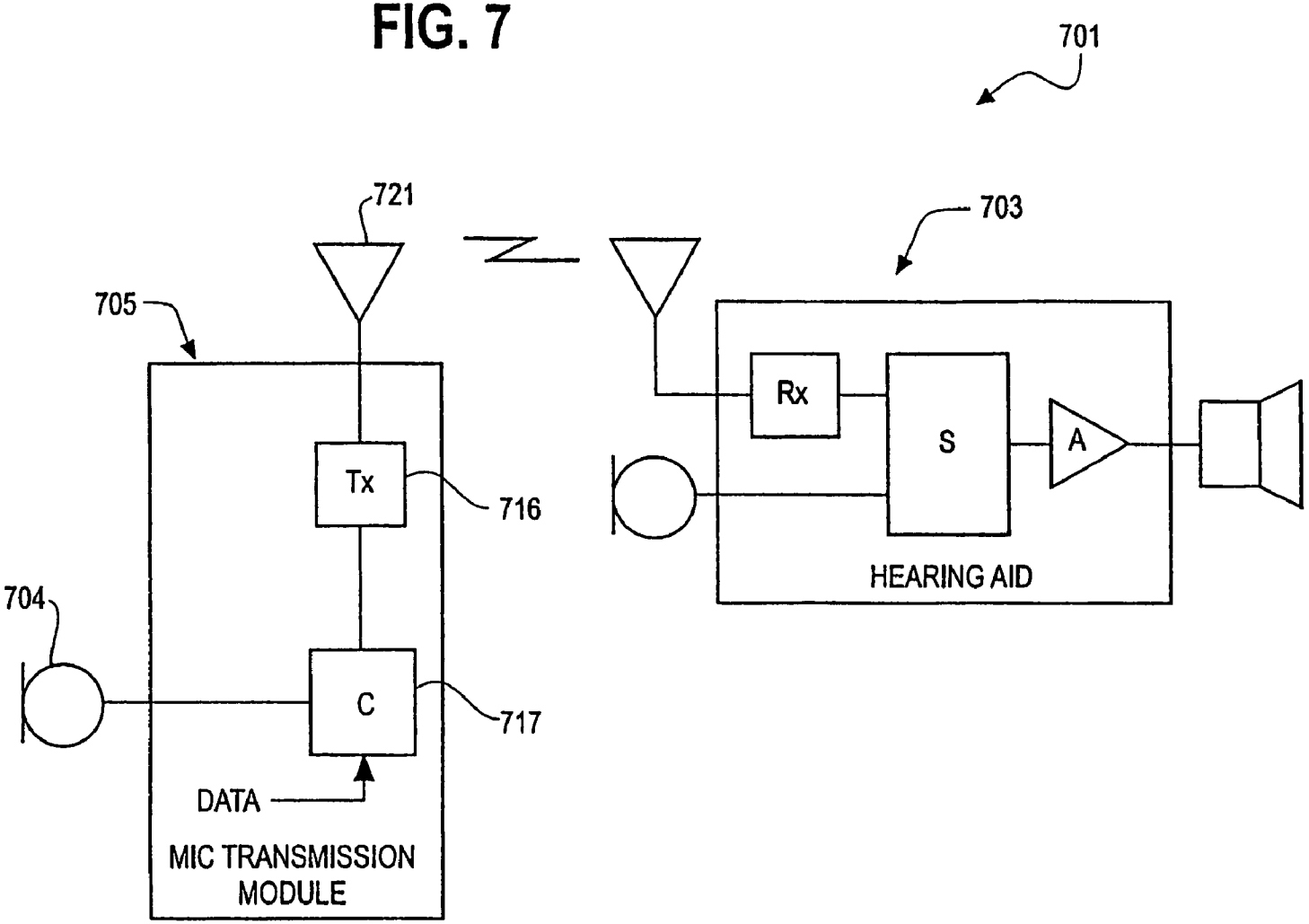
FIG. 7 is a block diagram of hearing improvement system in accordance with an embodiment of the present invention.

FIG. 7 is a block diagram of still another more specific embodiment of an overall hearing improvement system in accordance with the present invention. The system 701 of FIG. 7 may be similar to those discussed above, in that hearing aid 703 of FIG. 7 may have the same components and functionality of the hearing aid 203 discussed above with respect to FIG. 2. In addition, the secondary audio source of FIG. 7 may be an audio transmission module similar to audio transmission modules 505 and 605 of FIGS. 5 and 6, respectively. In FIG. 7, however, the audio transmission module may be a microphone transmission module 705. Instead of receiving audio signals from an audio source, such as a home entertainment system, the microphone transmission module 705 may pick up sound from a microphone 704 that is distinct from the microphone of the hearing aid 703. In all other respects, the audio transmission module 705 may operate in the same manner as, and be positioned in the same environments as the audio transmission module 505 of FIG. 5.

The microphone 704 of the microphone transmission module 705 may be, for example, a directional microphone array or other directional microphone. The microphone transmission module 705 may be worn or otherwise supported by the hearing aid user, or even a talker if the talker is within range for wireless transmission between the microphone transmission module 705 and the hearing aid 703. The microphone transmission module 705 may have the same component(s) comprising the wireless subsystem for communication with the hearing aid as those found in the audio transmission module 505 of FIG. 5. In addition, the microphone transmission module 705 may be continuously activated, manually activated by a user, or may be automatically activated when the module 705 receives audio transmissions or senses that the hearing aid 703 has been brought in proximity of the module 705 (or vice versa).

In operation, the microphone 704 may pick up audio sounds and converts the audio sounds into audio signals. The signals may then be transmitted to combiner circuitry 717, which may forward the audio signals to the transmitter 716. Those signals may be transmitted wirelessly to the hearing aid 703 via the aerial 721. As previously, the transmitter 716 and aerial 721 combination may be, for example, a radio frequency transmitter and antenna or an inductive coil.

Figure 8:
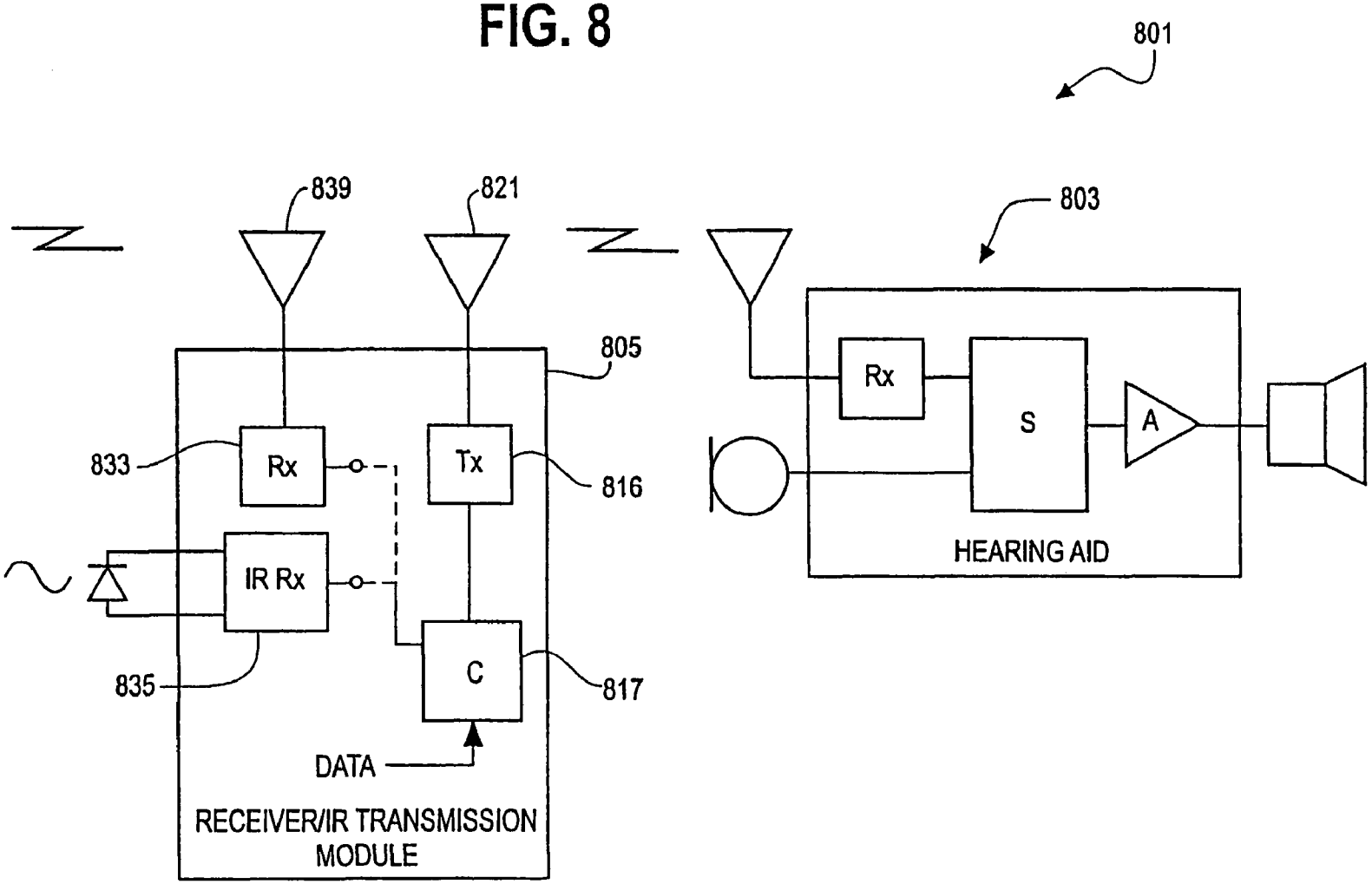
FIG. 8 is a block diagram of a hearing improvement system in accordance with an embodiment of the present invention.

FIG. 8 is a block diagram of a further more specific embodiment of an overall hearing improvement system in accordance with the present invention. The system 801 of FIG. 8 may be similar to the system 701 of FIG. 7. In FIG. 8, however, the transmission module 805 may receive wireless audio signals from an external audio source, which may be any type of audio source including a "remote" microphone. The transmission module 805 may have the same component(s) comprising the wireless subsystem for communication with the hearing aid as those found in the audio transmission module 505 of FIG. 5. In addition, the audio transmission module 805 may generally operate in the same manner as the audio transmission module 505 of FIG. 5.

The transmission module 805 may further comprise a receiver 833 component and/or an infrared receiver 835 component. The transmission module 805 may receive audio signals via the receiver 833 and the aerial 839, which may be, for example, an antenna. Alternatively, the transmission module 805 may receive infrared audio signals via the infrared receiver 835. The signals may then be transmitted to combiner circuitry 817, which may forward the audio signals to the transmitter 816. Those signals may be transmitted wirelessly to the hearing aid 803 via the aerial 821. As with other embodiments, the transmitter 816 and aerial 821 combination may be, for example, a radio frequency transmitter and antenna or an inductive coil.

Figure 9:
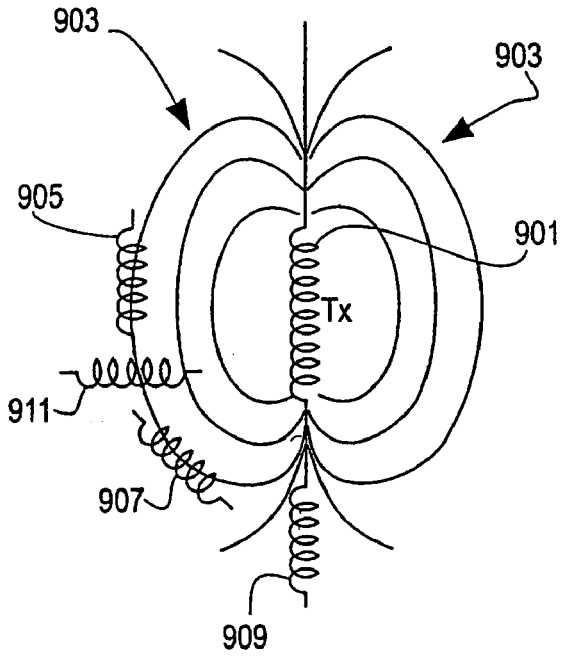
FIG. 9 is a diagram illustrating a component orientation guideline for wireless communication between a secondary audio source and a hearing aid in accordance with an embodiment of the present invention.

FIG. 9 illustrates a component orientation guideline for wireless communication between a secondary audio source and a hearing aid in accordance with the present invention. FIG. 9 illustrates a guideline for the case of inductive wireless transmission. A transmitting coil 901 is illustrated surrounded by a magnetic field 903. Location of the receiving coil at positions 905 and 909 relative to transmitting coil 901 are advantageous. Locations, such as position 907, that are generally aligned with the magnetic field 903, are also acceptable. Locations, such as position 911, that are aligned perpendicularly to the magnetic field, should be avoided, however, due to the null (cancelled field) located at such positions.

Figure 9A:
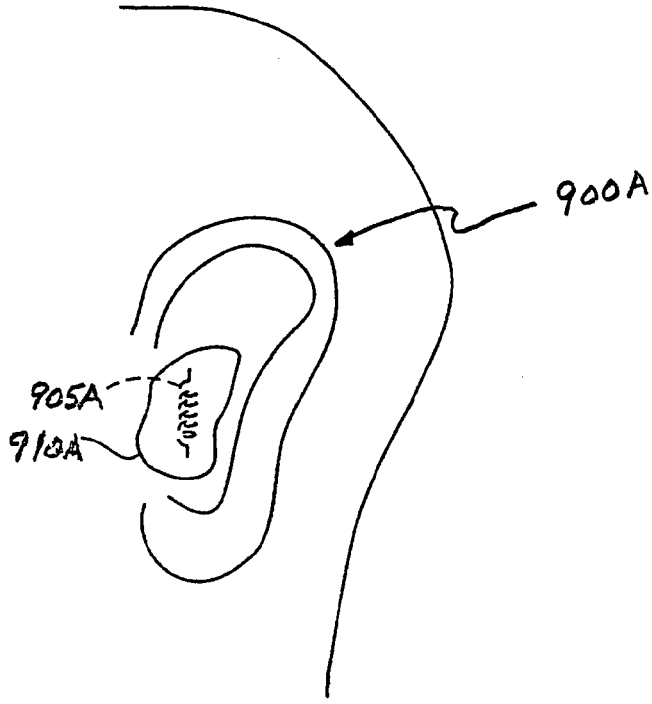
FIG. 9A is a diagram illustrating a side view of a head of a user wearing an in-the-ear (ITE) type of hearing aid in accordance with an embodiment of the present invention.

FIG. 9A shows a side view of the head of a user wearing an in-the-ear (ITE) type of hearing aid 910A. ITE hearing aid 910A may contain telecoil 905A, which in the illustration is shown in a vertical orientation. Other orientations of telecoil 910A within ITE hearing aid 910A are also possible, however a vertical orientation may most frequently be used for compatibility with room loop systems and neck loops, while maintaining adequate compatibility with telephone receivers. As discussed above with respect to FIG. 9, the orientation of telecoil 905A provides greater sensitivity by being vertically oriented with the lines of magnetic flux, such as those generated by coil 901 of FIG. 9.

Figure 9B:
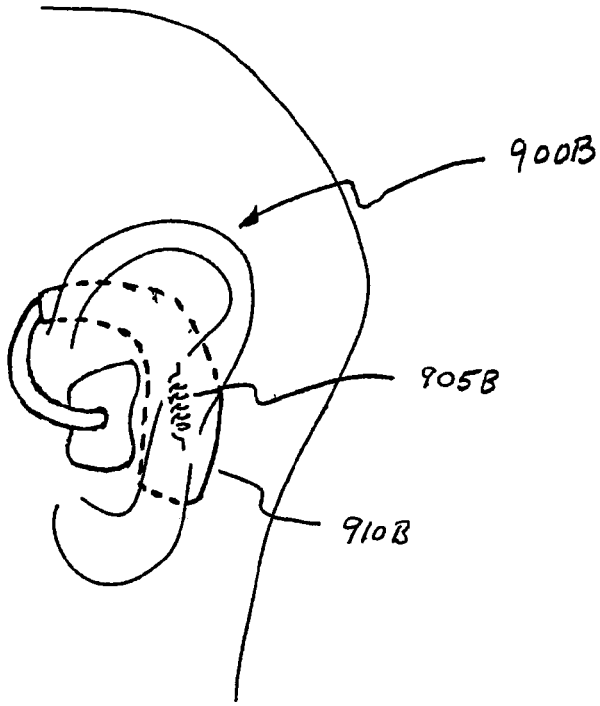
FIG. 9B is a diagram illustrating a side view of a head of a user wearing a behind-the-ear (BTE) type of hearing aid in accordance with an embodiment of the present invention.

FIG. 9B illustrates a side view of the head of a user wearing a behind-the-ear (BTE) type of hearing aid 910B. This type of hearing aid may be positioned behind the curve of the outer ear, between the outer ear and the head. BTE hearing aid 910B may be equipped with telecoil 905B. The primarily vertical orientation of BTE hearing aid 910B permits telecoil 905B to be vertically oriented and of greater length and sensitivity than that in the ITE hearing aid of FIG. 9A. As with the ITE hearing aid 910A illustrated in FIG. 9A, the orientation of telecoil 905B provides greater sensitivity to magnetic fields whose flux lines are primarily vertical, such as the lines of flux created by coil 901 of FIG. 9.

Figure 10:
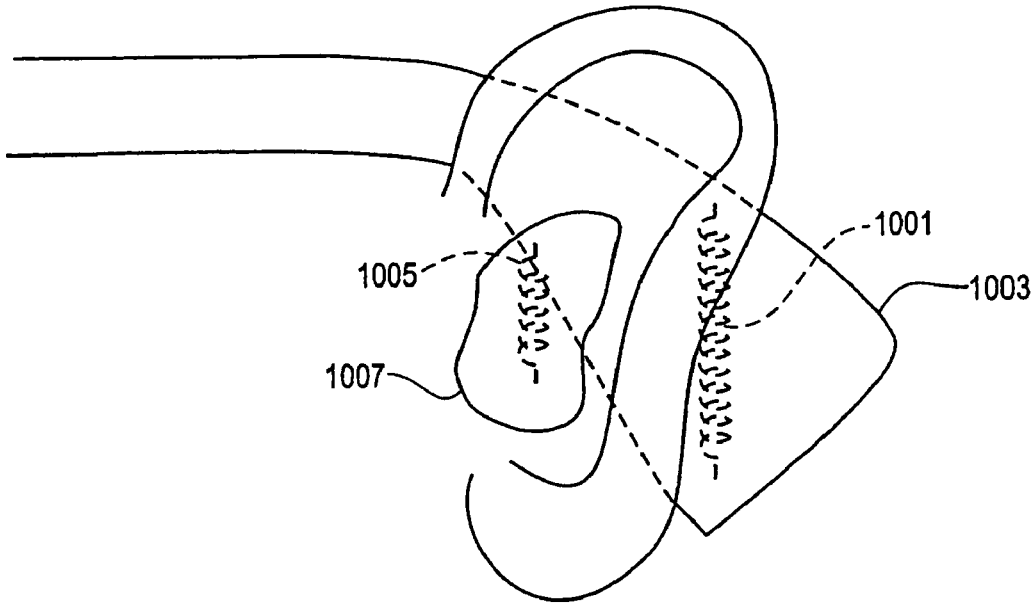
FIG. 10 is a diagram illustrating positioning of a transmitting coil relative to a receiving coil based upon the guidelines of FIG. 9 in accordance with an embodiment of the present invention.

FIG. 10 illustrates an advantageous positioning of a transmitting coil relative to a receiving coil based on the guidelines of FIG. 9. Transmitting coil 1001, located in or on a glasses frame 1003, may be positioned parallel and to the side of a receiving coil 1005 located within a hearing aid 1007.

Figure 11:
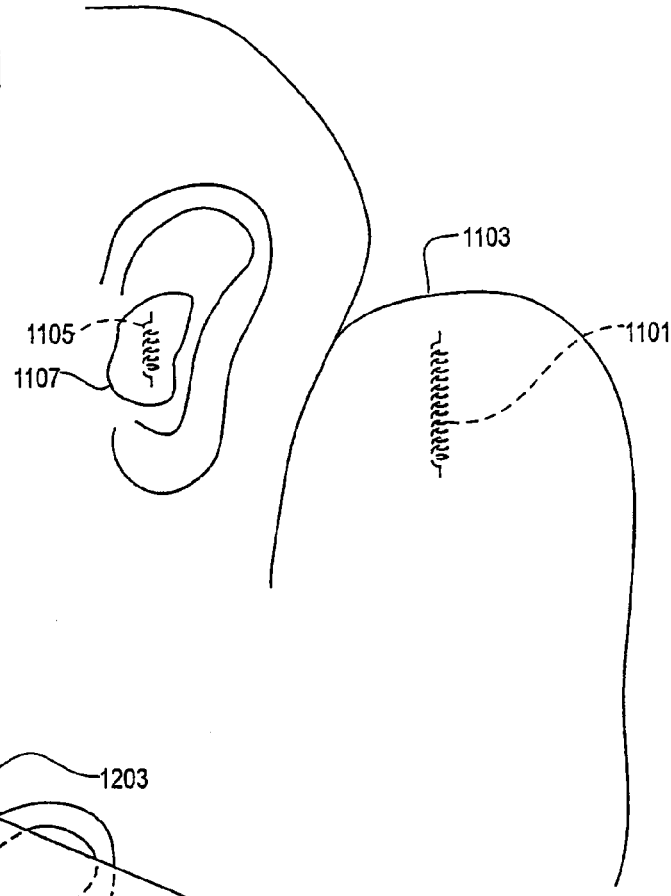
FIG. 11 is a diagram illustrating positioning of a transmitting coil relative to a receiving coil based upon the guidelines of FIG. 9 in accordance with an embodiment of the present invention.

FIG. 11 illustrates an advantageous positioning of a transmitting coil relative to a receiving coil in another embodiment based on the guidelines of FIG. 9. Transmitting coil 1101, located in seat back or headrest 1103, may similarly be positioned parallel and to the side of a receiving coil 1105 located within a hearing aid 1107 when the hearing aid user is in a seated position. This relative positioning will be generally maintained with normal left-right head movements.

Figure 12:
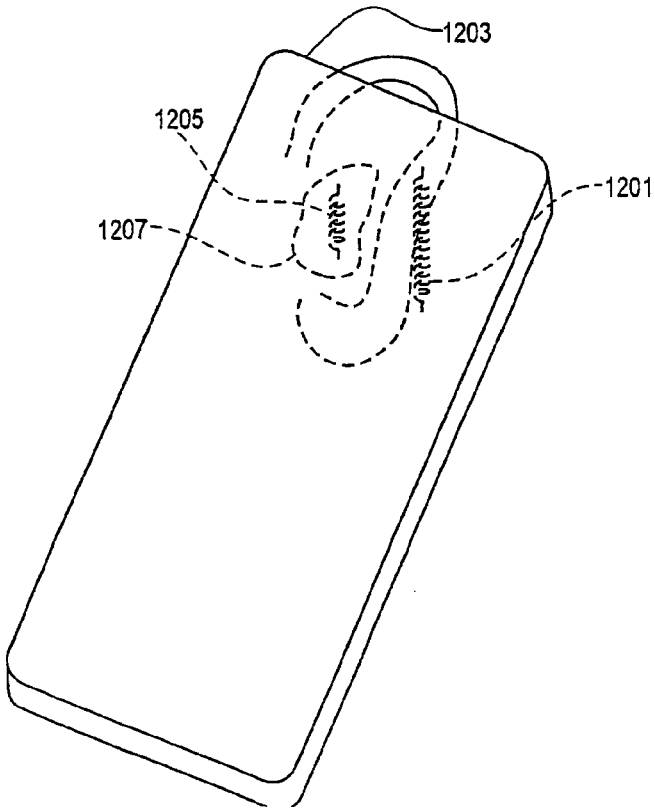
FIG. 12 is a diagram illustrating positioning of a transmitting coil relative to a receiving coil based upon the guidelines of FIG. 9 in accordance with an embodiment of the present invention.

FIG. 12 illustrates an advantageous positioning of a transmitting coil relative to a receiving coil in yet another embodiment based on the guidelines of FIG. 9. Transmitting coil 1201, located in telephone 1203, may similarly be positioned parallel and to the side of a receiving coil 1205 located within a hearing aid 1207 when the phone is located proximate the ear in a typical manner.

Figure 13:
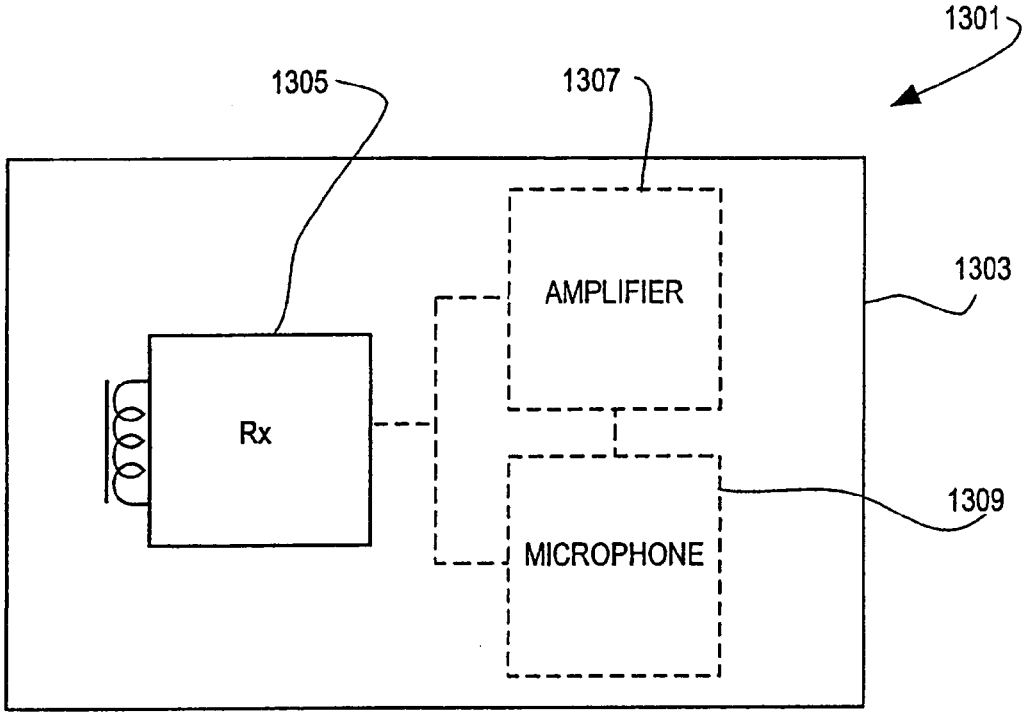
FIG. 13 is a diagram illustrating a module for use with a hearing aid in accordance with an embodiment of the present invention.

Certain components used by the hearing improvement system of the present invention may be integrated into a single module manufactured/assembled separately and incorporated into or with the hearing aids or secondary audio sources contemplated by the present invention. For example, FIG. 13 illustrates a block diagram of such a module for incorporation with a hearing aid. Module 1301 may comprise a hearing aid faceplate 1303 that may incorporate a receiver component 1305 having an inductive coil. The faceplate 1303 may also incorporate a hearing aid amplifier 1307 and/or a hearing aid microphone 1309 operatively coupled to the receiving component 1305. The module 1301 may be pre-assembled as a unit to install the faceplate 1303 onto a hearing aid shell and connect other appropriate components. Alternatively, the components 1305, 1307 and 1309 may be integrated into a module that does not include the faceplate 1303, for example, for use with BTE type hearing aids or other types of listening devices.

Figure 14A:
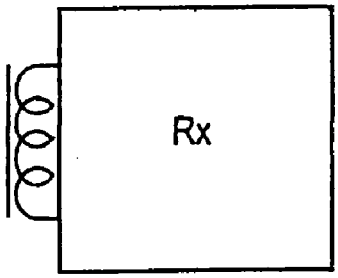
FIGS. 14A, 14B and 14C are block diagrams illustrating different potential modules for insertion into or incorporation with a hearing aid in accordance with an embodiment of the present invention.
Figure 14B:
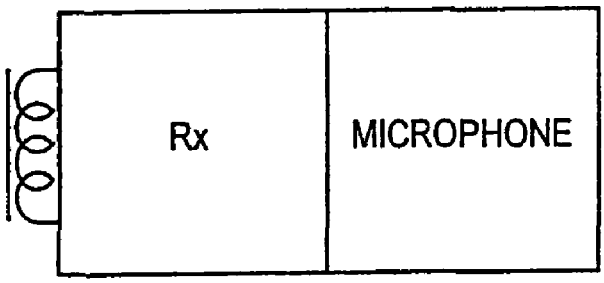
Figure 14C:
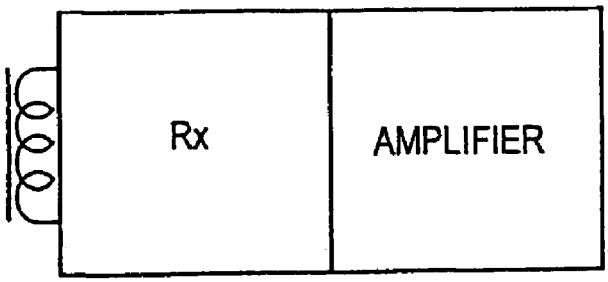

FIGS. 14A, 14B and 14C illustrate block diagrams for different potential modules for insertion into or incorporation with a hearing aid. FIG. 14A illustrates a module comprising a receiver component having an inductive coil or other type of antenna. FIG. 14B illustrates a module having a receiver component having an inductive coil (or other type of antenna), as well as an integrated microphone component. FIG. 14C illustrates a module having a receiver component having an inductive coil (or other type of antenna), as well as an integrated amplifier component.

Like the module(s) of FIG. 13, the modules of FIG. 14 may be pre-assembled and as a unit to install the module into the hearing aid or other device and connect other appropriate components.

Figure 15A:
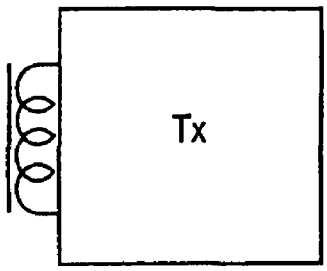
FIGS. 15A, 15B and 15C are block diagrams illustrating different potential modules for insertion into or incorporation with an additional audio source in accordance with an embodiment of the present invention.
Figure 15B:
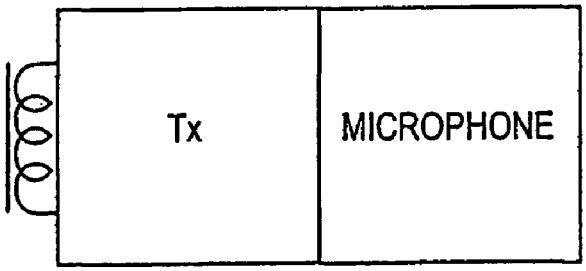
Figure 15C:
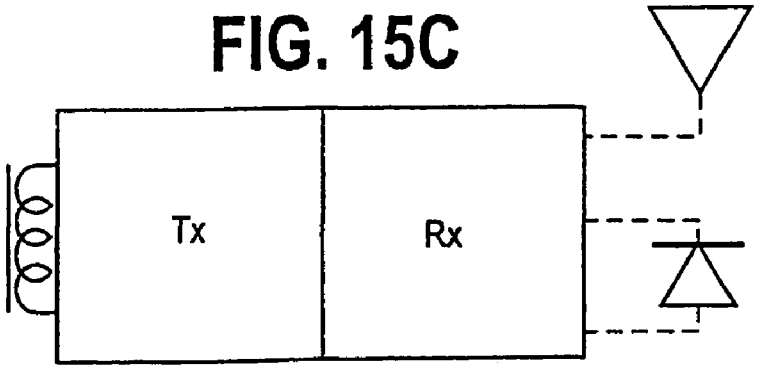

FIGS. 15A, 15B and 15C illustrate block diagrams for different potential modules for insertion into or incorporation with a secondary audio source. FIG. 15A illustrates a module comprising a transmitter component having an inductive coil or other type of antenna. FIG. 15B illustrates a module having a transmitter component having an inductive coil (or other type of antenna), as well as an integrated microphone component. FIG. 15C illustrates a module having a receiver component, in addition to a transmitter component having an inductive coil (or other type of antenna). These modules may be pre-assembled as a unit to install the module into the secondary audio source and connect the appropriate components.

Figure 16:
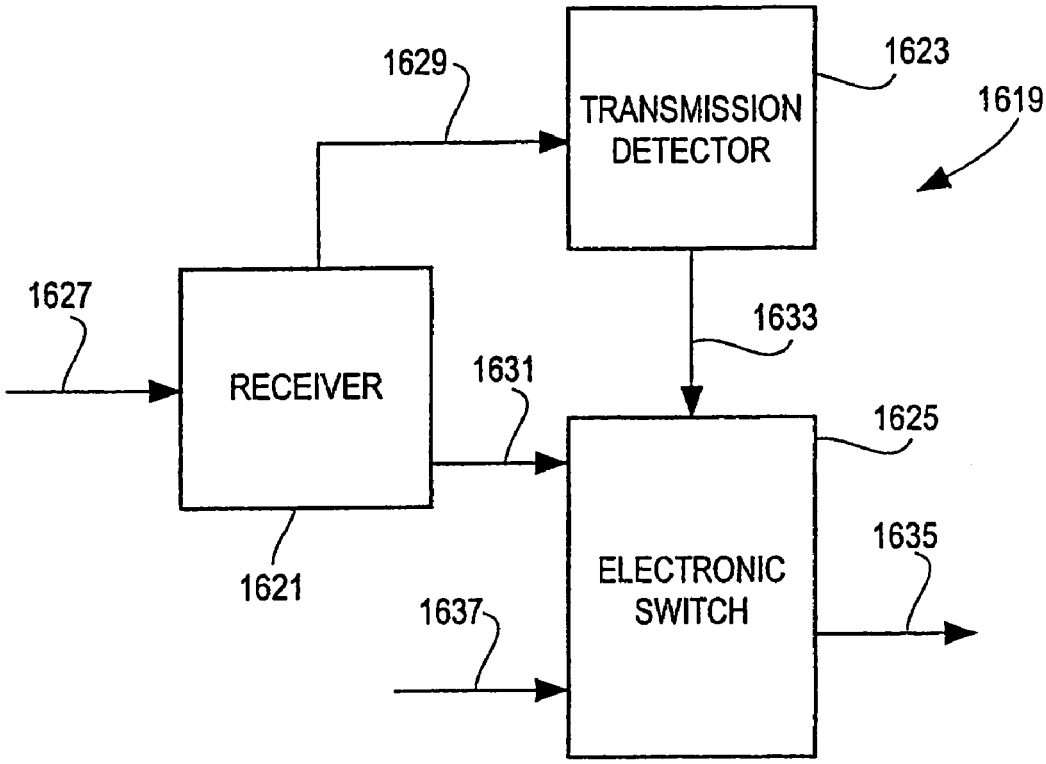
FIG. 16 is a block diagram illustrating a transmission detection and switch system in accordance with an embodiment of the present invention.

FIG. 16 is a block diagram of one embodiment of the transmission detection and switch system of the present invention. A transmission detection and switch system 1619 may comprise three basic components, a receiver 1621, a transmission detector 1623, and an electronic switch 1625. The receiver 1621 may receive an input signal 1627 from a secondary audio source (not shown). Upon receipt of the input signal 1627, the receiver 1621 may generate a detector input signal 1629, as well as an audio output signal 1631 representative of the input signal 1627. The transmission detector 1623 may receive the detector input signal 1629, and may generate in response a control signal 1633 for the electronic switch 1625. The electronic switch 1625 may be controlled by the status of the control signal 1633.

More specifically, for example, if the transmission detector 1623 determines from the detector input signal 1629 that the input signal 1627 represents a desired transmission (e.g., a signal above a certain threshold value), the detector 1623 may indicate to the electronic switch 1625, using control signal 1633, that a signal is present. The electronic switch 1625 may select audio output 1631 (representative of the input signal 1627 from the secondary audio source) and may provide the audio output 1631 as signal 1635 to hearing aid or other type of circuitry (not shown).

If, on the other hand, the transmission detector 1623 determines from the detector input signal 1629 that the input signal 1629 is not representative of a desired signal (e.g., below a certain threshold value), the detector 1623 may indicate to the electronic switch 1625, again using control signal 1633, that no signal is present. The switch may then instead select audio output signal 1637 from the primary audio source (e.g., a hearing aid microphone), and may provide the audio output signal 1637 as signal 1635 to the hearing aid or other type of circuitry (not shown).

Figure 17:
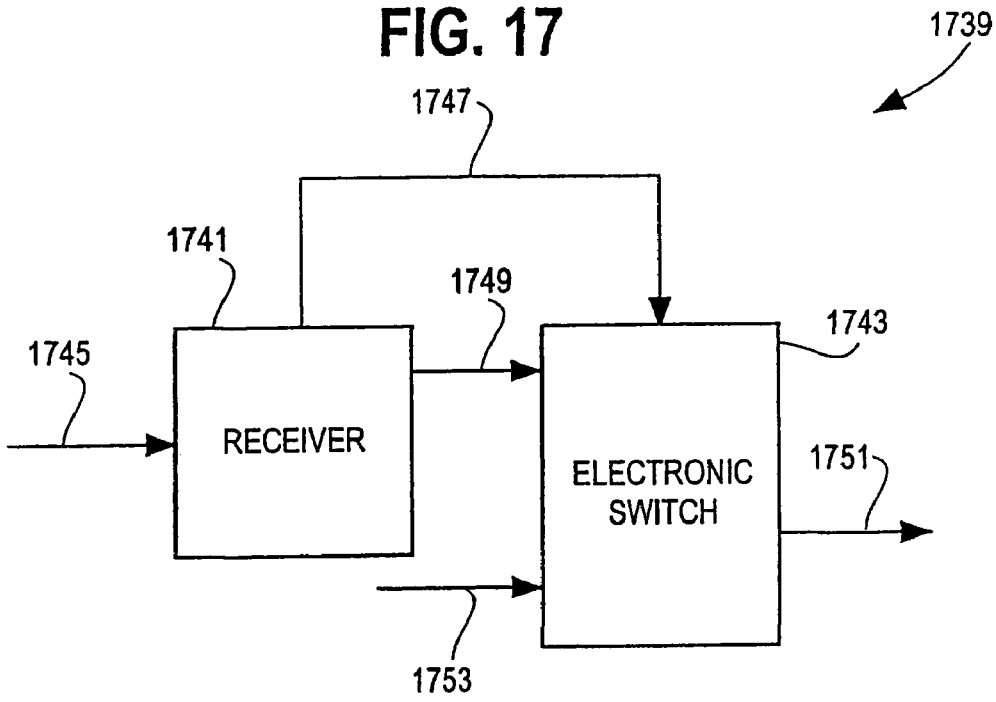
FIG. 17 is a block diagram illustrating a transmission detection and switch system in accordance with an embodiment of the present invention.

FIG. 17 is a block diagram of another embodiment of the transmission detection and switch system of the present invention. A transmission detection and switch system 1739 may comprise a receiver 1741 and an electronic switch 1743. The receiver 1741 may receive an input signal 1745 from a secondary audio source (not shown). If the input signal 1745 is a desired signal, then receiver 1741 may generate a control signal 1747 for the electronic switch 1743. If the input signal 1745 is not a desired signal, then no control signal is generated by the receiver 1741. In either case, the desirability of the signal may be determined by, for example, the receiver 1741 or circuitry associated therewith.

If the electronic switch 1743 receives the control signal 1747 from the receiver 1741, the electronic switch may select receiver output signal 1749, which is an audio output signal representative of input signal 1745 from the secondary audio source (not shown), and provides receiver output signal 1749 as signal 1751 to hearing aid circuitry (not shown).

If, on the other hand, the electronic switch 1743 does not receive the control signal 1747 from the receiver 1741, then the electronic switch may select audio output signal 1753 from the primary audio source (e.g., a hearing aid microphone), and provides the audio output signal 1753 as signal 1751 to the hearing aid circuitry (not shown).

Figure 18:
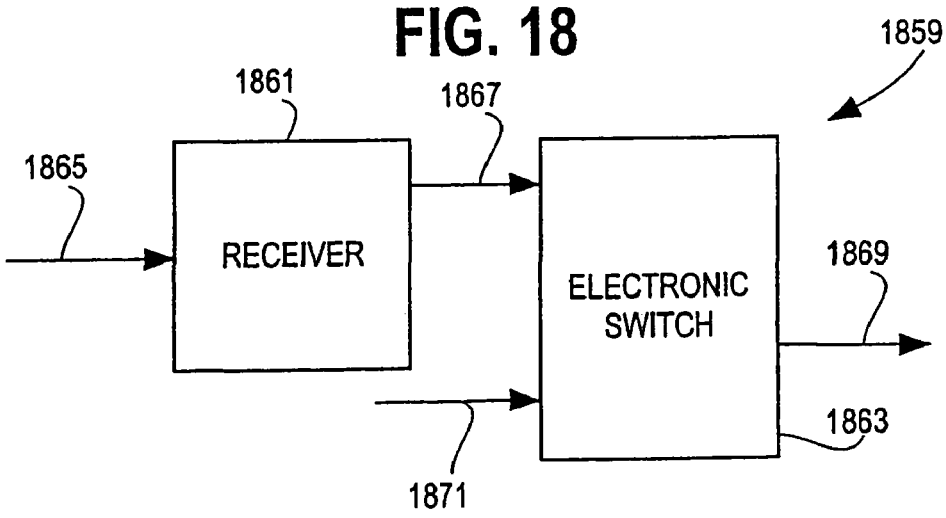
FIG. 18 is a block diagram illustrating a transmission detection and switch system in accordance with an embodiment of the present invention.

FIG. 18 is a block diagram of a further embodiment of the transmission detection and switch system of the present invention. A transmission detection and switch system 1859 may comprise a receiver 1861 and an electronic switch 1863. The receiver 1861 may receive an input signal 1865 from a secondary audio source (not shown), and may generate an audio output signal 1867 representative of the input signal 1865 for transmission to electronic switch 1863. The electronic switch 1863 may receive the audio output signal 1867, and, if it is determined that the audio output signal 1867 is a desired signal, the electronic switch 1863 may provide the audio output signal 1867 as signal 1869 to hearing aid circuitry (not shown). If, on the other hand, it is determined that the audio output signal 1867 is not a desired signal, the electronic switch 1863 may provide audio output signal 1871 as signal 1869 to the hearing aid circuitry (not shown). In either case, the desirability of the signal 1867 may be determined by the electronic switch 1863 or circuitry associated therewith.

Figure 19:
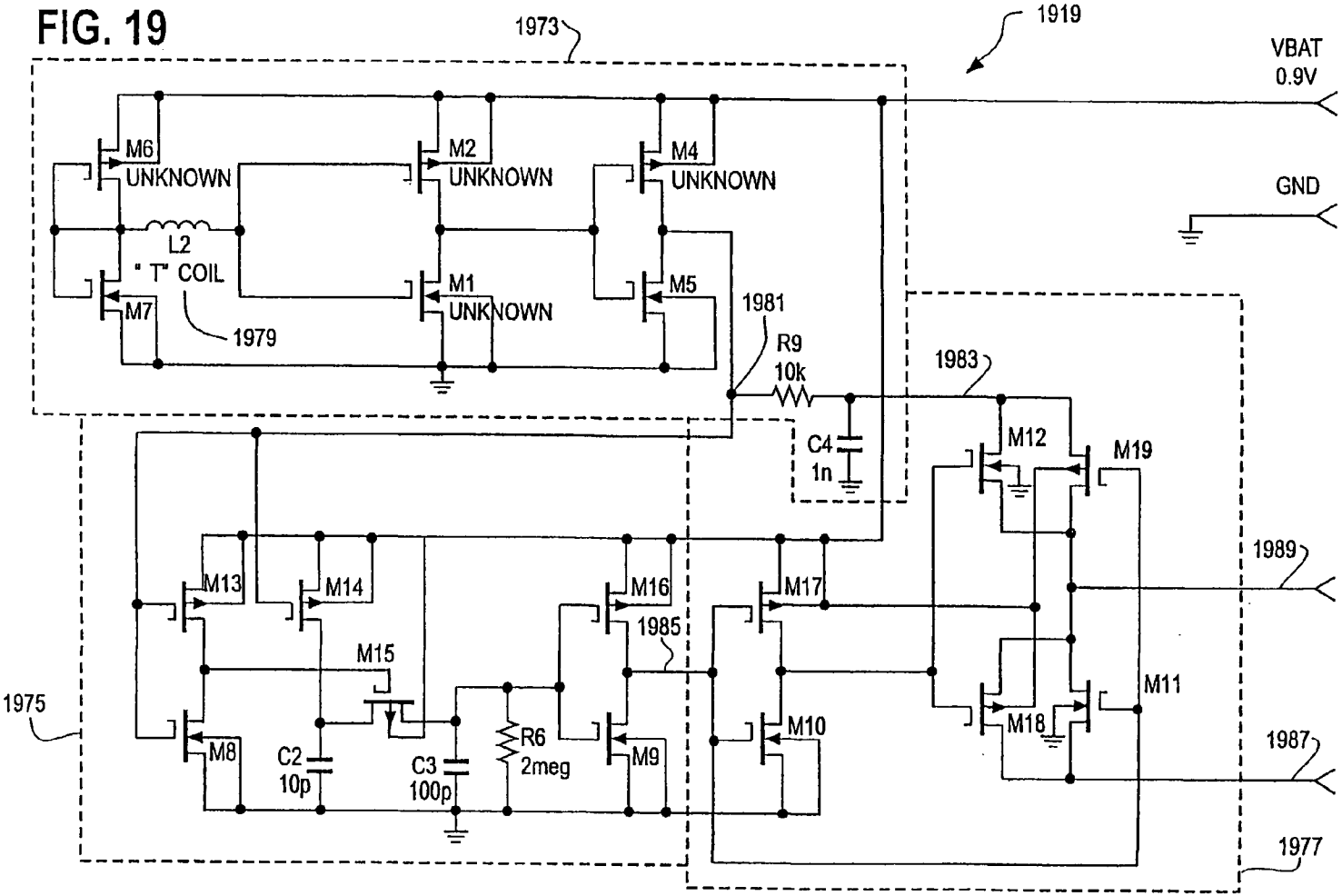
FIG. 19 is a diagram illustrating a circuit implementation of the transmission detection and switch system embodiment of FIG. 16 in accordance with an embodiment of the present invention.

FIG. 19 illustrates one specific circuit implementation of the transmission detection and switch system embodiment of FIG. 16. System 1919 may comprises a pulse width modulation (PWM) wireless type receiver, a carrier transmission detector and a switch, and may be designed to work at a carrier frequency of approximately 100 kHz. The receiver, carrier transmission detector and switch are shown in FIG. 19 blocks 1973, 1975 and 1977, respectively.

Input to the receiver of block 1973 from the secondary audio source may be derived from "T" Coil L2 (illustrated by reference numeral 1979 in FIG. 19). Also in the receiver of block 1973, components M1/M2 and M4/M5 may comprise a two-stage amplifier biased by components M6/M7. The output 1981 of the receiver of block 1973, which output represents an un-demodulated 100 kHz carrier signal, may be filtered using a single pole at 10 kHz (low pass) filter to produce a demodulated signal 1983 (i.e., a demodulation of the 100 kHz PWM transmission signal).

As mentioned above, the carrier transmission detector is shown in FIG. 19 block 1975. The output 1981 of the receiver of block 1973, which output, as mentioned above, may represent an un-demodulated 100 kHz carrier signal, may be "charged pumped/integrated" by components M8, M13, M14, M15, C2, C3, R6 and comparator M9/M16 of the carrier transmission detector of block 1975 to perform a carrier detect function with a nominal 50 kHz threshold detection frequency. The output 1985 of comparator M9/M16 may drive the switch, which, as mentioned above, is shown in block 1977.

The switch in block 1977 may comprise components M10, M11, M12, M17, M18 and M19. When the carrier frequency as determined at output 1985 is greater than 50 kHz, the switch may select signal 1983, representing the audio output of the receiver (from the secondary audio source). When the carrier frequency as determined at output 1985 is not greater than 50 kHz, the switch may select signal 1987, representing the output of the primary audio source. In either case, the selected signal may be connected to output 1989, the output of the electronic switch, may be connected to hearing aid circuitry.

It should be understood that, while a specific embodiment is shown in FIG. 19, numerous circuit embodiments may be implemented to carry out the general functionality of FIG. 16, as well as that of FIGS. 17 and 18. In addition, digital signal processing may also be used to carry out such functionality.

Figure 20:
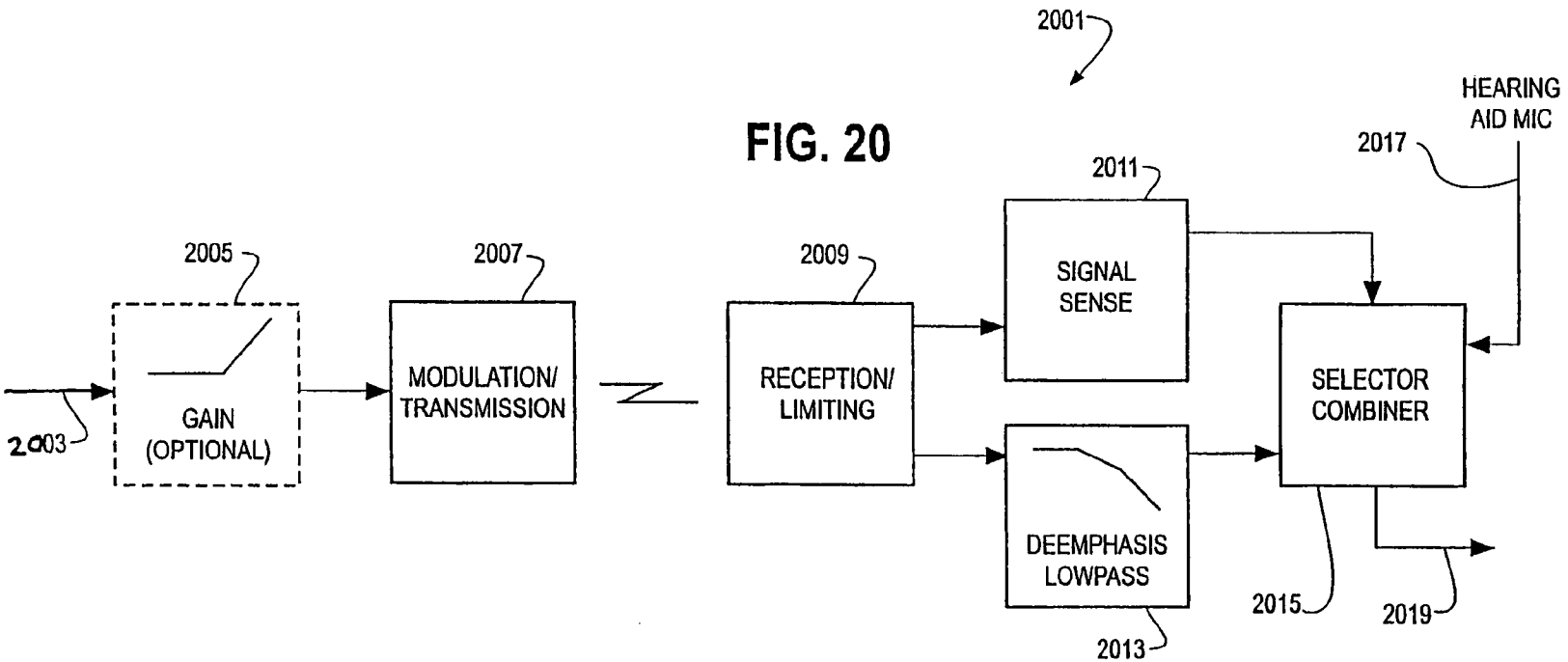
FIG. 20 is a block diagram illustrating an inductively coupled hearing improvement system in accordance with an embodiment of the present invention.

FIG. 20 is a general block diagram of an inductively coupled hearing improvement system 2001 in accordance with the present invention. An audio frequency signal 2003, which is to be inductively coupled to a hearing aid, may be input to an optional gain stage block 2005. The gain stage block 2005 may apply an appropriate signal level to a modulation/transmission block 2007, such that, eventually after reception and demodulation, an appropriate signal level maybe presented to circuitry of the hearing aid. The gain stage block 2005 may also optionally provide high frequency pre-emphasis (boost).

In the modulation/transmission block 2007, the modified signal from the gain block may modulate a carrier of typically 100 kHz by some means for application to a transmitting inductor or other type of antenna. The transmitting inductor may responsively generate a corresponding changing magnetic flux field. A reception/limiting block 2009 may include a receiving inductor some distance away from the transmitting inductor, which may respond to the flux field at an attenuated level. The electrical signal produced by the receiving inductor may be amplified by an amplifier sufficiently such that the amplifier output signal is limited (clipped) under normal operating conditions, and, thus, constant amplifier output signal level is maintained. The signal at this point may be largely free of interfering noises, because the noises are attenuated greatly by the limiting action.

The reception/limiting block 2009 may or may not incorporate additional signal demodulation, depending upon the modulation method employed, as will be seen in the descriptions of the following figures.

The reception/limiting block 2009 may feed both a signal sense block 2011 and a de-emphasis/lowpass filter block 2013. The signal sense block 2011 may determine if there is a received signal of sufficient quality to enable passing the demodulated signal on to the hearing aid circuitry. The signal sense block 2011 may determine whether the output signal of the previous block (i.e., block 2009) is firmly in limiting. The signal sense block 2011 may also, for example, respond directly to received signal strength, respond to the level of demodulated ultrasonic noise, or operate in some other manner.

The de-emphasis/lowpass filter block 2013 may employ a lowpass filter to substantially remove components of the high frequency carrier before application to the hearing aid circuitry, without substantially affecting the desired audio frequency signals. The de-emphasis/lowpass filter block 2013 may also provide some high frequency de-emphasis (rolloff) to compensate for the initial transmitter preemphasis and restore a flat overall audio frequency range response. Such emphasis/de-emphasis action may reduce the higher frequency noise within the audio frequency range in the received, demodulated signal.

A selector/combiner block 2015 may receives the demodulated, filtered, inductively-coupled signal and a hearing aid microphone signal 2017. At rest (meaning that no high quality inductively coupled signal is being received), the selector/combiner block 2015 may pass the hearing aid microphone signal through unchanged to the remainder of the hearing aid circuitry (see, output 2019), while blocking any received signal. When the signal sense block 2011 determines that a sufficiently high quality signal is being received, the signal sense block 2011 may cause the selector/combiner block 2015 to pass the signal through to the hearing aid circuitry. The hearing aid microphone signal may be attenuated to reduce interfering environmental sounds for the user. The attenuation may be total, but often the attenuation may be limited to about 15 dB, allowing an acoustic room presence to be maintained when the coupled signal does not contain this information (as would an eyeglass-mounted highly directional microphone, for example). When selected, the coupled signal may dominate over the hearing aid microphone signal, irrespective of the nature or source of the signal.

Figure 21:
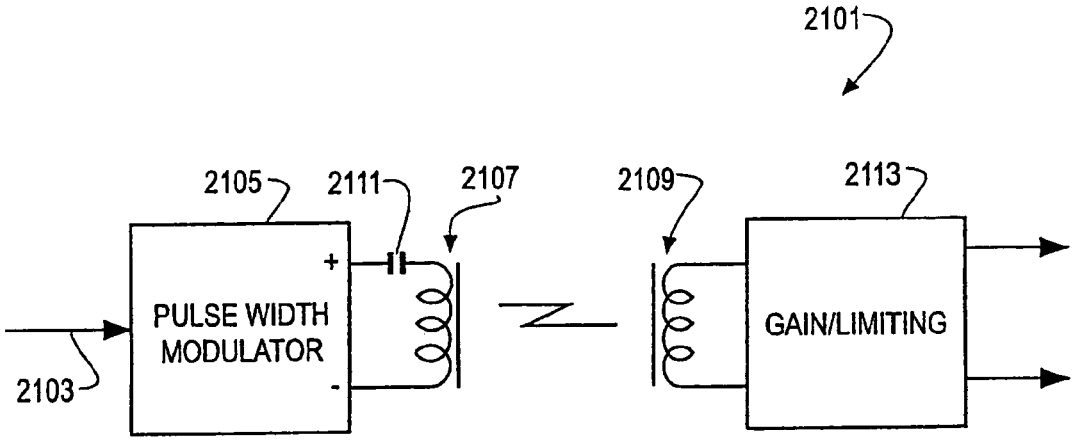
FIG. 21 is a diagram illustrating a pulse width modulation system for modulation/transmission and reception/limiting illustrated in FIG. 20 in accordance with an embodiment of the present invention.

FIG. 21 illustrates a pulse width modulation system 2101 that may be used for the modulation/transmission and reception/limiting blocks of FIG. 20. In the pulse width modulation (PWM) system 2101, the gain-adjusted, pre-emphasized input signal 2103 (i.e., signal 2003 of FIG. 20) maybe applied to a pulse width modulator 2105. The carrier frequency may be 100 kHz, which is well above the audio frequency range, allowing good separation of the audio and carrier information upon reception, but not so high as to make reception with very low voltage, very low power receiving circuitry difficult. The modulator circuit may output opposite polarities of a rectangular signal whose mark/space ratio varies with the instantaneous value of the audio frequency signal input. These modulator output signals may differentially drive a transmit inductor 2107.

The coupling from the transmit inductor 2107 to a physically separated receive inductor 2109 may be weak. The coupling may be dependent upon the respective inductors' dimensions, individual inductances, and separation distances. Empirically it has been found that the voltage input to voltage output coupling ratio is proportional to the core length of each inductor, roughly to the square root of the ratio of their core diameters, to the square root of the ratio of their inductances, and proportional roughly to the $2.75^{th}$ power of their separation distance (at least for inductors of the approximate size and construction, and operated under the moderately separated distances and moderate frequencies studied). This may be expressed by the following empirical formula for inductors positioned end-to-end, where the dimensions are in millimeters and the result in decibels:

$$\text{coupling} = 10 \log \left[\frac{L_{RX}}{L_{TX}}\right] + 10 \log [dia_{RX} \times dia_{TX}] + 20 \log [length_{RX} \times length_{TX}] - 55 \log [\text{distance}] - 12$$

For inductors positioned side-to-side, the coupling may be 6 dB less. At other orientations, coupling may be variable, but can be at a null when the receive inductor 2109 core is aligned perpendicularly to the lines of flux of the transmitting inductor. For the PWM transmit and receive inductors 2107 and 2109, respectively, described more completely below, the loss given by the formula is predicted to be 25 dB at a 1 cm center-to-center spacing and 63 dB for a 5 cm spacing. The loss may be greater for other relative orientations.

For a short range transmitter circuit powered by a single-cell hearing aid battery with a voltage of 1.3 volts, a 1 mH inductor wound on a ferrite core of diameter 1.6 mm and length 6.6 mm may be used for a compact transmitter design with reasonable transmission efficiency. Employing a low loss ferrite core inductor improves transmitter efficiency by allowing most of the stored inductor energy to be returned to the battery each cycle, instead of being dissipated in the inductor core. Peak inductor current is about 3.25 mA, but average battery current is only about 400 uA (exclusive of input circuitry), with efficient MOSFET H-bridge drive transistors.

A 0.1 μF coupling capacitor 2111 may form a high-pass filter with the transmit inductor 2107, rolling off the voltage applied to the transmit inductor 2107 at 12 dB/octave below 16 kHz. The frequency may be chosen to be high enough to allow large attenuation of the baseband audio frequency content while being low enough to preserve the waveform shape of the rectangular signal applied to the transmit inductor 2107. The audio frequency components of the spectrum may be attenuated to avoid the large currents that would otherwise flow into the transmit inductor 2107, which has been sized for proper transmission of the much higher frequency carrier. The resulting rectangular voltage waveform which is applied to the transmit inductor 2107 may change its peak positive and negative levels under modulation along with its mark/space ratio to maintain a near zero average voltage level.

The receive inductor 2109 may have a value of about 10 mH at frequencies in the 100 kHz range and may be wound on a steel bobbin of overall length 5.5 mm and bobbin diameter 0.6 mm. Receive inductor 2109 may be configured to have an equivalent parallel capacitance of about 9 pF. Together with other stray circuit capacitance, this may result in receive inductor 2109 input circuit having a resonance of about 500 kHz. The received PWM voltage waveform will have harmonics above this frequency rolled off, or equivalently, have its leading edges rounded. Sufficient parallel circuit loading may be added (typically about 50 kOhms) so that in conjunction with the inductor core losses, the input circuit Q is about 0.7. This choice allows the sharpest leading edge transitions to be received to maintain sensitivity to narrow pulses, while minimizing overshoot and ringing. The overall receive inductor 2109 input circuit frequency response may enable adequate waveform fidelity for pulse detection over a full range of transmitted mark/space ratios from 50/50 to 90/10.

The receive inductor 2109 voltage may be amplified approximately 70 dB, for example, by a multistage amplifier 2113 having a sufficiently wide bandwidth so as not to significantly degrade the input signal. (Some bandwidth tradeoff is possible between the amplifier and the inductor circuit: i.e., widening the inductor circuit bandwidth or increasing the Q slightly to allow some effective reductions in each of these by the amplifier). The amplifier 2113 may be designed such as to not exhibit behavioral problems over a very wide range of input signal levels, corresponding to differing transmit-receive inductor spacings and orientations. The amplifier 2113 may also be designed to cleanly and stably limit the output signal to consistent high and low levels. The high and low levels may be separated by two Shottky or PN junction diode drops. The amplifier 2113 will be in a limiting condition whenever the received signal is usable. By restoring consistent high and low levels to the PWM signal, the baseband audio frequency content is also restored. This can be considered a form of demodulation, in that only filtering to remove the (now unwanted) carrier signal is used to restore the original audio frequency range signal.

In the PWM signal, the audio modulation information may be carried by the timing of the transitions. It is possible to transmit greater peak flux rates of change for the same transmitter power consumption by transmitting essentially only those transitions. These transitions can be considered the derivative of the PWM signal. These could be obtained by reducing the value of the coupling capacitor in FIG. 21, but obtaining strong pulses may require high peak battery and switch currents, with very low drain during most of the cycle.

Figure 22:
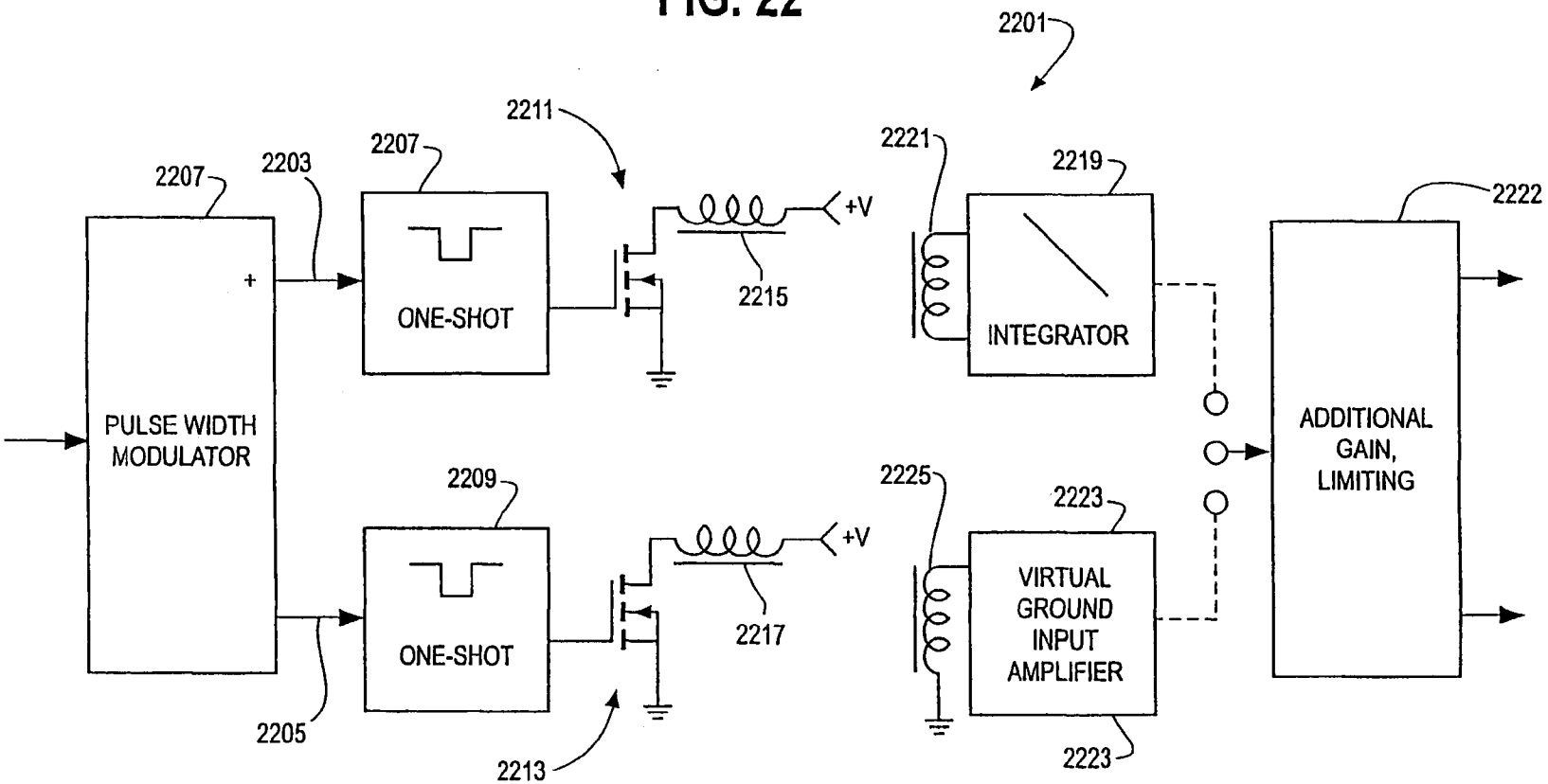
FIG. 22 is a diagram illustrating a system for obtaining large transition spikes with lower, more continuous battery and switch currents in accordance with an embodiment of the present invention.

FIG. 22 shows a system 2201 to obtain large transition spikes with lower, more continuous battery and switch currents. Opposite polarity outputs 2203 and 2205 of a low power 100 kHz pulse width modulator 2207 may each trigger a respective 1.5 μsec, for example, one-shot monostable multivibrator (i.e., one-shots 2207 and 2209). These, in turn, may each turn off a corresponding switch (i.e., switches 2211 and 2213) for that time period on opposite PWM signal transitions. Each switch normally connects an associated inductor (i.e., inductors 2215 and 2217) to ground. The opposite end of each of the inductors 2215 and 2217 may be connected to the positive voltage supply. During most of the cycle, each of the inductors 2215 and 2217 may be charged with current. When an associated switch opens in response to its associated one-shot, the inductor voltage may ring up to a voltage many times the supply voltage before ringing back down to discharge its remaining reversed current into a reverse catch diode associated with the switch. This ring may last for just over one-half cycle of the inductor circuit resonant frequency. The inductors 2215 and 2217 are normally arranged in opposition, so that each alternating spike may generate a changing flux field of opposite, alternating polarity. Depending on the demodulation method chosen, the spikes may be made to go in the same direction.

For a 1.3 volt short range transmitter, low-loss 3 mH inductors wound on the cores previously described for the PWM transmitter may be used. These may have in-circuit resonances of 500 kHz, resulting in 1 μsec pulses of approximately 13 volt peak amplitude, depending on battery voltage. Each of the inductors 2215 and 2217 can achieve peak currents of about 1.7 mA, yet the average battery drain of both inductor circuits, with efficient switches, may be about 400 μA (exclusive of input and PWM circuitry).

The switches 2211 and 2213 are shown in FIG. 22 as N-channel enhancement mode MOSFET switches. These may be used due to their low switching losses, inherent reverse catch diode, and ability to conduct both directions of current with low loss when switched on. The timing of the one-shots 2207 and 2209 may be reliably just greater than the ring-back time of their respective inductors, so that the transistor can quickly revert to a low loss condition following the return of reverse current flow, with minimal time spent relying on the catch diode. The MOSFET may have a less than 1 volt turn-on gate voltage and the ability to withstand more than 13 volt drain-source spikes.

In order to receive most of the available signal strength of the transmitted signal and not excessively lengthen the signal's rise and fall times, and assuming conventional sensing and amplification of receive inductor voltage, a receive inductor circuit may have a resonant frequency at least as great as, and preferably greater than, the transmit inductors 2215 and 2217. A 3 mH inductor may be used, wound on a the same steel bobbin as just described for the PWM receiver can have an in-circuit resonance of 800 kHz. The Q may be controlled to about 0.7 with parallel resistive loading in conjunction with the core loss, to prevent excessive ringing while maintaining adequate pulse rise and fall times.

FIG. 22 illustrates two potential means of obtaining a PWM-equivalent signal. In a integrator block 2219, a receive inductor 2221 voltage may be amplified and integrated. If the received signal, with its opposite polarity spikes, is integrated as such, then an equivalent PWM signal may be recovered. The received signal may also be amplified, limited, and filtered by circuitry of block 2222 in the same manner as discussed in connection with FIG. 21.

Alternatively, in a block 2223, the receive inductor 2225 may be operated into a virtual ground amplifier input. The amplifier may directly sense the received flux level, which is already proportional to the integral of the summed transmitter inductor voltages. Once the PWM-equivalent signal is obtained, it may also be amplified, limited, and filtered by circuitry of block 2222 in the same manner as discussed in connection with FIG. 21.

In this virtual ground amplifier configuration, the circuit sensitivity to equivalent parallel inductor capacitance and resistance is low. A roughly 3 mH inductor value may be used, as discussed more completely below.

Another possible method of demodulating the audio information from the received pulses is to sense the peak recovered positive and negative signal amplitudes, ignore all signals of lesser amplitude, set and reset a flip-flop, and then low pass filter the flip-flop output.

Figure 23:
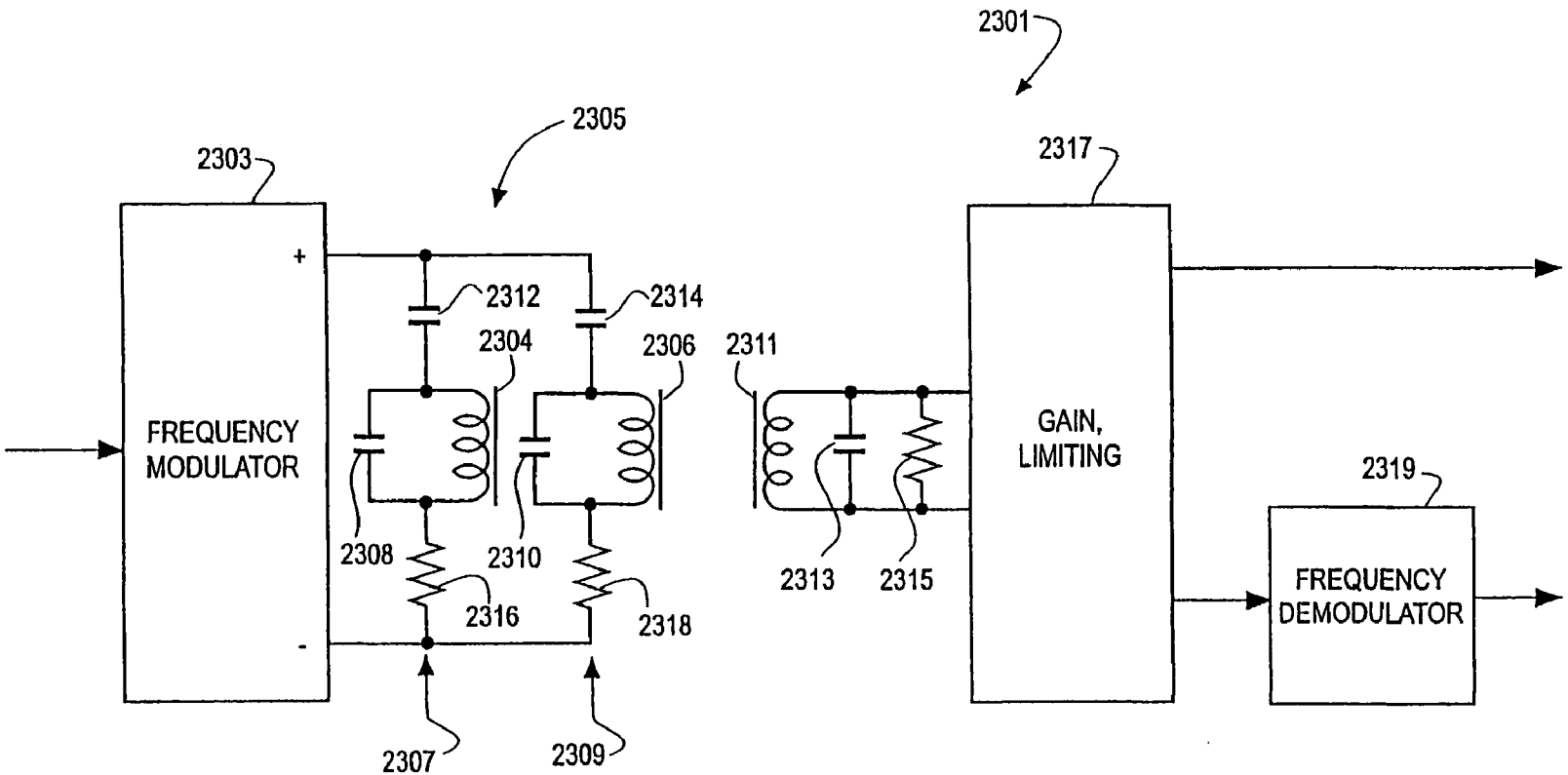
FIG. 23 is a diagram illustrating a frequency modulation system in accordance with an embodiment of the present invention.

To enhance the system's rejection of interferences and possibly allow for multi-channel operation, frequency modulation ("FM") may be used instead of the pulse width based systems discussed with respect to FIGS. 21 and 22. FIG. 23 illustrates a FM system 2301 in accordance with the present invention. Roughly +/−10 kHz peak deviation of a 100 kHz carrier may be used. Because, unlike the previously discussed modulation methods, harmonics of the carrier frequency are not needed, the transmit inductor drive circuit may be operated into an inductor circuit which is mildly resonant in the region of the carrier frequency, thus enhancing the proportion of energy maintained in the waveform fundamental.

Figure 23A:
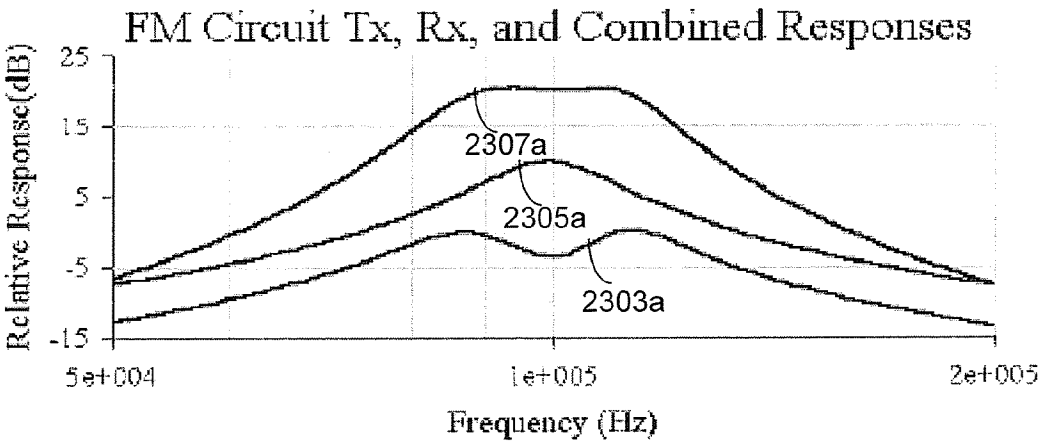
FIG. 23A is a graph illustrating the transmitted flux frequency response, the received flux frequency response, and the net inductor-to-inductor frequency response for the system 2301 of FIG. 23.

In FIG. 23, a frequency modulator 2303 provides a frequency modulated square wave drive to a transmit inductor network 2305. In order to provide a reasonably flat amplitude response and linear phase response over a 20 kHz band around 100 kHz, dual resonant inductor circuits 2307 and 2309, stagger-tuned on either side of 100 kHz may employed. When combined with a single resonant receive inductor circuit, the net transmit-receive frequency response achieves a flat pass-band. FIG. 23A is a graph illustrating the transmitted flux frequency response, the received flux frequency response, and the net inductor-to-inductor frequency response for the system 2301 of FIG. 23. The following curves represent the transmitted flux frequency response (lower curve 2303*a*), the received flux frequency response (middle curve 2305*a*), and the net inductor-to-inductor frequency response (upper curve 2307*a*) for the system 2301 of FIG. 23.

A low voltage, low power short range transmitter network, such as network 2305, may comprise 10 mH ferrite core inductors 2304 and 2306 of the dimensions previously discussed, for example, equivalent parallel capacitors 2308 and 2310 (having capacitance of 30 pF, for example), added series capacitance 2312 and 2314 (having capacitance of 297 and 174 pF, respectively, for example), and total series resistors 2316 and 2318 (having 1.3 and 1.4 kOhms resistances, respectively, for example) in the configuration shown in FIG. 23. This configuration gives resonances for the circuits 2307 and 2309 at 88 kHz and 111 kHz, both with Q's of about 5. Assuming an efficient MOSFET H-bridge drive circuit is used, the peak joint inductor current will be about 850 uA with an average battery current (exclusive of input circuitry) of about 600 μA.

A receive inductor 2311 may be of a much higher value than with the other modulation approaches, which allows a significant increase in sensitivity. A 100 mH inductor wound on the steel bobbin previously described can have a 99 kHz resonance using a total circuit+inductor capacitor 2313 having a capacitance of 26 pF, for example. In conjunction with a resistor 2315 having 340 kOhms of total equivalent and actual parallel loading resistance, for example, a Q of just over 5 results. The combination of high inductor value and under-damped response allows a very high effective sensitivity. A limiting amplifier 2317 that follows can have significantly less gain than the previous systems. The limited amplifier output signal contains no base-band audio content and must be demodulated by a block 2319 using any of the known FM demodulation methods.

The transmitted FM signal of a system such as shown in FIG. 23 has significantly less harmonic content than do the other described transmitters, but some high frequency content may remain due to the original square wave drive. This high frequency content may be further reduced by additional filtering between the drive circuitry and the transmitting inductor, utilizing very small or well-shielded inductors with minimal radiating potential.

FIGS. 24–27 show in detail circuitry that may be employed to implement the pulse width modulation embodiment of FIGS. 20 and 21. The input signal may be derived from an eyeglass-mounted highly directional array microphone. The transmitter circuitry may also be mounted on the eyeglass. Both the array microphone and the transmitter may be powered by a single 1.5 volt nominal hearing aid battery. The receiver circuitry provides automatic switchover from an ear canal mountable hearing aid type microphone.

Figure 24:
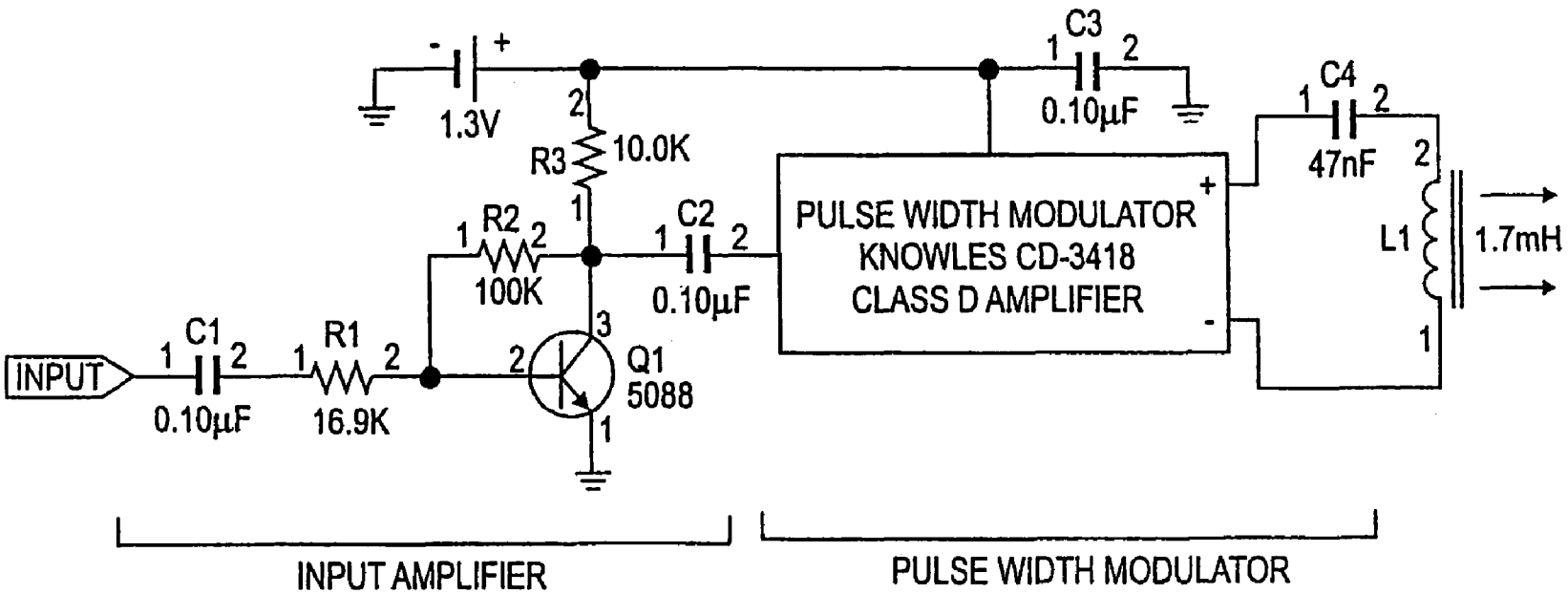
FIG. 24 is a diagram illustrating a single stage amplifier adapted to raise an audio frequency input signal strength to an optimum range for a pulse width modulated hybrid in accordance with an embodiment of the present invention.

FIG. 24 corresponds to blocks 2005 and 2007 of FIG. 20, and shows a single stage amplifier that raises the audio frequency input signal strength to the optimum range for the PWM hybrid. This hybrid, a Knowles CD-3418 (ref. Knowles Electronics, Inc. CD Series Data Sheet), is intended for use as a class D audio amplifier for use in driving hearing aid receivers. It does this by providing both output polarities of a pulse width modulated output through a MOSFET H-bridge. Blocking capacitor C4 prevents excessive inductor currents that would otherwise result from audio frequencies and DC offset. For convenience, transmit inductor L1 is constructed by the parallel combination of eight Tibbetts Industries, Inc. model Y09-31-BFI telecoils. Total current drain (exclusive of the array microphone) is 750 uA.

Figure 25:
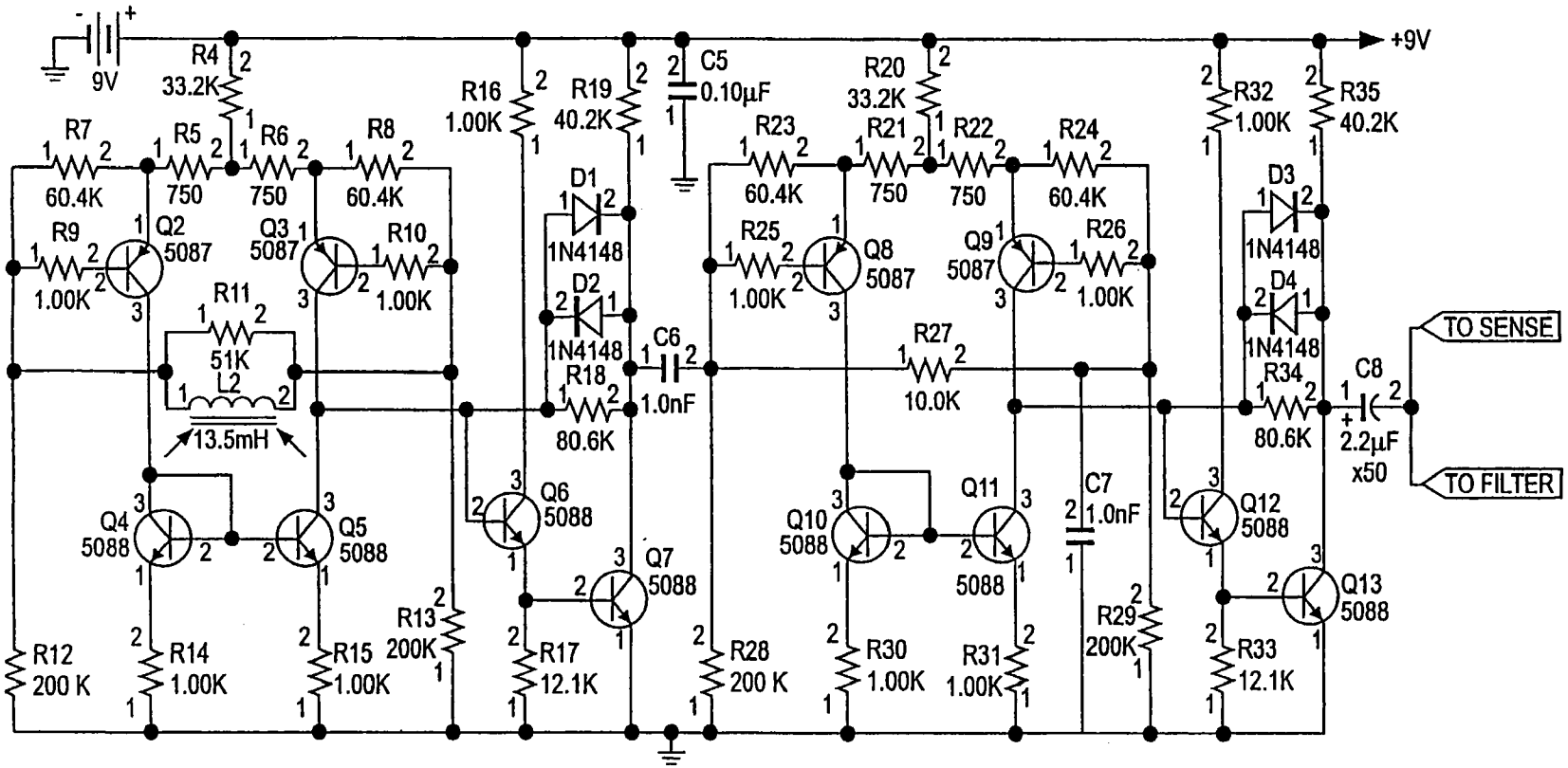
FIG. 25 is a diagram illustrating additional detail regarding an inductively coupled hearing improvement system illustrated in FIG. 20 in accordance with an embodiment of the present invention.

FIG. 25 corresponds to block 2009 of FIG. 20. Two cascaded amplifier stages provide a total of 68 dB of gain for the 100 kHz PWM signal received from inductor L2, a Tibbetts Industries, Inc. model Y09-31-BFI telecoil. An input circuit Q of about 0.7 is obtained through the combination of the coil characteristics and the circuit loading, particularly the paralleled 51 kOhms resistor, R11. The output signal amplitude remains at a consistent peak-to-peak level of two silicon diode drops for transmitter-receiver distances from less than 1 cm to roughly 6 to 8 cm (end-to-end coil orientation).

Figure 26:
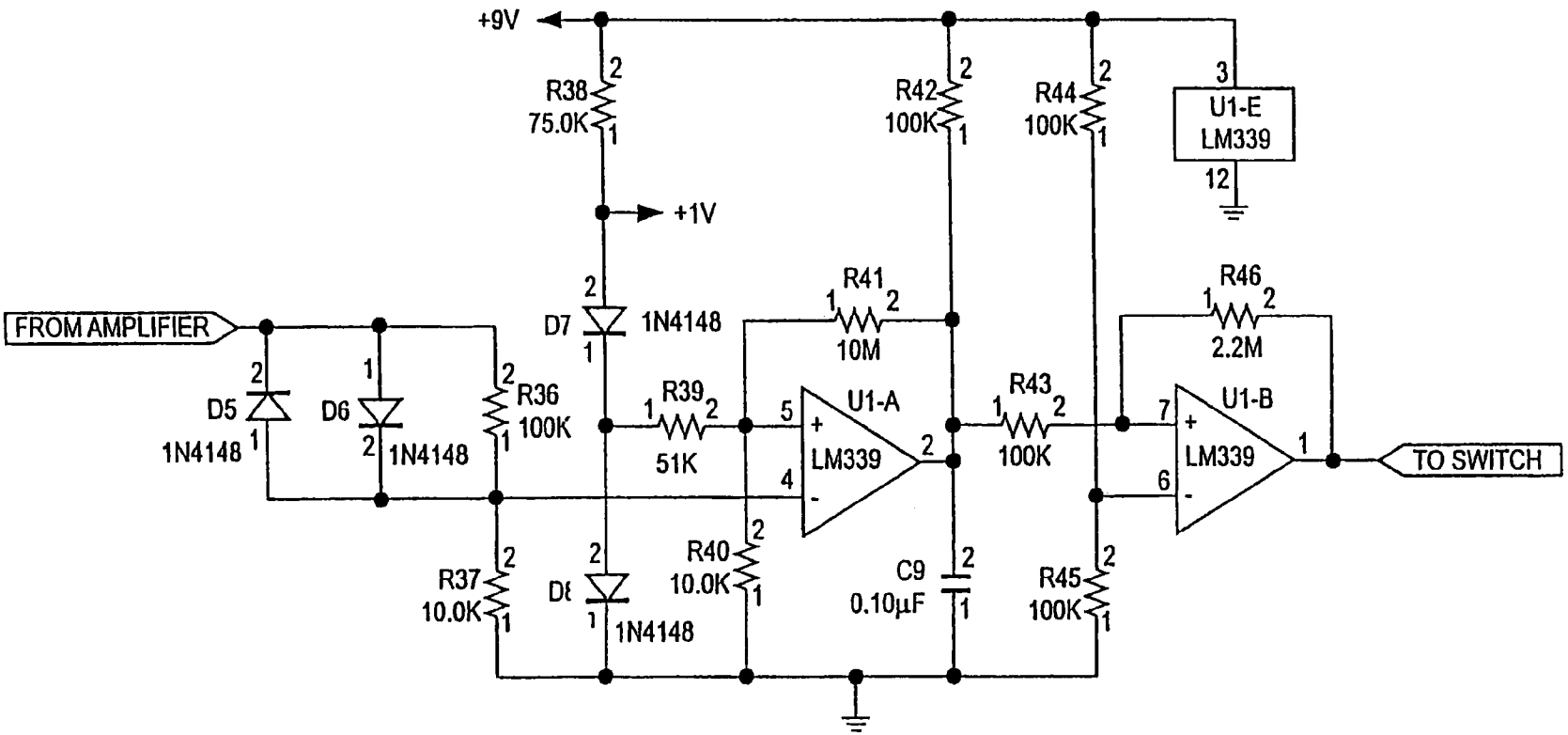
FIG. 26 is a diagram illustrating additional detail regarding an inductively coupled hearing improvement system illustrated in FIG. 20 in accordance with an embodiment of the present invention.

FIG. 26 corresponds to block 2011 of FIG. 20. The signal sense circuitry receives a ground-referenced signal from the output of the amplifier. If the amplifier of FIG. 25 is driven sufficiently strongly into limiting at least every 7 msec, indicating adequate received signal strength, the output of this circuit block pulls to ground. This will result in the enabling of the inductively received signal. This circuit also provides a 1 volt supply for the hearing aid microphone.

Figure 27:
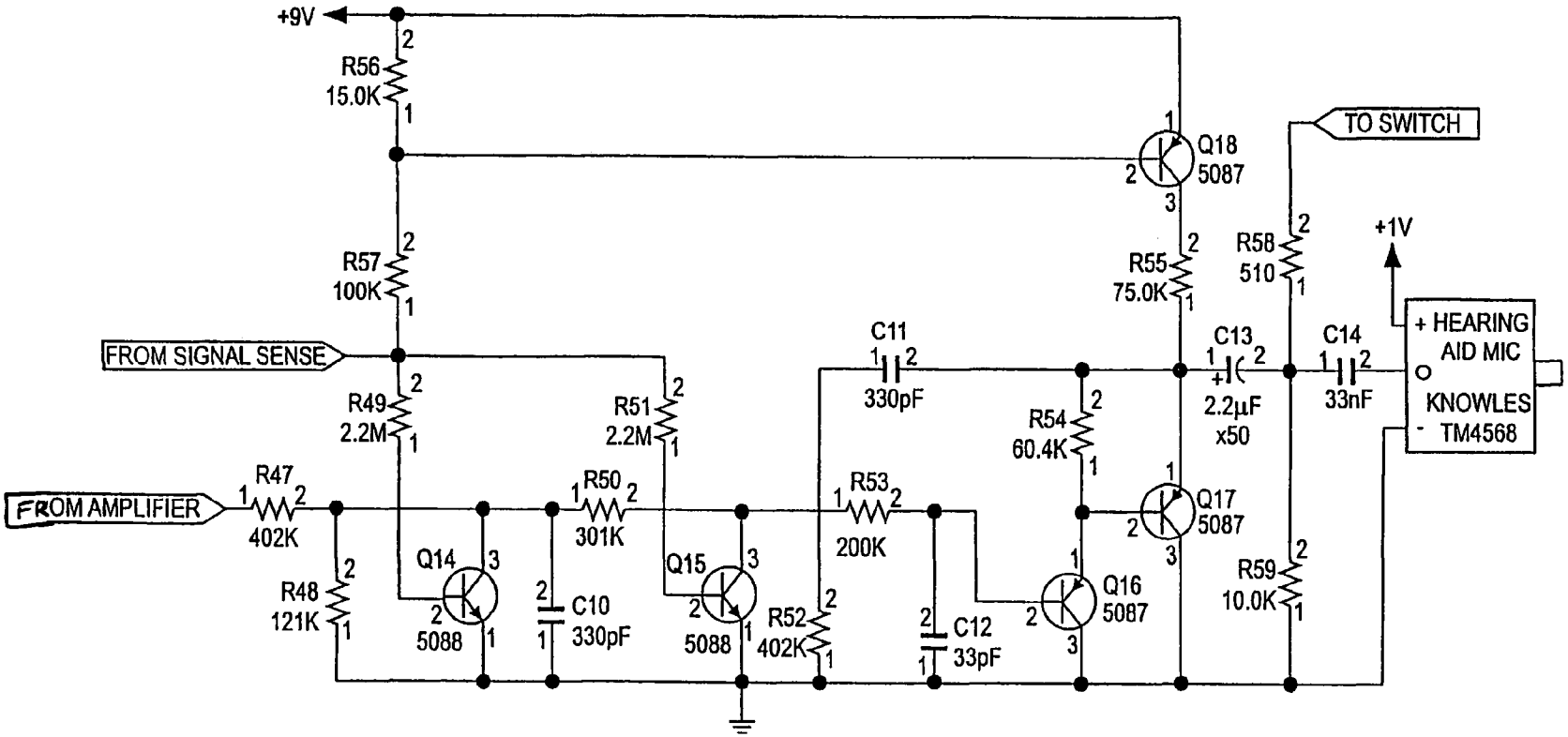
FIG. 27 is a diagram illustrating additional detail regarding an inductively coupled hearing improvement system illustrated in FIG. 20 in accordance with an embodiment of the present invention.

FIG. 27 corresponds to the blocks 2013 and 2015 of FIG. 20. When the output of the signal sense block (FIG. 26) is not pulled low, indicating that the inductively coupled signal is not of useful strength, output transistors Q16 and Q17 are not powered up by transistor Q18 and the drive signal to output transistors Q16 and Q17 is shorted to ground by transistors Q14 and Q15. The signal from the hearing aid microphone, in this case a Knowles Electronics, Inc. TM4568, is allowed to pass with virtually no loading or attenuation. When the signal sense output is pulled low, the output transistors are powered up and the signal from the amplifier is allowed to pass through the 3rd order, 6 kHz low pass filter on to the output. The low output impedance of the powered output transistor stage attenuates the hearing aid microphone signal by about 20 dB, so that the inductively received signal may dominate. It may be generally desirable that the hearing aid microphone not be attenuated too deeply, though, so that a sense of the room will not be lost in applications where the inductively coupled signal does not provide such a sense. The degree of attenuation of the hearing aid microphone signal may be reduced from that shown by, for example, reduction of the bias current level in transistor Q17 or insertion of a build-out resistor in series with capacitor C13.

The system described with reference to FIGS. 24–27 above delivers an A-weighted signal-to-noise ratio of about 65 dB, referred to the maximum signal level, at a distance of 2 cm. The system transitions between the hearing aid microphone and the inductively coupled microphone at a distance of 6 to 8 cm, at which point the signal-to-noise ratio is reduced by 15–20 dB from the 2 cm value. The distortion at 1 kHz just below clipping is 1%.

Figure 28:
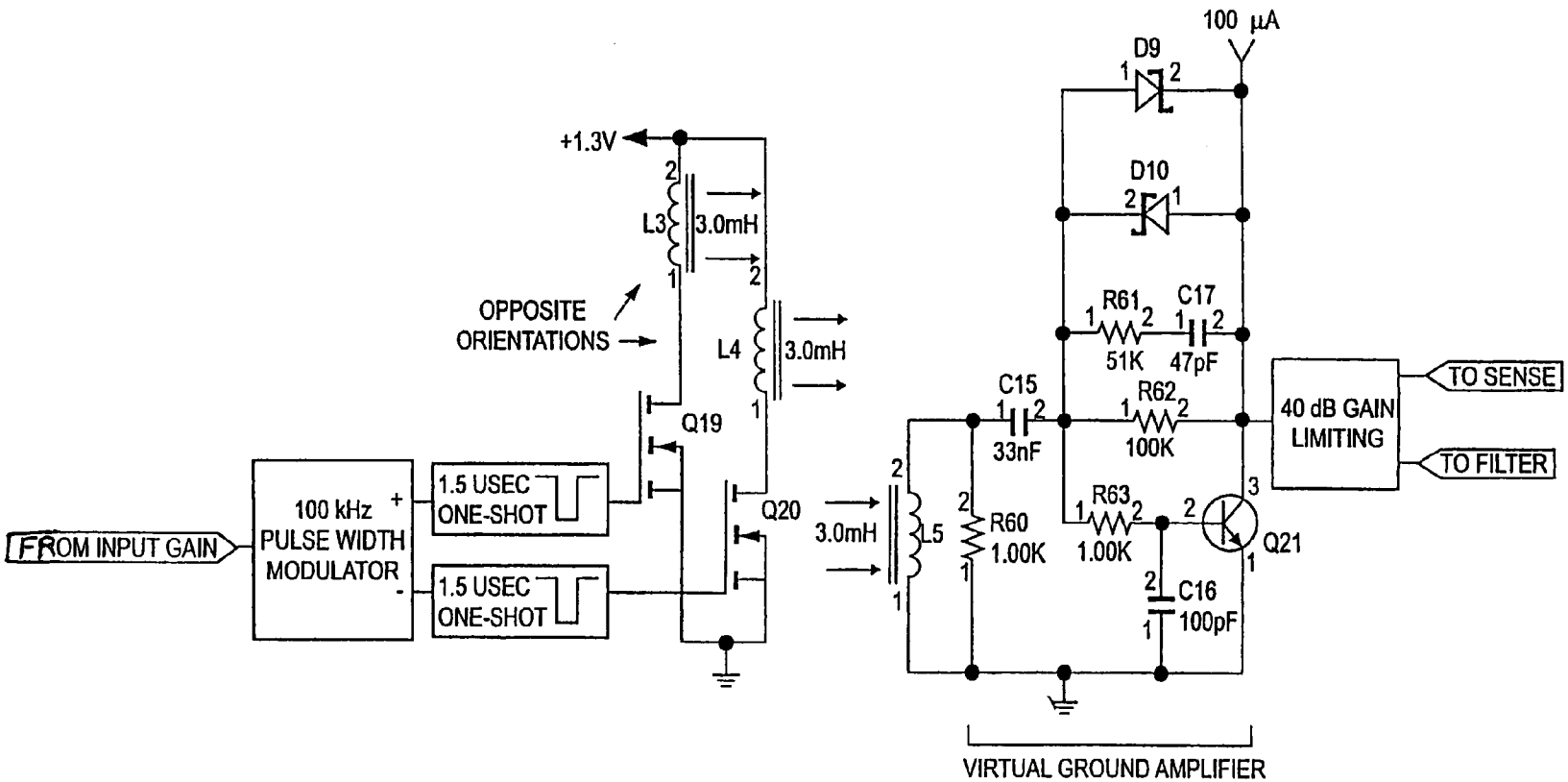
FIG. 28 is a diagram illustrating circuitry illustrated in the embodiment of FIG. 22 in accordance with an embodiment of the present invention.

FIG. 28 shows somewhat more exemplary detail of the circuitry suggested by the block diagram of FIG. 22. The 100 kHz pulse width modulator has the same functionality as the similar block in FIG. 24, but with the need only for low power output stages. The one-shot timing may be achieved by any of several known methods.

The virtual ground receive inductor input amplifier shown has an input impedance of about 300 Ohms. This is lower than the inductor impedance at frequencies above 16 kHz. By amplifying the virtual short circuit inductor current, the circuit responds essentially to the induced inductor flux, which is essentially the integral of its open circuit voltage. By amplifying this signal, an equivalent PWM signal appears at the stage output. The lower frequency roll-off and resultant waveform droop in the recovered signal caused by the finite stage input impedance and coupling capacitor C15 can be partially compensated by the shelving feedback network R61, R62, and C17. An advantage of the low stage input impedance is that it enables additional capacitance to be added at the input for improved filtering of radio frequency interference. This is accomplished here by R63 and C16. R60 helps stabilize the stage under overdrive conditions.

Figure 29:
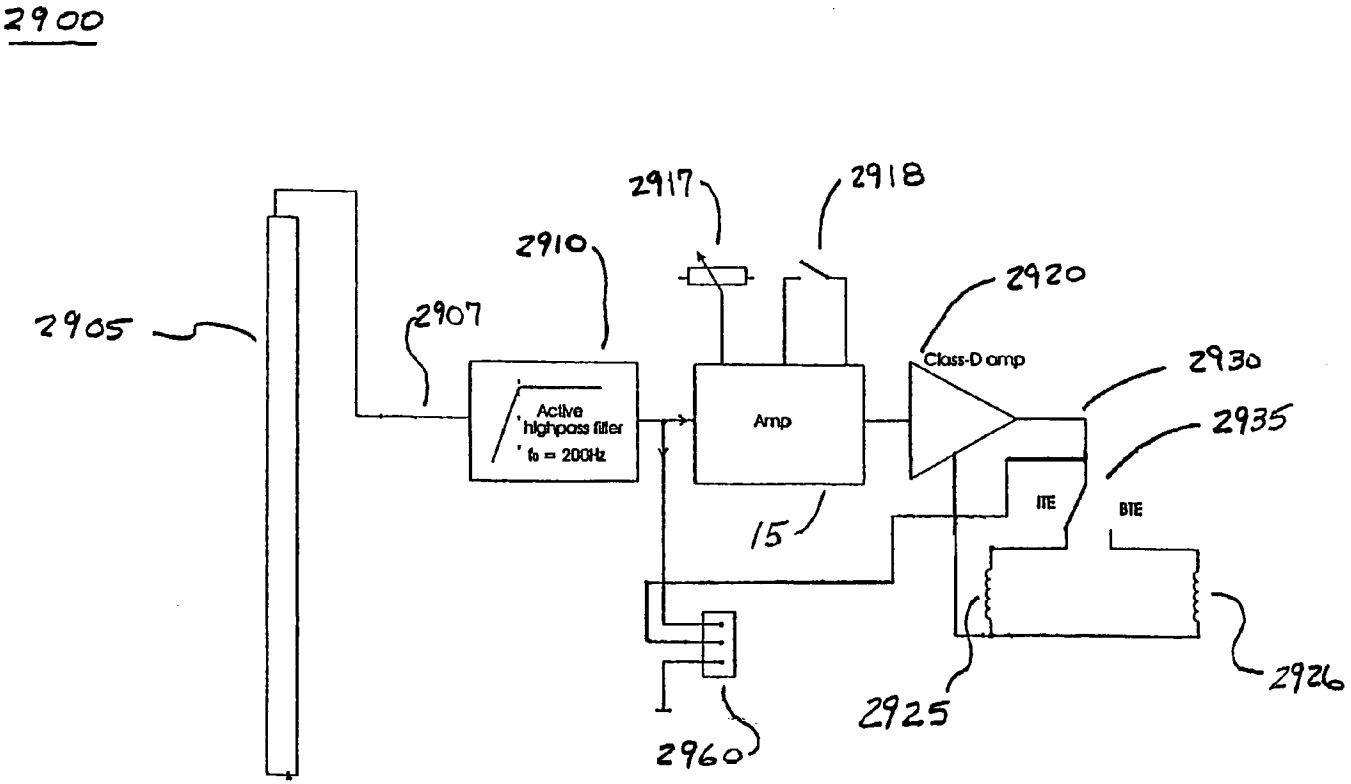
FIG. 29 is a diagram further defining the diagram of FIG. 15B and illustrating the signal from a directional array microphone being amplified and coupled through one of two inductors to a hearing aid of a user in accordance with an embodiment of the present invention.

FIG. 29 shows a block diagram of another embodiment corresponding to the block diagram of FIG. 15B, in which the signal from a directional array microphone is amplified and coupled through one of two inductors to the hearing aid of a user, in accordance with the present invention. In other embodiments, other electrical signal sources may be substituted for the array microphone. In the exemplary embodiment, separate inductors have been employed to permit the device to generate magnetic fields optimized to more effectively couple with the telecoils contained within ITE and BTE types of hearing aids. In the illustration of FIG. 29, array microphone 2905 transduces a sound field into electrical signal 2907. The array microphone 2905 may be, for example, an array microphone such as that described in a patent application having Ser. No. 09/517,848, entitled "DIRECTIONAL MICROPHONE ARRAY SYSTEM", filed on Mar. 2, 2000, which is hereby incorporated herein by reference, in its entirety. The output of array microphone 2905 is connected to the input of high-pass filter 2910, which may be used to reduce low-frequency components of the electrical signal 2907, to avoid excessive low-frequency coupling to a hearing aid unit that may have difficulty processing and making effective use of the signal. High pass filter 2910 may be designed to have a cutoff frequency of approximately 230 Hz. High pass filter 2910 may also be designed to provide a boost to frequencies just above its cutoff frequency, as will be discussed in relation to FIG. 32D.

The output of high-pass filter 2910 is amplified by preamplifier 2915, which provides gain as indicated by the setting of gain control 2917. The microphone signal is then further amplified by class-D amplifier 2920 to produce a typically 100 KHz pulse-width-modulated output signal 2930. Class D amplifier 2920 may be, for example, a Knowles Electronics model CD-3418. As shown in FIG. 29, switch 2935 may be used to connect output signal 2930 to BTE transmit inductor 2926 for use with a BTE-type of hearing aid, or to ITE transmit inductor 2925 for use with a ITE-type of hearing aid. Although the output signal 2930 of class-D amplifier 2920 is a 100 KHz pulse-width-modulated signal, ITE transmit inductor 2925 and BTE transmit inductor 2926 have sufficient inductance to filter nearly all of the 100 KHz component from output signal 2930. The incorporation of Class D amplifier 2920 allows for full 1 volt peak signals to be applied to BTE transmit inductor 2926 or ITE transmit inductor 2925 when circuit power is provided by a small 1.25 volt hearing aid-style battery, while maintaining a low average battery power drain.

Figure 30:
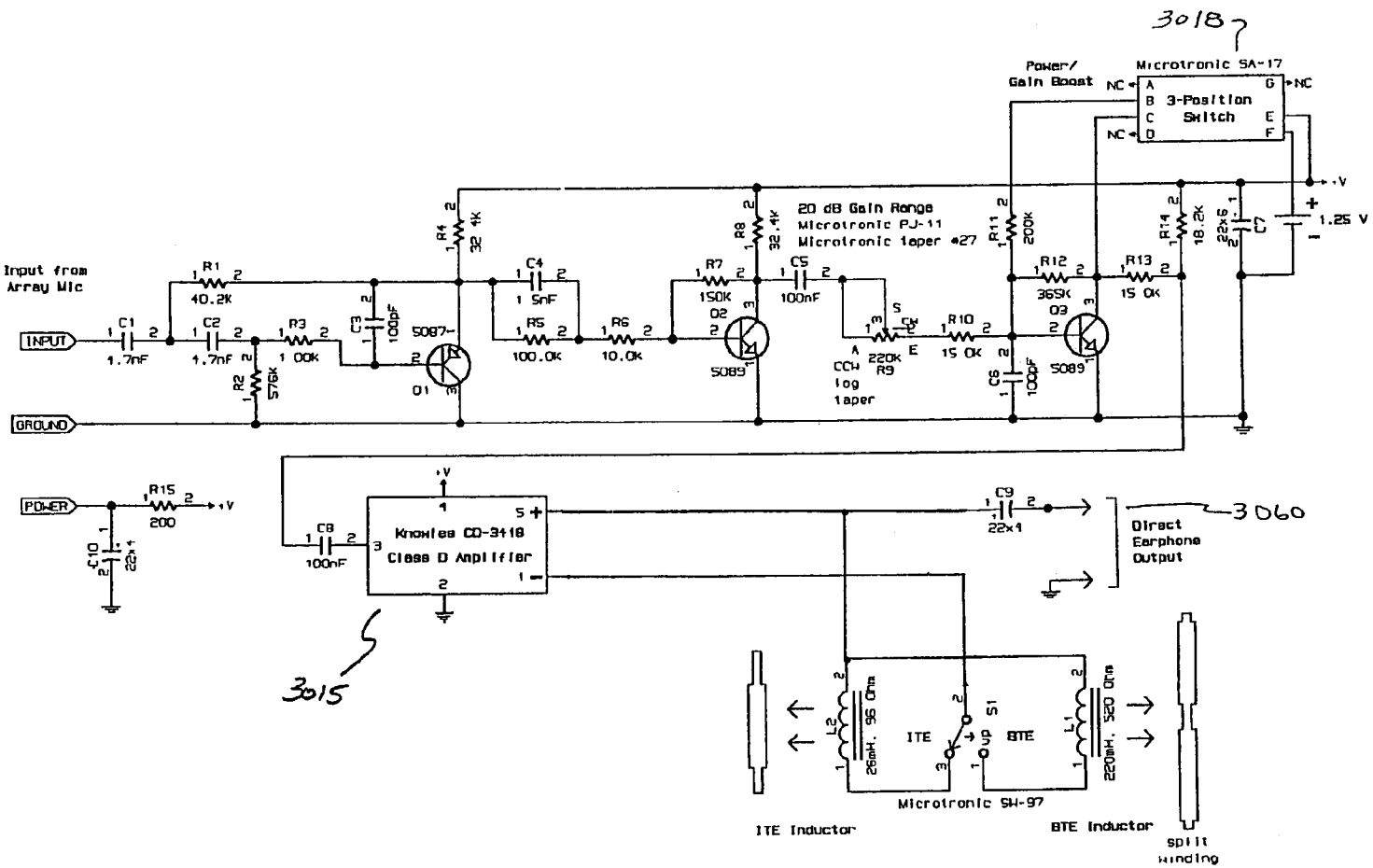
FIG. 30 is a schematic diagram illustrating the circuitry corresponding to the embodiment illustrated in FIG. 29 in accordance with an embodiment of the present invention.

FIG. 30 show a schematic diagram of the circuitry which corresponds to the exemplary embodiment shown in the block diagram of FIG. 29, in accordance with the present invention. FIG. 30 depicts components R1, R2, R4, C1, C2, and Q1, which may correspond to the functionality of high pass filter 2910 of FIG. 29, for example. The resulting signal is amplified by a two-stage preamplifier, corresponding to preamplifier 2915 of FIG. 29, for example, in which the first stage comprises components C4, C5, R5, R6, R7, R8, and Q2. C4 boosts the higher frequencies, as will be discussed further in relation to FIG. 32D. The first stage output is operatively coupled to potentiometer R9, which may correspond to gain control 2917 of FIG. 29, for example. The second stage of the preamplifier comprises components R10, R11, R12, R13, R14, C6, and Q3. Three-position switch 3018, shown in FIG. 30, may correspond to switch 2918 of FIG. 29, and may be, for example, a switch such as a Microtronic model SA-17. When used in combination with R11 of FIG. 30, this switch may allow the gain of the third preamplifier stage to be increased by, for example, approximately 8 dB. The second section of the three-position switch 3018 may provide control of the power needed to operate the circuitry of FIG. 30. The voltage divider formed by R13, R14 may be used to improve the performance of class D amplifier 2920 of FIG. 29, to minimize sensitivity to dynamic battery voltage fluctuations.

FIG. 30 illustrates the arrangement of switch, SI, that may be used for selecting between the two inductors of the present embodiment. Switch SI of FIG. 30 may correspond to switch 2935 of FIG. 29, and may be used to select either the ITE transmit inductor, L2, which may correspond to ITE transmit inductor 2925 of FIG. 29, for example, or the BTE transmit inductor, L1, which may correspond to BTE transmit inductor 2926 of FIG. 29, for example.

In general, hearing aids with telecoils are designed to expect field strengths of approximately 30 mA/m at 1 kHz, which corresponds to normal speech levels (from telephone receivers, etc.). The magnetic field strength required for speech peaks, however, may rise high above this, making it advantageous to provide 200 or 300 mA/m, even under well-controlled conditions. A magnetic coupling system expected to handle a wide range of signal inputs without distortion or overload may need to be capable of levels greater than 1 A/m. In addition, environmental magnetic noise levels may be high enough to cause significant interference to telecoil pickup. A quiet home environment may have background magnetic noise levels as low as approximately 1 mA/m, but this can easily reach the 5 mA/m range in a typical office environment or 30 mA/m at a distance of three feet from a cellular telephone. Speech in a magnetic coupling system may need to be transmitted at a much higher average level than any interfering noise, in order to avoid the user experiencing annoying hums and buzzes. This consideration concerning environmental magnetic noise also supports the above stated desirability of achieving magnetic coupling system field levels of 1 A/m or more.

Figure 30A:
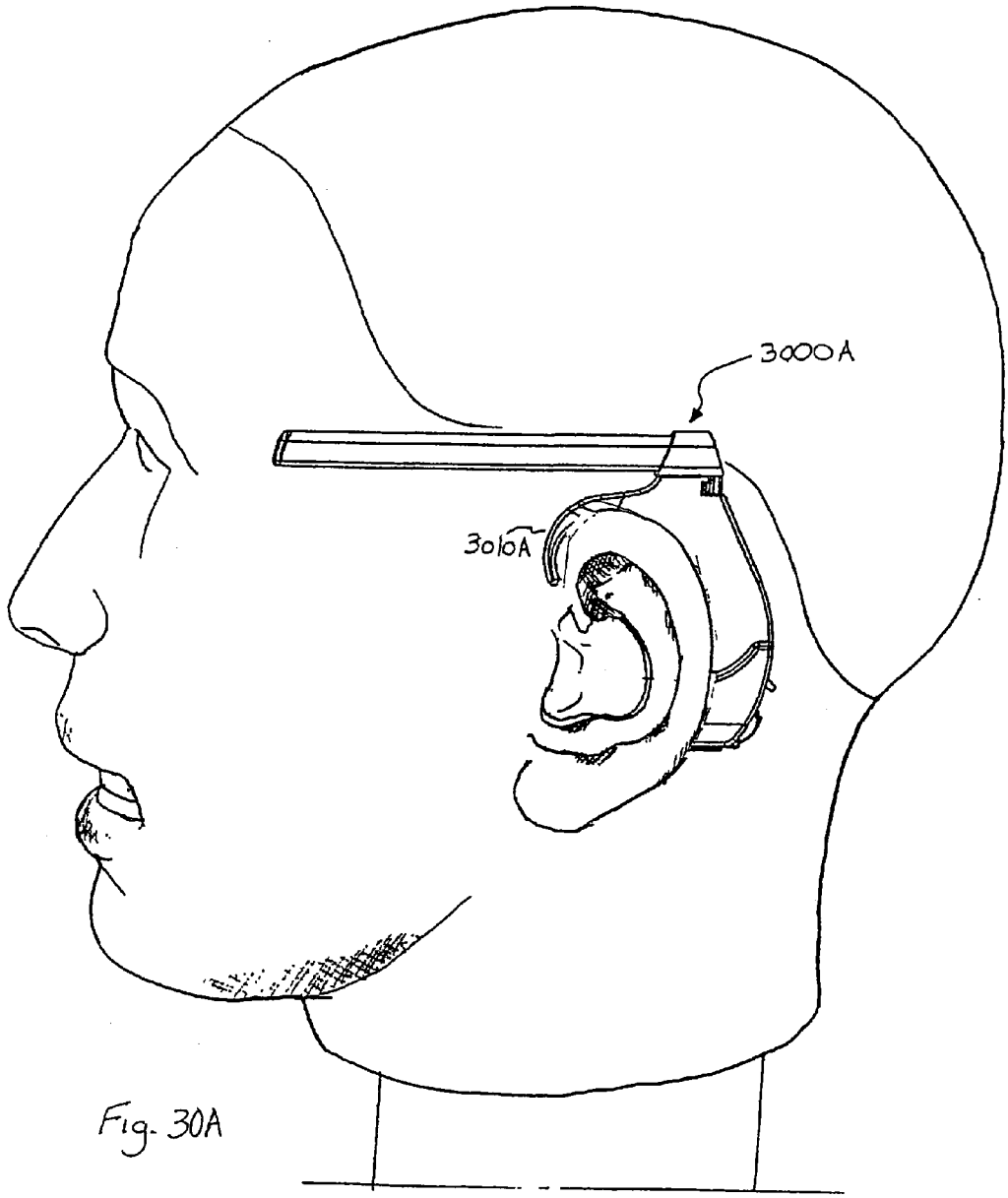
FIG. 30A is a diagram illustrating a side view of a user wearing a hearing improvement device in accordance with an embodiment of the present invention.

FIG. 30A illustrates a side view of a user wearing an exemplary embodiment of a hearing improvement device, in accordance with the present invention. In the illustration of FIG. 30A, hearing improvement device 3000A is held in typical operating position on the ear of a user 3090A by earhook 3010A. The main housing of hearing improvement device 3000A is positioned behind the outer ear, between the outer ear and the head of user 3090A.

Figure 31:
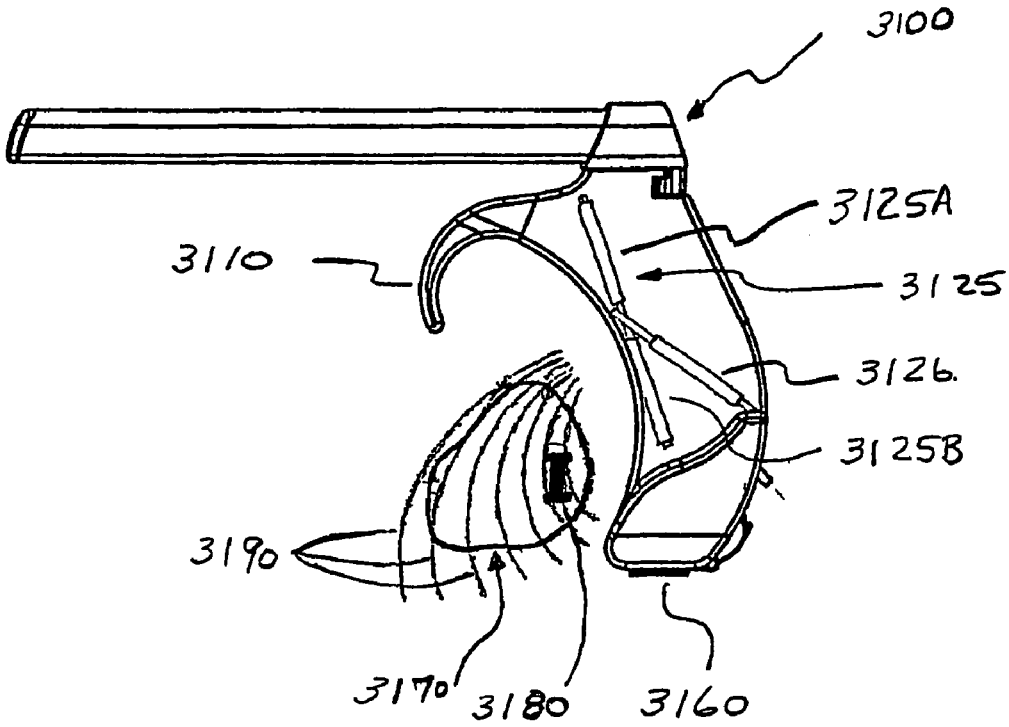
FIG. 31 is a diagram illustrating positional relationship during use of a hearing improvement device and an ITE type hearing aid in accordance with an embodiment of the present invention.

FIG. 31 illustrates the positional relationship during use of a hearing improvement device and an ITE type hearing aid, in accordance with an embodiment of the present invention. In FIG. 31, it can be seen that ITE transmit inductor 3126 of FIG. 31 is positioned at an angle. This arrangement is designed to optimize coupling with a vertically-oriented telecoil that may be located within some ITE-type hearing aids. The lines of magnetic flux 3190 generated by ITE transmit inductor 3126 are illustrated in relation to the ITE hearing aid 3170, and to enclosed telecoil 3180. In an embodiment in accordance with the present invention, the construction and orientation of ITE transmit inductor 3126 has been arranged so that the direction of magnetic flux 3190 is primarily vertical in the region within which ITE hearing aid 3170 may be located, to optimize the influence on a vertically oriented telecoil such as telecoil 3180, that may be contained within ITE type hearing aid 3170.

When considered in combination with the level of sensitivity and environmental noise sources, the relatively large distance separating ITE transmit inductor 3126 from telecoil 3180 increases the importance that the field strength of ITE transmit inductor 3126 be maximized. A higher level of magnetic field strength may be accomplished in an embodiment of the present invention by making the core of ITE transmit inductor 3126 as long as possible within the limitations of the space and orientation available. An important factor influencing the performance of ITE transmit inductor 3126 is its "copper volume", which determines the "crossover" frequency below which the ITE transmit inductor 3126 is primarily resistive in nature. Below the crossover frequency, it becomes increasingly difficult to obtain the field strength that may be needed from a fixed maximum voltage drive. The copper volume selected for use in the ITE transmit inductor 3126 of an embodiment of the present invention results in a relatively low crossover frequency of approximately 400 Hz. The equation presented in relation to FIG. 21 shows that the field-generating efficiency is directly proportional to the length of the core. To maximize the field-generating efficiency, the core is made as long as is practical within the confines of the housing and the required orientation. The core dimensions in an embodiment in accordance with the present invention may be, for example, 0.84" long by 0.03" diameter. The coil may be wound over a length of, for example, 0.49" to an outside diameter of 0.055". The wire gauge and number of turns are chosen to give inductance and resistance values of 26 mH and 96 ohms allow peak currents of 8 milliamps in the resistance-limited lower frequency range, using the class D amplifier 3015 of FIG. 30 operating on a single 1.25 volt hearing aid-style battery. This level of current is sufficient to drive the iron core of ITE transmit inductor 3126 to the edge of saturation, maximizing the magnetic field influencing ITE telecoil 3180. An embodiment in accordance with the present invention may produce maximum field levels of 2 to 4 A/m at typical ITE telecoil positions.

The winding of the BTE transmit inductor 3125 used for coupling to telecoils of BTE-type hearing aids, also depicted as BTE transmit inductor 2926 in FIG. 29, has been divided into two windings that are spaced apart by a distance and positioned on a common core, which are shown as windings 3125A and 3125B in FIG. 31. This split winding arrangement results in an improvement in the uniformity of the magnetic field of BTE transmit inductor 3125. The nature of the magnetic field of BTE transmit inductor 3125 will be discussed in further detail below. The windings of BTE transmit inductor 3125 extend as closely as is practical to the end of the core, in order to maintain a more uniform field near the ends of the core. In an embodiment in accordance with the present invention, the core may have a length of, for example, 1.26", and a diameter of, for example, 0.03". The coil may have an outside diameter of, for example, 0.055" and may be wound to within 0.04" of each end. The central winding gap may be, for example, 0.1". As can be seen in FIG. 31, the winding gap of inductor 3125 may also permit ITE transmit inductor 3126 to overlap the center of BTE transmit inductor 3125 to minimize the overall thickness of the inductor pair, while allowing ITE transmit inductor 3126 to be advantageously positioned to maximize coupling with ITE telecoil 3180. The inductance of BTE transmit inductor 3125 may be, for example, 222 mH, while the resistance may be, for example, 520 Ohms. These values give substantially the same crossover frequency as with ITE transmit inductor 3126.

Figure 32A:
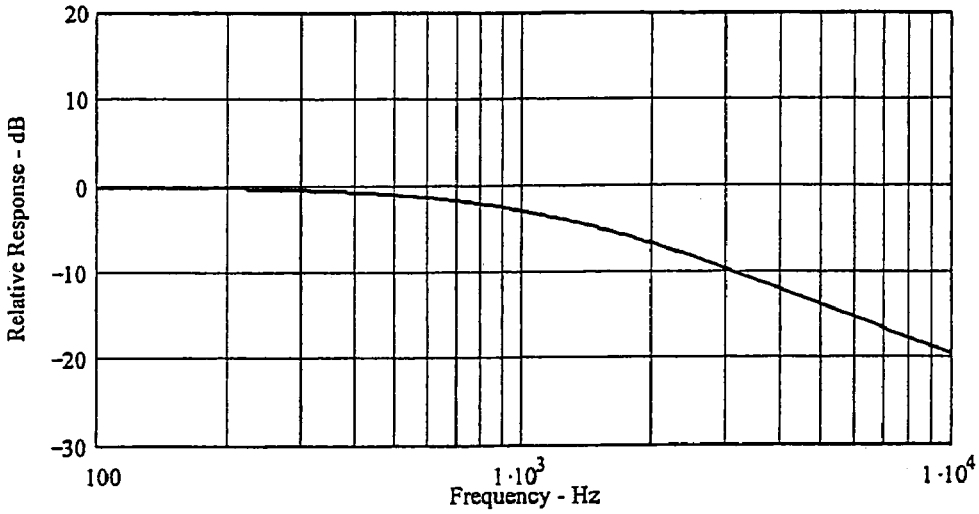
FIG. 32A is a graph illustrating frequency response of an amplified telecoil exposed to a magnetic field with a constant, frequency-independent rate-of-change of magnetic flux in accordance with an embodiment of the present invention.

FIGS. 32A–32D illustrate the approach used to improve the fidelity of the transmitted signal and the effectiveness of the coupling arrangement in an embodiment in accordance with the present invention. FIG. 32A is a graph which shows the frequency response of a typical amplified telecoil exposed to a magnetic field with a constant, frequency-independent rate-of-change of magnetic flux. This rolloff avoids the excessive brightness sometimes associated with telecoil operation in the past with some magnetic sources, but does not particularly complement the characteristics of prior art tele-couplers.

Figure 32B:
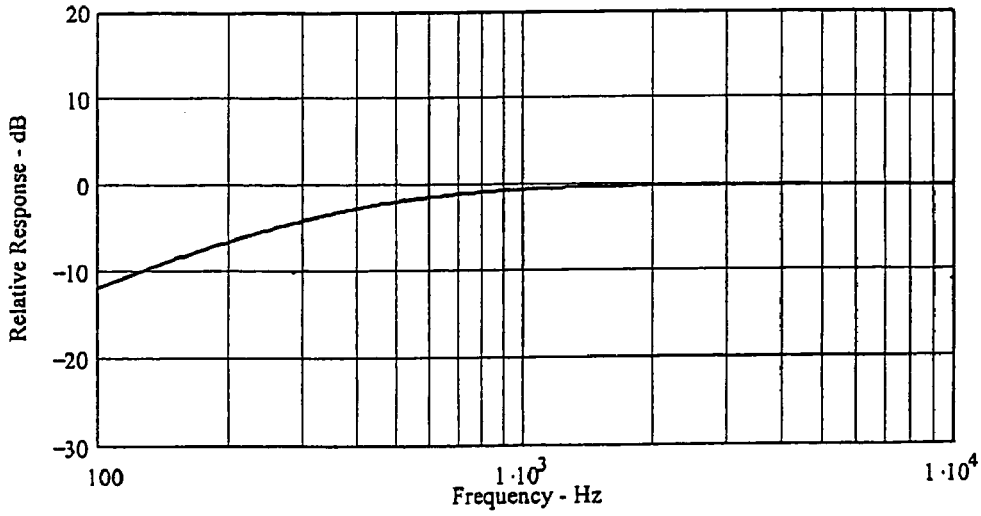
FIG. 32B is a graph illustrating the relative rate-of-change of flux level vs. frequency for a constant applied voltage drive level to a transmit inductor in accordance with an embodiment of the present invention.

FIG. 32B shows a graph of the relative rate-of-change of flux level vs. frequency for a constant applied voltage drive level to a transmit inductor chosen as described above, in accordance with the present invention. In such an embodiment, the inductor resistance dominates over the inductive reactance at frequencies below approximately 400 Hz, resulting in low-frequency roll-off.

Figure 32C:
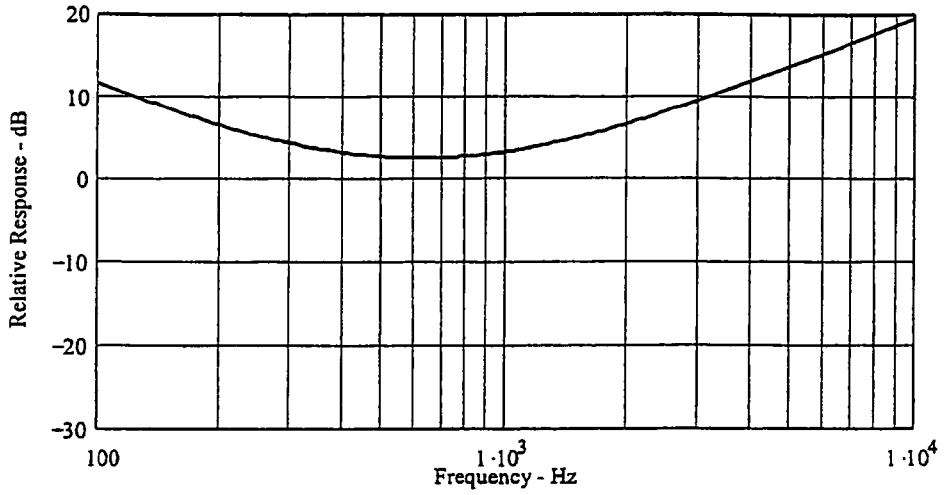
FIG. 32C is a graph illustrating a transmit inductor drive voltage used to produce a flat frequency response at an output of a receiving telecoil in accordance with an embodiment of the present invention.

FIG. 32C shows a graph of the theoretical transmit inductor drive voltage required to produce a flat frequency response at the output of the receiving telecoil of a typical modern telecoil application. This illustration shows the theoretical frequency-dependent drive voltage response required to compensate for the combined frequency response of the modern telecoil application, as shown in FIG. 32A, and the transmit inductor, as shown in FIG. 32B.

Figure 32D:
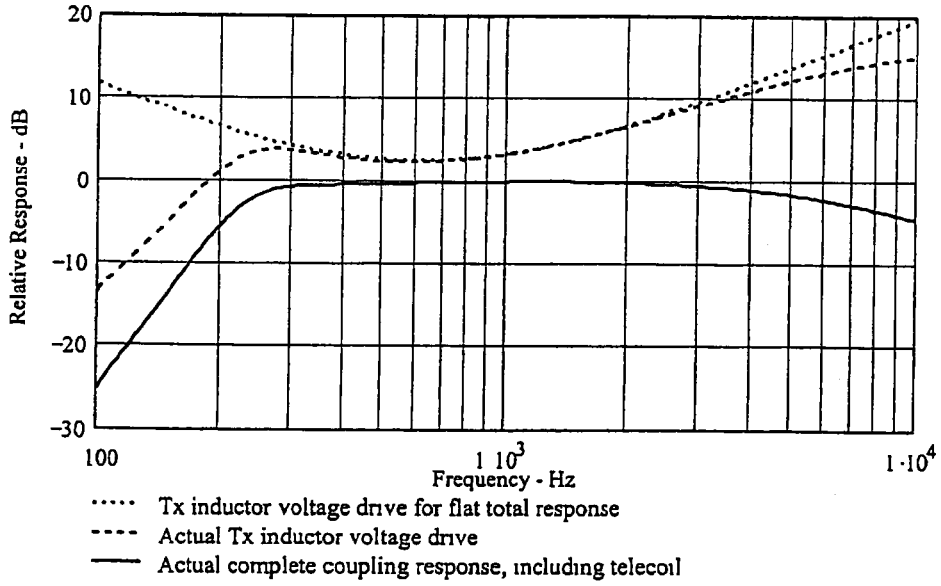
FIG. 32D is a graph illustrating a transmit inductor drive voltage used for a flat receiving telecoil frequency response as illustrated in FIG. 32C in accordance with an embodiment of the present invention.

FIG. 32D shows a graph comparing the theoretical transmit inductor drive voltage required for a flat receiving telecoil frequency response as shown in FIG. 32C, the actual transmit inductor drive voltage of an embodiment in accordance with the present invention, and the expected frequency response at the output of the telecoil of a modern hearing aid. The high frequency boost in the transmit inductor drive voltage comes from the action of C4 of FIG. 30. The boost at 300 Hz comes from the action of high pass filter 3910 of FIG. 29. The overall magnetic coupling system response is very uniform over the important speech frequency range.

Figure 33:
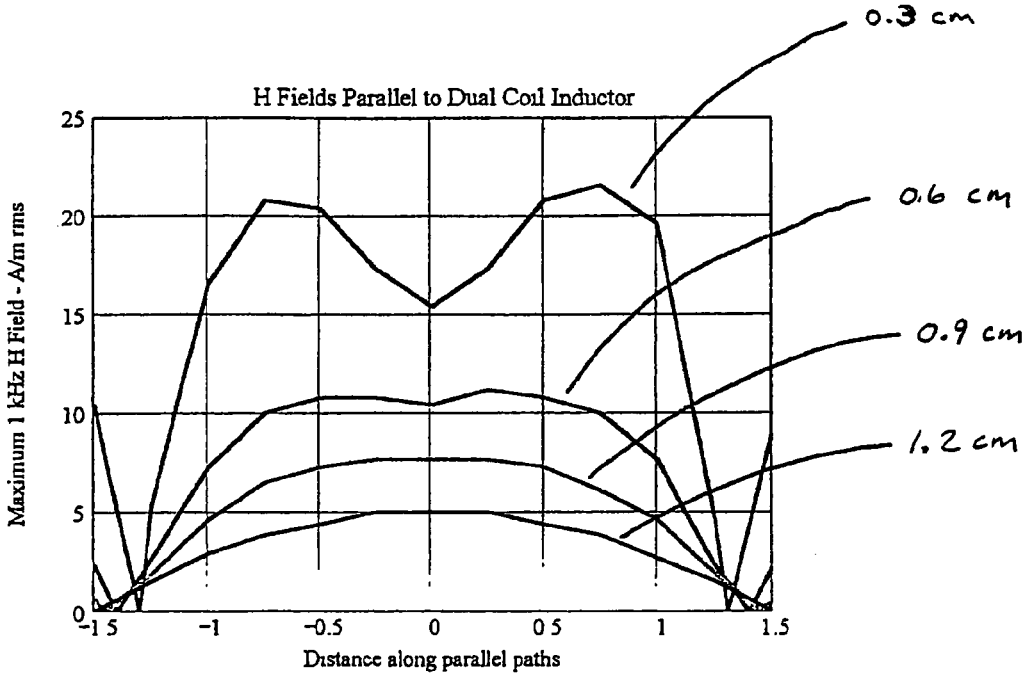
FIG. 33 is a graph illustrating the field strength of a magnetic field measured along a length of a BTE transmit inductor illustrated in FIG. 31 at different distances from the centerline in accordance with an embodiment of the present invention.

FIG. 33 shows a graph illustrating the magnetic field strength as measured at different distances from its surface, along the length of BTE transmit inductor 3125 of FIG. 31, in accordance with an embodiment of the present invention. It has been observed that during use, a separation of between 0.5 cm and 0.9 cm may exist between the BTE transmit inductor 3125 in an embodiment of the present invention, and the telecoil in a typical BTE type hearing aid. The magnetic field strength generated by BTE transmit inductor 3125 in a typical use arrangement, as shown in graphs of FIG. 33, and the uniformity of the magnetic field over the length of BTE transmit inductor 3125, demonstrates the effectiveness of the split winding approach in avoiding the buildup of field strength near the center of the inductor that would occur with a continuous winding, and in providing a magnetic field that will be effective in coupling to a variety of BTE-type hearing aids over a range of receiving telecoil positions. An embodiment in accordance with the present invention may produce maximum magnetic field strength levels greater than 5 A/m very uniformly over a wide range of BTE telecoil positions.

Figure 34B:
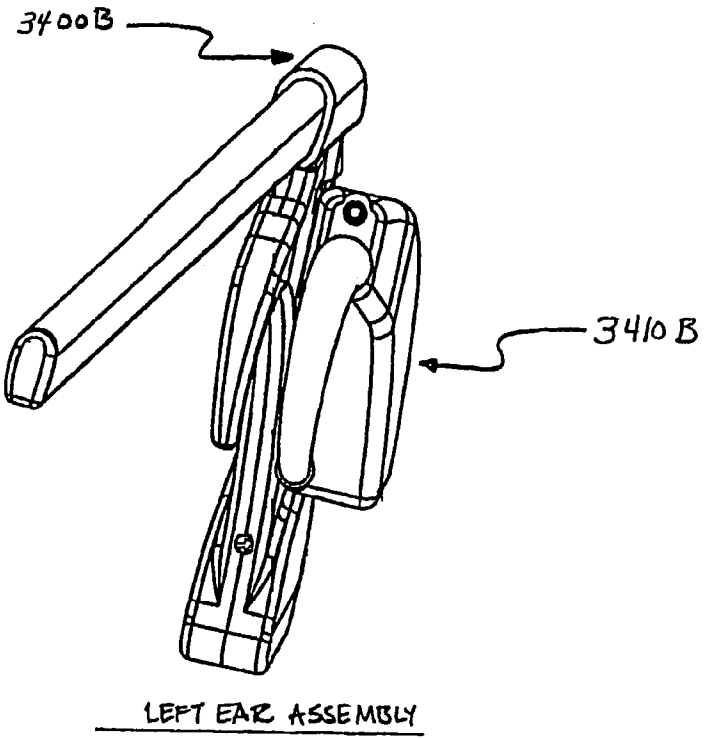
FIG. 34A and FIG. 34B are diagrams illustrating right-ear and left-ear use, respectively, of a BTE type hearing aid having a hearing improvement device installed therein in accordance with an embodiment the present invention.
Figure 34A:
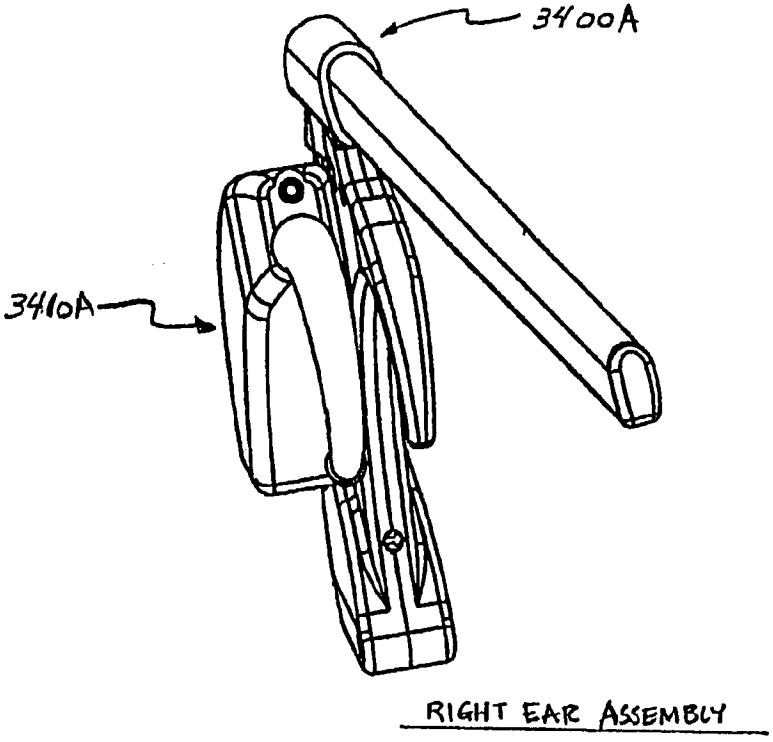

FIG. 34A and FIG. 34B illustrate two views showing right-ear and left-ear use of a BTE type hearing aid with an exemplary embodiment of a hearing improvement device, in accordance with the present invention. In FIG. 34A, BTE hearing aid 3410A is positioned adjacent to hearing improvement device 3400A, which in use would be located behind the right ear and next to the head of a user. Similarly, in FIG. 34B, BTE hearing aid 3410B is positioned adjacent to hearing improvement device 3400B, which during use would be located in a similar manner behind the left ear and adjacent the head of a user. In the arrangement illustrate in each of FIG. 34A and FIG. 34B, the proximity, without attachment, of the BTE hearing aid (3410A, 3410B) to the respective hearing improvement device (3400A, 3400B) provides efficient coupling of the magnetic field generated by the BTE transmit coil within the hearing improvement device, to the receiving telecoil located within the respective BTE type hearing aid, with uniform magnetic coupling strength over a range of possible telecoil positions within the BTE hearing aid housing.

One aspect of the present invention relates to the issue of power consumption. Through the use of the previously described transmit inductor design approach and a class D amplifier, high peak field strengths are achieved with very low idle current from a single 1.25 volt hearing aid-type battery. The three-transistor preamplifier circuit and the class D amplifier shown in FIG. 30A require a total of approximately 165 μA without a transmit inductor load (approximately 60 μA for the transistors and 105 μA for the class-D amplifier). The BTE transmit inductor, such as the one shown in FIG. 29 as BTE transmit inductor 2926, may add only 21 μA to this at idle, while the more powerful ITE transmit inductor, such as ITE transmit inductor 2925 of FIG. 29, may add 71 μA at idle. Although the operating current does go higher transiently when louder sounds are being coupled, the duration of this higher current drain is extremely short and highly intermittent, and does not have an appreciable effect upon battery life. In an embodiment of the present invention, battery life is determined primarily by the idle currents. The total current drain, including approximately 200 μA for the array microphone described above, is approximately 386 μA using the BTE transmit inductor, and approximately 436 μA using the ITE transmit inductor. This results in an estimated battery life of approximately 181 hours (BTE transmit inductor active) or 161 hours (ITE transmit inductor active) from a size 10 A zinc-air hearing aid battery of 70 mA-hour capacity. These levels are very low average current drains for the high peak magnetic field strengths produced.

Figure 35:
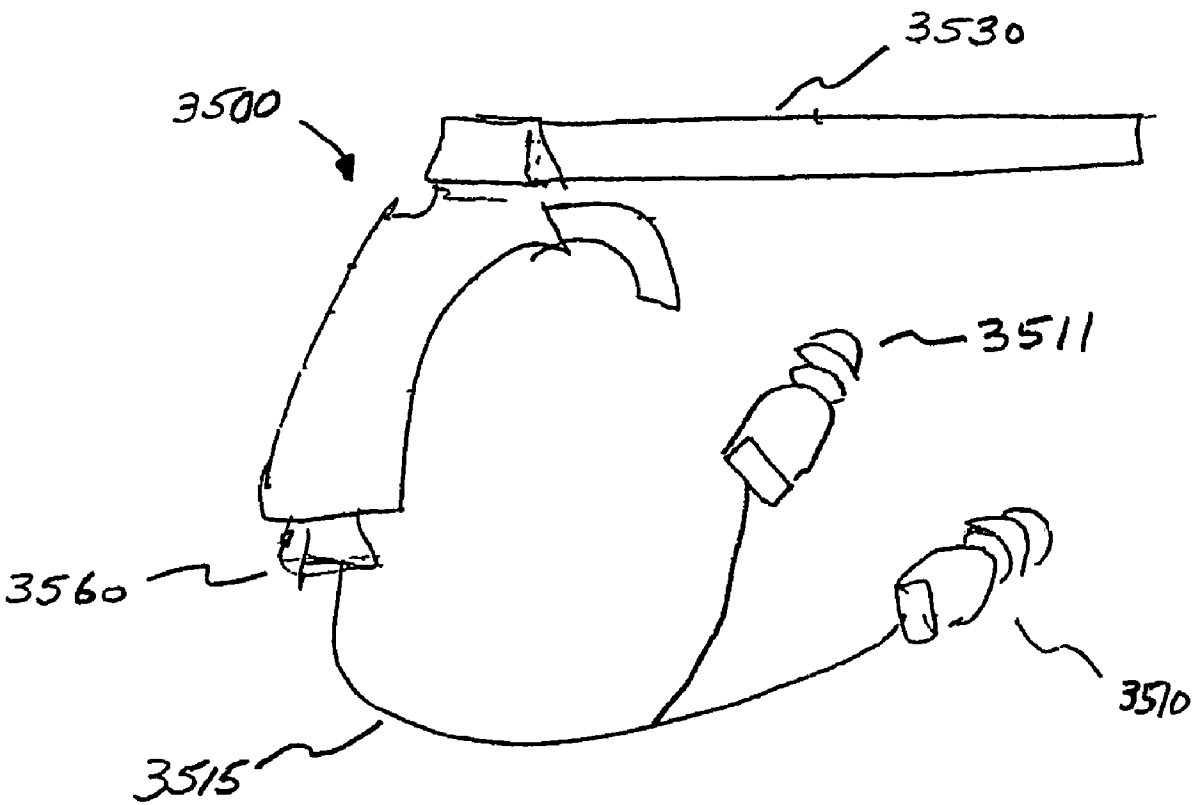
FIG. 35 is a diagram illustrating an earphone directly connected to a hearing improvement device in accordance with an embodiment of the present invention.

FIG. 35 illustrates a further embodiment in which an earphone is directly connected to the hearing improvement device, in accordance with the present invention. In the embodiment illustrated in FIG. 35, array microphone 3530 transduces a sound field into an electrical signal, which is amplified by the circuitry within hearing improvement device 3500 as described above, and made available at connector 3560. The circuitry of hearing improvement device 3500 may correspond, for example, to the schematic illustrated in FIG. 30. The directionality of array microphone 3530 allows the user to orient array microphone 3530 so as to emphasize those sounds of most interest to the user. In the exemplary embodiment of FIG. 35, earphones 3510 and 3511, which may be, for example, earphones such as the Etymotic Research model ER-6 insert earphone, are operatively coupled to connector 3560 by multi-conductor cable 3515. Connector 3560 may correspond to connector 3060 as shown in FIG. 30. Although two earphones are shown in FIG. 35, a lesser or greater number may be used without departing from the spirit of the invention.

Figure 35A:
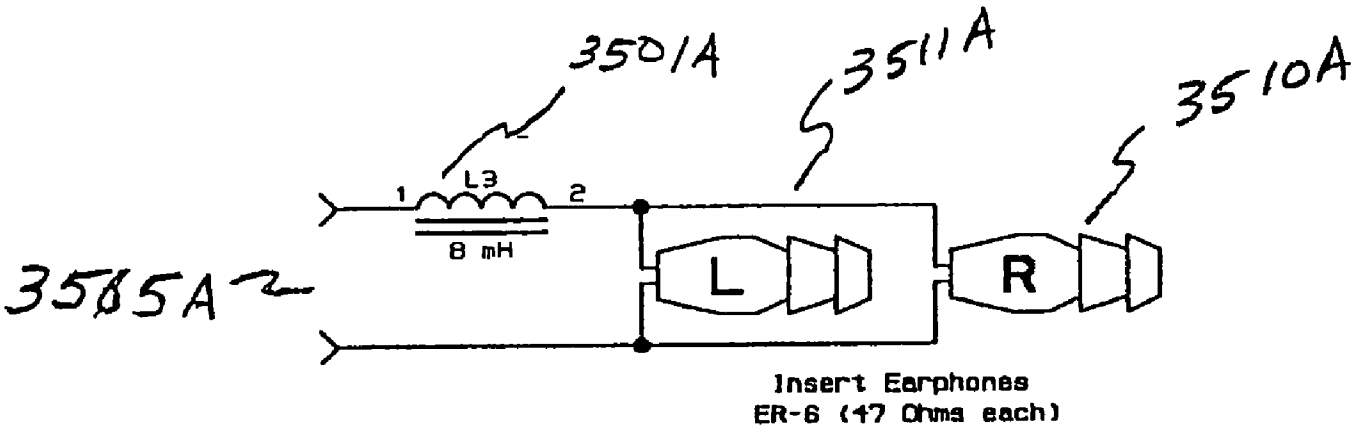
FIG. 35A is a diagram illustrating interconnection of a pair of earphones illustrated in FIG. 35 in accordance with an embodiment of the present invention.

FIG. 35A shows a schematic diagram illustrating the interconnection of a pair of earphones suitable for use with the embodiment shown in FIG. 35, in accordance with the present invention. Returning to the illustration shown in FIG. 30, it can be seen that in addition to driving the ITE or BTE transmit inductors 3025 and 3026, respectively, the class-D amplifier 3015 is also arranged to provide the amplifier output signal through a 22 μF capacitor, for external direct connection of an earphone assembly at connector 3060. An earphone assembly that may be suitable for such use is shown in FIG. 35A. In FIG. 35A, earphones 3510A and 3511A receive audio electrical signals from connector 3565A through inductor 3501A, which may have a value of 8 mH. Inductor 3501A may be used to filter the 100 kHz switching currents that may be present in the output signal of the class-D amplifier 3015. Use of inductor 3501A significantly reduces the current drain of hearing improvement device that would otherwise occur if earphones 3510A and 3511A received signals directly from connector 3060 of FIG. 30. Inductor 3501A also introduces a high frequency roll-off similar to that introduced by the characteristics of the receive telecoil in an inductively coupled hearing aid. To compensate for such high-frequency roll-off, high frequency boost has been provided by the action of capacitor C4 of FIG. 30. A small boost in the transmitter response just above the cutoff frequency of approximately 230 Hz provided by Q1 and its associated parts, C1, C2, R1, and R2, for use with ITE and BTE transmit inductors, may not be needed when using earphones 3510A and 3511A. This unnecessary boost is reduced by the action of output coupling capacitor C9. The net result is that the earphone receives a final frequency response substantially similar to that shown in FIG. 32D, as previously discussed.

Figure 36:
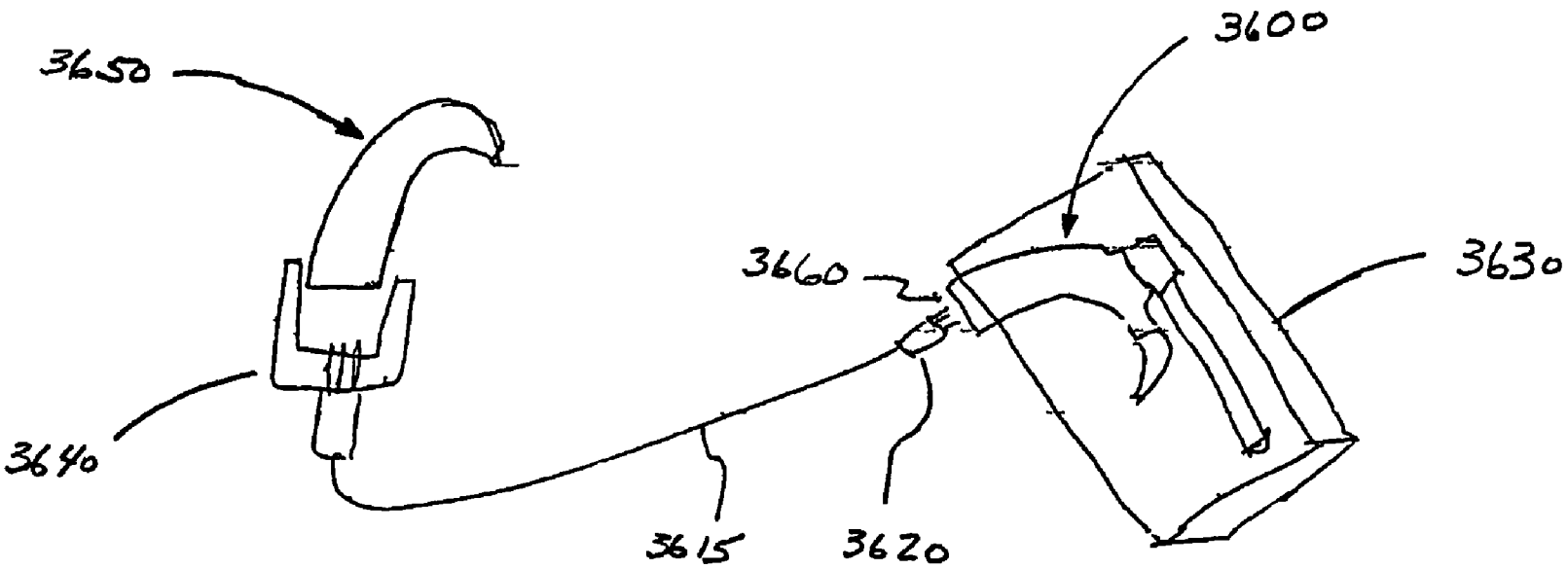
FIG. 36 is a diagram illustrating a hearing improvement device directly coupled to a hearing aid of a user in accordance with an embodiment of the present invention.

FIG. 36 illustrates an additional embodiment in which a hearing improvement device is directly coupled to the hearing aid of a user, in accordance with the present invention. Such an arrangement may enable a user to reduce background noise and improve intelligibility by allowing the substitution of the array microphone within hearing improvement device 3600 for the internal microphone of hearing aid 3650, permitting the user to direct the array microphone of hearing improvement device 3600 at the sound source of interest. In the illustration of FIG. 36, the BTE type hearing aid 3650 is electrically connected to hearing improvement device 3600, which may correspond to the hearing improvement devices depicted in FIG. 31 and FIG. 34A or 34B. Connector 3620 at one end of multi-conductor cable 3615 is inserted into mating connector 3660 on the hearing improvement device 3600. Connector 3660 may correspond to connector 3160 in FIG. 31. Boot 3640 at the remaining end of multi-conductor cable 3615 connects to BTE hearing aid 3650, supplying amplified audio signals from the array microphone contained within hearing improvement device 3600 directly to BTE hearing aid 3650. To avoid damage that may occur should hearing improvement device 3600 be dropped or struck and to provide a less noticeable visual appearance, hearing improvement device 3600 may be protected within enclosure 3630.

Aspects of the present invention may be employed in a cellphone, to facilitate efficient coupling of the received audio signals of the cellphone to the telecoil in the hearing aid of a user. There are two well-know sources of audible buzz during hearing aid use with digital telephones, especially TDMA and GSM (PCS) transmissions, which are a) the RF pulses (217 per second with GSM, each pulse lasting one-eight of the period) and b) the magnetic pulses from the (especially battery-to-RF-power-output wiring) resulting from the current surges 217 times a second as the RF output is powered on and off. RF pulses, finding a place of rectification in the hearing aid circuitry, become a 217 Hz audio buzz signal that can interfere with telephone reception for a hearing aid wearer using either microphone or telecoil inputs. Magnetic pulses provide an additional source of buzz that can interfere with the telecoil reception even if the hearing aid has been made immune to RF.

It appears that the RF coupling problem has been essentially solved in the latest hearing aid designs, whose immunity made them impervious to the RF output directed towards the head of most present cellphone users. For those using older-design hearing aids, the percentage who can use GSM or TDMA cellphones is improving as the RF output from cellphones directed toward the head continues to decrease due to changes in cellphone design.

The telecoil noise coupling problem has been more difficult to solve, because both the RF and magnetic interference can cause a buzz in the hearing aid. Although the RF pickup has now been largely solved in present hearing aid designs, the magnetic buzz that is typically produced by the cellphone over nearly all of the cellphone case (and in particular in the vicinity of the earphone) cannot be distinguished by the hearing telecoil circuitry from a similar signal coming over the phone line. In other words, the interfering signal cannot be blocked without also blocking a portion of the desired speech signal as well. As in the case of the RF buzz, the magnetic buzz can often be strong enough to make reception unintelligible.

It has been found that for GSM buzz a 25 dB SBR (signal-to-buzz ratio) was for required in order for 90% of their subjects to rate the reception acceptable. In a similar study, Teder and Killion found a 20 dB SBR was required for TDMA and a 25 dB SBR was required for GSM. FIG. 1 shows both sets of data as published in Preves, 2003.

Prior work has attempted to employ a cancellation scheme to reduce the magnetic buzz field from the cellular telephone. The approach taken reasoned that a sample of the current pulses to the RF output could be fed to a shaped coil positioned so as to cancel the offending buzz (i.e., to produce an out-of-phase but similar in magnitude canceling magnetic buzz) in the vicinity of the earphone. After some effort, the researchers concluded that it did not seem practical, because the interfering magnetic field was distributed over a wide area.

A highly directional array microphone has been developed by the applicant that combines three individual directional microphones in an small array to provide a 7 to 10 dB improvement in acoustic signal-to-noise ratio in restaurants and the like for conventional hearing aid wearers. Since it was an accessory to a hearing aid, it required a means of coupling with the hearing aid. Measurements on possible telecoil coupling approaches were made, assuming than a magnetic field similar to that required for landline telephones (30 to 80 mA/m magnetic field) would be sufficient.

Measurements of the magnetic buzz created by fluorescent lights, computer monitors, and other sources have been made. These measurements have found noise levels of 5 to 30 mA/m. Users of a hearing aid in telecoil mode may need to hold their head at an unusual angle in order to minimize the buzz sufficiently to carry on a conversation due to the magnetic noise from fluorescent lights.

The following illustrates the problem in terms of common experience. In normal circumstances where background noise is not a problem, normal conversational speech is received at the ear or hearing aid input at approximately 65 dB SPL. In social situations, the noise experienced typically achieves a steady state average of 82 dB SPL. In such a situation, a speaker may raise his or her voice to 85 dB SPL in order to be understood by those with normal hearing. The reason for the difference between the 3 dB signal-to-noise ratio we accept in social gatherings and the 25 dB SBR for 90% of the subjects in the experimental situations mentioned above is probably because a) the magnetic interference is an effective masker b) many of the experimental subjects had a significant loss of ability to hear in noise and c) the experimental question was not "just barely able to carry on a conversation" at a social gathering but rather, "acceptable for normal use".

In some restaurants the background noise can reach 90 dB, in which case the talker must raise his or her voice to 93 dB to be understood. In those cases, the hearing aid wearer may well choose to reduce the gain, even if the internal automatic gain control circuit is well designed.

By analogy with raising one's voice, it is possible to raise the telecoil signal to the equivalent of 85–95 dB SPL. To produce a 25 dB signal-to-buzz ratio with up to 30 mA/m buzz level may require a little over 500 mA/m signal strength. In the design of the telecoil driver for the array microphone referenced above, the approach taken provided an additional 10 dB margin in order to perform better with hearing aids whose telecoil is mounted at such an angle that ideal magnetic coupling may be difficult to achieve. This margin raised the design goal to approximately 1700 mA/m. In actual practice, a field strength of approximately 2000–5000 mA/m was obtained. The field strength can be reduced with a screwdriver trimmer when such a high a field is not desirable for a given hearing aid/telecoil combination. Although these fields are somewhat high, they are entirely practical, and may be achieved using a Class D driver with a total battery drain of less than 0.2 mA on a 1.4 Volt cell.

Telecoils in hearings aids are sometimes mounted in a vertical orientation to maximize performance with "loop" systems found in theatres, and are sometimes mounted along a line through the ears of a user in order to maximize pickup with telephones, the orientation depending on the needs of the patient. The higher drive level described above makes it possible to use a single magnetic field configuration for a variety of telecoil locations.

When the magnetic buzz level of several digital cellphones was measured, interference noise levels of up to 50 mA/m were observed. While it is possible to reduce the magnetic buzz in cellphones, research experience and the absence of buzz-free digital cellphones in the marketplace suggest that it is more effective to increase the signal level coupled to the hearing aid telecoil than to reduce the level of cellphone buzz. This approach has the additional advantage that cellphones generating a higher level of magnetic signal would also permit greater freedom from the magnetic interference generated by fluorescent lights and computer monitors.

Assuming that a field strength of 50 mA/m corresponds to conversational speech at 65 dB SPL (see Teder, 2003, attached), a magnetic field strength of 500 mA/m corresponds to 85 dB SPL, and 1700 mA/m corresponds to 90 dB SPL. In experiments conducted by the applicant, applying the magnetic coupling technology described above in the modification of a sample of digital cellular telephones in order to provide these levels of magnetic signals resulted in acceptable operation, even when the cellphone generated a relatively high level of magnetic interference. In addition, incorporation of the present invention did not alter the external appearance of the cellphones.

Analog cellphones were once considered a temporary solution to both the RF and magnetic interference problems. It is becoming increasingly difficult to find a cellular service provider willing to support analog cellular telephones. Thus, the "analog solution" to telecoil usage is becoming a less and less viable solution as time goes on.

The data and analysis above leads to the following observations. First, because nearly all hearing aids will work with 80 mA/m signal strength in the absence of interference, a minimum magnetic field strength of 80 mA/m appears to be a reasonable requirement. A level higher than 80 mA/m may be required, as the 80 mA/m field strength is considered by some in the field to be barely adequate. For instance, the field requirement for wireline telephones is 78 mA/m (EIA 504). The average speech level of during wireline phone use is approximately 85 dB, while that of a cellphone is approximately 97 dB. As a matter of symmetry, the magnetic field of the cellphone thus should also be 12 dB higher than wireline, or about 320 mA/m at full volume control. Second, If the magnetic buzz level of a cellphone (measured in the plane of the earphone at the same locations specified in C63.19 for RF measurements) exceeds 4.5 mA/m, then the magnetic signal output of the cellphone must be 25 dB greater than the worst-case magnetic buzz level.

Magnetic noise emission measurements have been made showing a very low equivalent 1 kHz, A-weighted magnetic fields (H-fields) of less than 3 mA/m in the vicinity of the loudspeaker of a sample of late-model CDMA cellphones. Measurements made in similar locations on a sample of TDMA cellphones were slightly higher, from 10 to 45 mA/m. These latter numbers, while being only about 10 dB greater than many other environmental magnetic noise sources (A-weighted comparison), are comparable to the present standards-specified nominal 31.6 mA/m telecoil field, (corresponding to 60 dB-SPL).

The units for which measurements were taken did not include GSM. While comparable measurements were not made on cellphones employing the GSM standard, it is evident that magnetic interference fields for GSM cellphones can be expected to be higher and more obnoxious.

It has been observed that magnetic interference field drops off very rapidly with the distance from the body of the cellphone. Specifically, the flip-phone style cellphones tend to have low magnetic noise emission in the region surrounding the location of the loudspeaker. This is primarily due to the distance of the loudspeaker from the "active" part of the phone. For other style cellphones, for example "candy bar" styles, positioning the telecoil of the hearing aid just 1 or 2 cm from the earpiece end of the phone is sufficient to greatly attenuate the interference field, even for those using the GSM standard. For a behind-the-ear (BTE) type hearing aid, this corresponds to the expected cellphone-telecoil relationship with typical cellphone positioning. For an in-the-ear (ITE) type hearing aid, moving the cellphone just slightly down towards the mouth may achieve this position.

Positioning a speech field source inductor 1 or 2 cm off the end of the cellphone may provide an appropriate level of attenuation, and simultaneously afford good coupling with good signal-to-noise. While the generated speech fields should be comfortably strong, they shouldn't need to be overwhelming. An implication of this is that, with the possible exception of a flip-phone style used with an ITE style hearing aid, the loudspeaker position is a less-than-optimal position from which to be generating the speech fields. For the best results, the speech field source inductor should be as far in the direction of the earpiece as possible. The typical loudspeaker magnetic source, besides being in a particularly awkward location for BTE use, also tends to generate a stronger horizontal field (in and out of the head) than vertical, similar to a telephone receiver. For a BTE (and a vertical telecoil ITE) type hearing aid, this results in weaker coupling and requires more adjustment on the part of the user to find the best orientation of the cellphone. This adjustment may be more critical than with a standard telephone receiver because of the small size of the source.

Aspects of the present invention provide an added inductor, placed at the very end of the cellphone, generating a more or less vertical field in normal use. Recent modifications of three cellphones demonstrate the practicality of driving the inductor in parallel with the existing loudspeaker. It is not extraordinarily difficult to find room for inductors in the appropriate location for any of the units. In fact, this area appears to be the most wide-open location anywhere in these tightly packed cellphones. In two of the modified units, multiple inductors were used to generate higher fields, since the ideal inductor winding impedance was not immediately available.

New measurements were taken on five cellphones, along with the previously constructed microphone/inductor clip-on adaptor. Three phones were modified with added inductors. The inductors were the "ITE"-coupling inductors from the array microphone device described above (94 Ohms, 26 mH, 21 mm long originally), but with one end trimmed down a couple of millimeters to help the fit. (The first inductor in each unit actually had 5% higher impedance, because it was a pre-production sample with longer leads). The ends of some inductors were bent a bit to help the fit. Effective magnetic output with good S/N (with the appropriate telecoil positioning) was confirmed by monitoring the output of a loaded telecoil on an oscilloscope and through a headphone amplifier. The BTE hearing aid available for testing had very poor RF immunity and could not be used for this evaluation. Maximum volume setting on the cellphones was always used.

Field strength was measured 1.5 cm off the end, or, for the unmodified flip-phone styles, away from the loudspeaker surface. The measurement vector was parallel to the inductors except as noted for the unmodified flip-phones. The H field numbers quoted are waveform peaks as viewed on the oscilloscope. Numbers in the range of 1 A/m and below are very approximate, as the traces were very small. Average speech levels (for comparison to typically quoted field levels such as "31.6 mA/m") should be considered roughly 5 times lower than the quoted waveform peak levels. Tests were conducted cellphone-to-cellphone.

Figure 37:
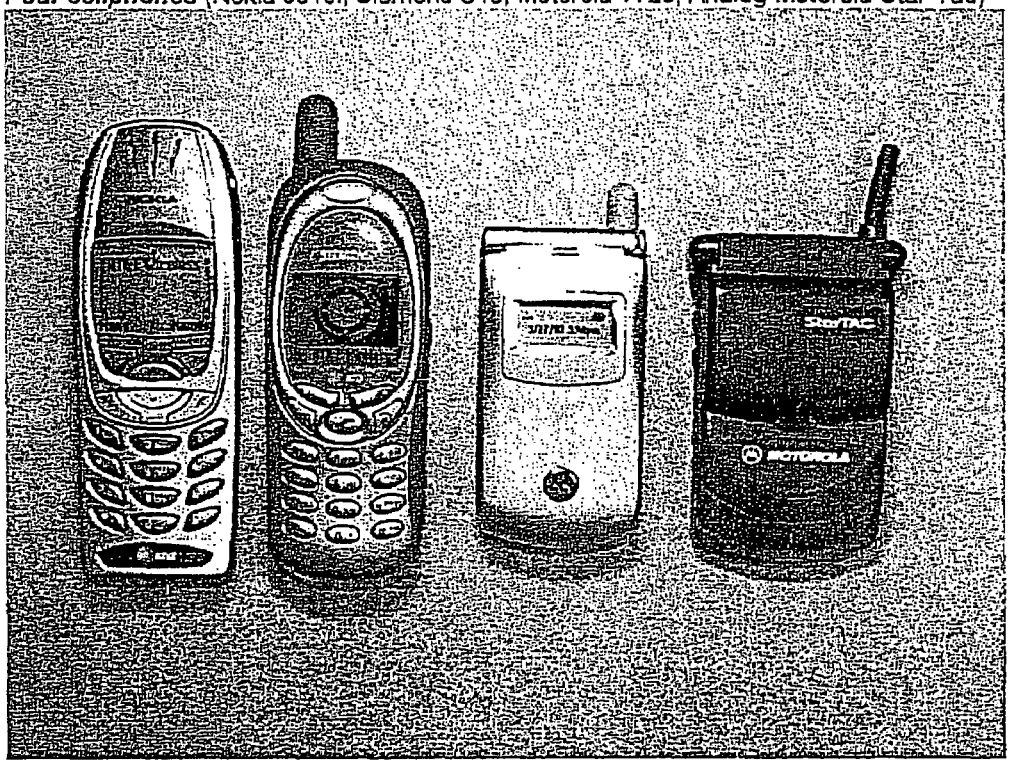
FIG. 37 is a photograph illustrating exterior views of four cellphone units adapted to be modified in accordance with an embodiment of the present invention.

FIG. 37 is a photograph illustrating exterior views of four cellphone units adapted to be modified in accordance with an embodiment of the present invention. The four cellphones illustrated are the Nokia 6310i, Siemens S46, Motorola T720, and an Analog Motorola Star-Tac. The Nokia 6310i, the Siemens S46, and the Motorola T720 are all GSM type cellphones, whereas the Motorola StarTac is an analog type cellphone.

Figure 38:
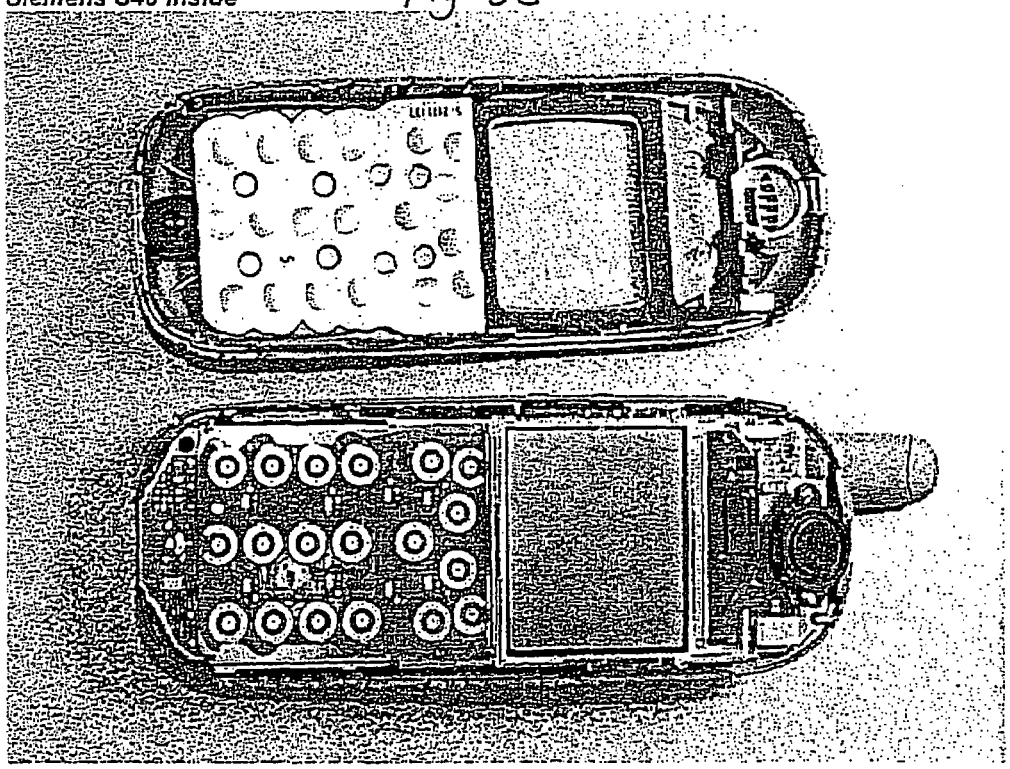
FIG. 38 is a photograph illustrating the interior of the top and bottom housing components of a cellphone unit adapted to be modified in accordance with an embodiment of the present invention.

FIG. 38 is a photograph illustrating the interior of the top and bottom housing components of a cellphone unit adapted to be modified in accordance with an embodiment of the present invention. In FIG. 38, a Siemens S46 GSM type cellphone is illustrated having the top and bottom housing components removed revealing the interior and the electronic components disposed within the interior of the cell phone.

FIG. 39 is a photograph illustrating a close-up view of modifications to the cellphone illustrated in FIG. 38 according to an embodiment of the present invention. In FIG. 39, a Siemens S46 GSM type cellphone is illustrated having the top and bottom housing components removed revealing the interior and the electronic components disposed within the interior of the cell phone. In the embodiment according to FIG. 39, the Siemens model S46 has been modified to include one inductor for transmitting signals to a hearing aid.

FIG. 40 is a photograph illustrating another close-up view of modifications to the cellphone illustrated in FIG. 38 according to an embodiment of the present invention; In FIG. 40, a Siemens S46 GSM type cellphone is illustrated having the top and bottom housing components removed revealing the interior and the electronic components disposed within the interior of the cell phone. In the embodiment according to FIG. 40, the Siemens model S46 has been modified to include three inductors for transmitting signals to a hearing aid. In FIG. 40, 3 parallel inductors are illustrated oriented across an 18 Ohm loudspeaker and having 3 A/m peak on "one, one" and having 7 A/m peak on "ten, ten" (with more high frequency content). The resulting modification enhanced the cellphone and produced clear and bright audio transmissions.

Figure 41:
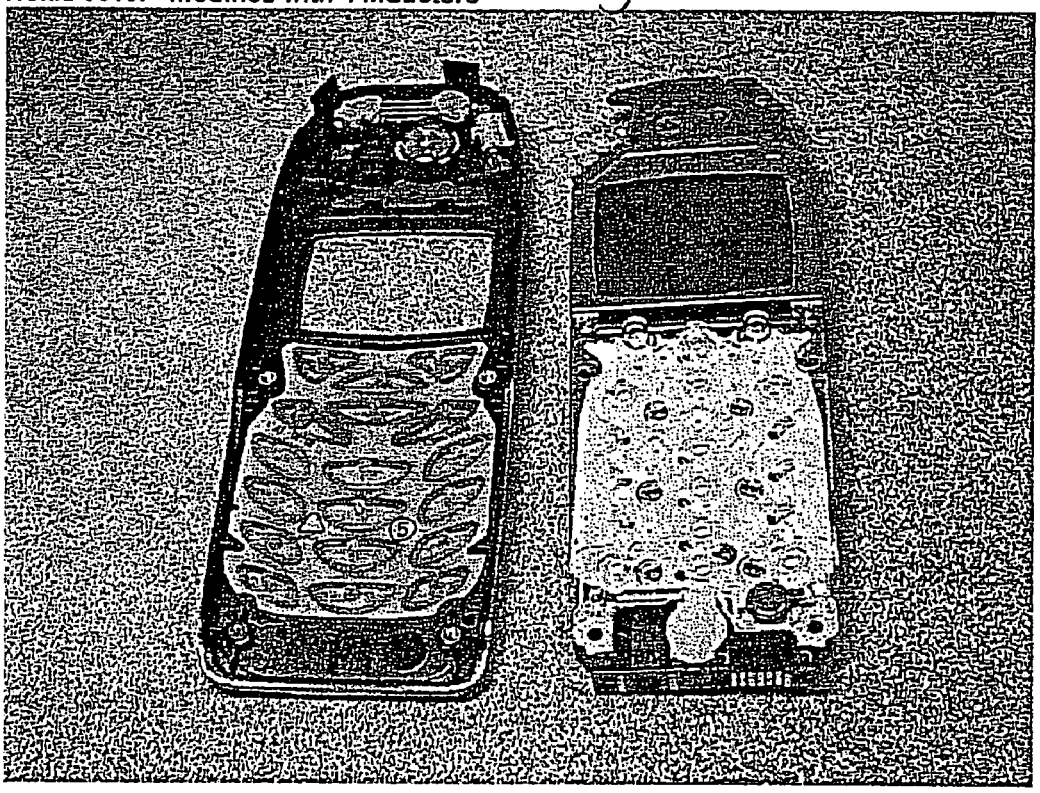
FIG. 41 is a photograph illustrating the interior of the top and bottom housing components of a cellphone illustrating modifications according to an embodiment of the present invention.

FIG. 41 is a photograph illustrating the interior of the top and bottom housing components of a cellphone illustrating modifications according to an embodiment of the present invention. In FIG. 41, a Nokia 6310i GSM type cellphone is illustrated having the top and bottom housing components removed revealing the interior and the electronic components disposed within the interior of the cell phone.

Figure 42:
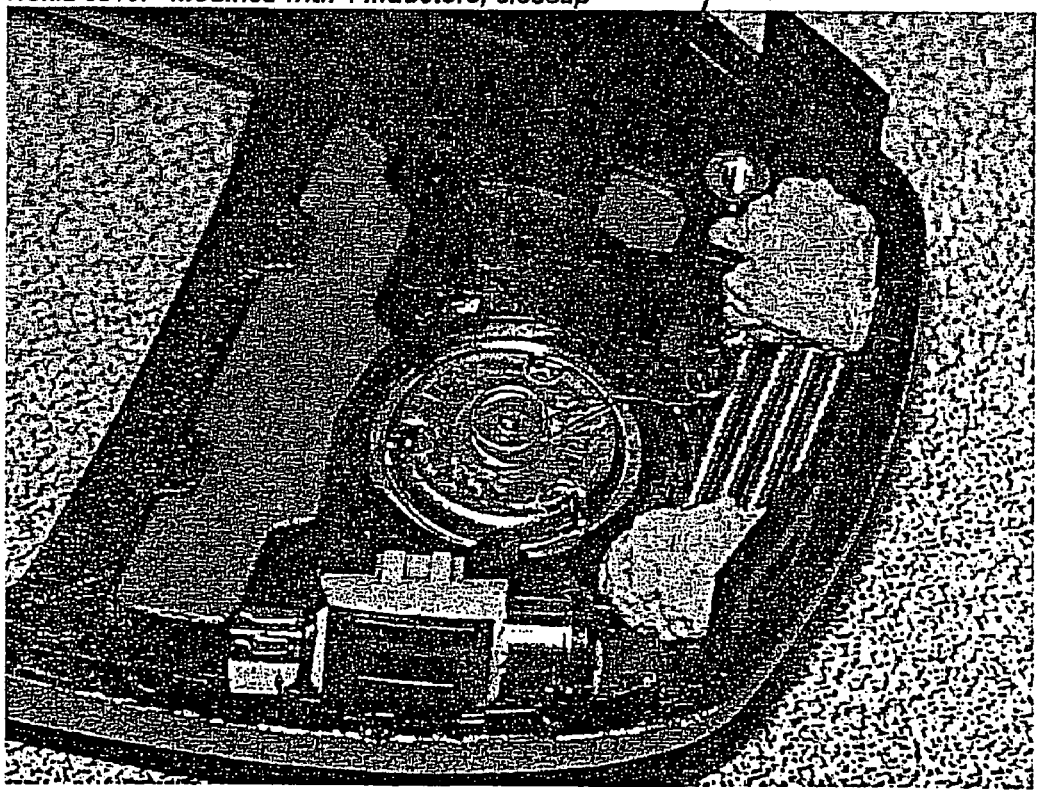
FIG. 42 is a photograph illustrating a close-up view of modifications to the top housing of the cellphone illustrated in FIG. 41 according to an embodiment of the present invention.

FIG. 42 is a photograph illustrating a close-up view of modifications to the top housing of the cellphone illustrated in FIG. 41 according to an embodiment of the present invention. In the embodiment according to FIG. 42, the Nokia 6310i has been modified to include four inductors for transmitting signals to a hearing aid. In FIG. 42, 4 parallel inductors are illustrated oriented across an 33 Ohm loudspeaker and having 3 A/m peak on "one, one" and having 3 A/m peak on "ten, ten". The resulting modification enhanced the cellphone and produced a more muffled softer audio transmissions.

Figure 43:
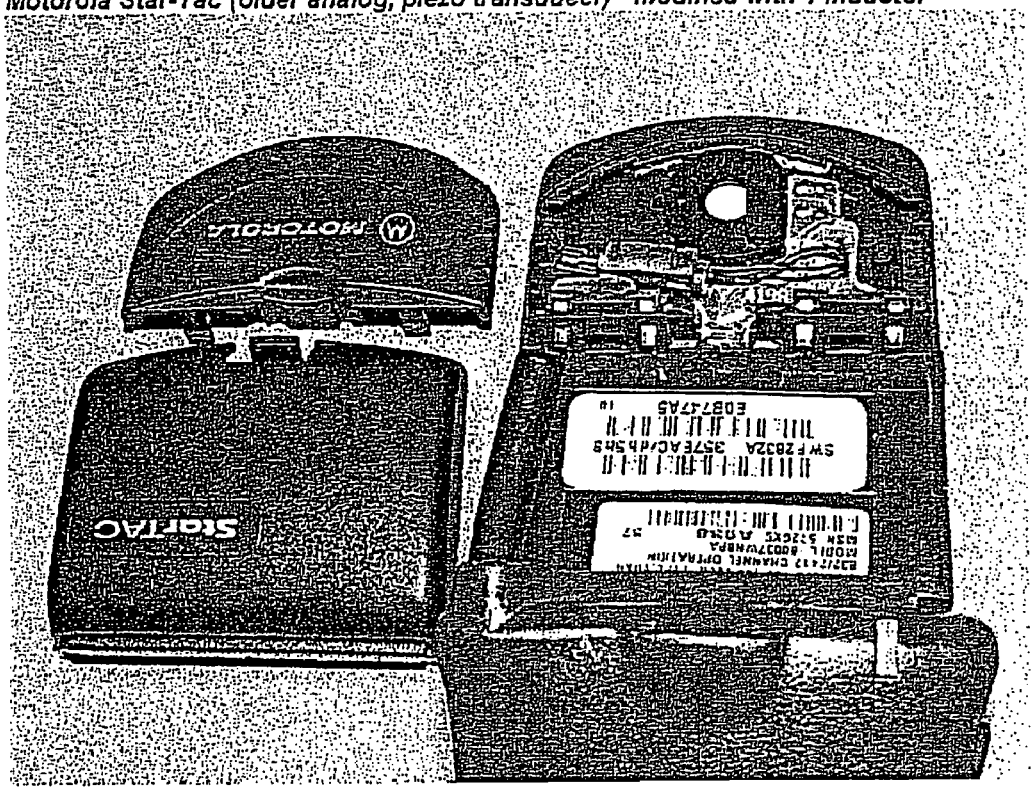
FIG. 43 is a photograph illustrating views of several components of another cellphone unit and illustrating modifications made thereto according to an embodiment of the present invention.

FIG. 43 is a photograph illustrating views of several components of another cellphone unit and illustrating modifications made thereto according to an embodiment of the present invention. In the embodiment according to FIG. 42, the Motorola StarTac analog cellphone has been modified to include one inductor for transmitting signals to a hearing aid. In FIG. 43, one inductor is illustrated oriented across a 97 nF piezo-transducer and having 3.5 A/m peak on recorded speech and having 11 A/m peak on dial tones without speech annunciating. The resulting modification enhanced the cellphone and produced audio transmissions having no readily detectable magnetic interference.

Figure 44:
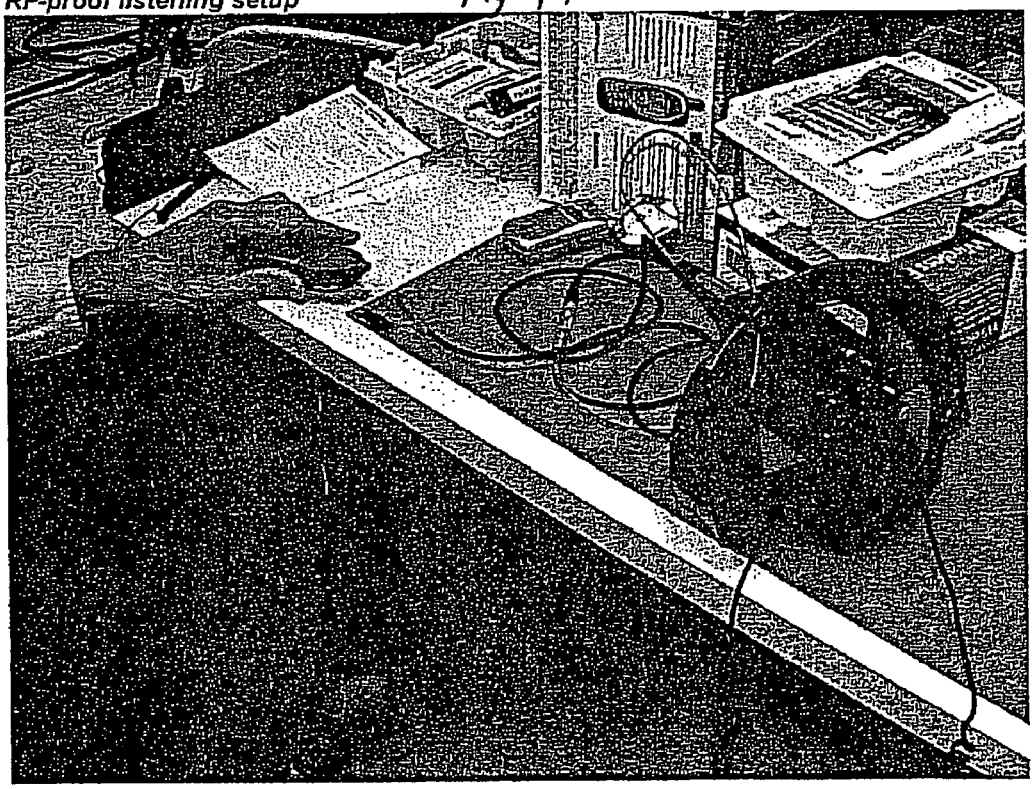
FIG. 44 is a photograph illustrating a testing setup adapted to test cellphones to determine whether the cellphones are immune to external RF sources according to an embodiment of the present invention.

FIG. 44 is a photograph illustrating a testing setup adapted to test cellphones to determine whether the cellphones are immune to external RF sources according to an embodiment of the present invention. During testing, the Motorola T720 cellphone and the older TDMA Star-Tac analog cellphone produced adequate, although not overly generous, speech fields directly from their loudspeakers. The Siemens S46 and Nokia 6310i "candy bar" phones had lower loudspeaker field levels, but were difficult to quantify because the speech fields were lost in interference. The Motorola T720 was sufficiently clear of interference at the loudspeaker location to make the unit useable as is, although, the inductor(s) positioning may be awkward for a BTE hearing aid. The inductor additions to the Siemens S46, Nokia 6310i, and the Motorola Star-Tac analog phone all produced similar strong levels. With appropriate user positioning, all the phones may be adapted to give more than adequate telecoil S/N (signal to noise response). The successful Motorola Star-Tac analog cellphone modifications demonstrates that a single inductor may be sufficient, if the impedance is properly matched to the available drive voltage. (The drive voltage used for the piezo transducer was apparently higher than that for the magnetic loudspeakers, and was a better match for a single inductor of the impedance employed in the tests). In an embodiment according to the present invention, an excessive L/R (inductance to resistance) ratio is avoided for the inductor, thus avoiding high frequency roll-off, although this may depend upon specific cellphone design choices.

It is evident that an inductor such as that employed in an embodiment according to the present invention, having appropriate impedance characteristics and being positioned atop an end of the cellphone, is a practical and effective method for coupling the cellphone audio signal to a hearing aid telecoil. Normal telephone positioning results in good speech coupling and, by virtue of the greater distance to the magnetic interference-generating portion of the cellphone compared to positioning encouraged by direct use of any loudspeaker field, good rejection of cellphone magnetic interference.

The Motorola T720 may be useable as is, but could use a bit stronger field, and may require awkward positioning when used with a BTE hearing aid. The loudspeaker source location and field orientation may not be ideal for the BTE hearing aid, although it may be more appropriate for at least some ITE hearing aids. For "candy bar" phones, the loudspeaker may be too close to the interference source, and may require awkward positioning of the BTE hearing aid.

The inductor may be chosen for optimum field strength. Natural positioning for a BTE hearing aid, or just a slight lowering for an ITE hearing aid results in the interference source being positioned away from the hearing aid.

The cellphone may be equipped with two pinhole entries on an end for an add-on inductor to plug into.

A small package may be adapted to clip over an end of a cellphone. The small package may contain: a microphone;

an amplifier integrated circuit; a D-Amp or op-amp; an inductor; miscellaneous resistors and capacitors to perfect the circuitry; a switch, i.e. an on/off switch; a battery, for example, an alkaline or lithium battery; and a case or holder.

Notwithstanding, the invention and its inventive arrangements disclosed herein may be embodied in other forms without departing from the spirit or essential attributes thereof. Accordingly, reference should be made to the following claims, rather than to the foregoing specification, as indicating the scope of the invention. In this regard, the description above is intended by way of example only and is not intended to limit the present invention in any way, except as set forth in the following claims.

While the present invention has been described with reference to certain embodiments, it will be understood by those skilled in the art that various changes may be made and equivalents may be substituted without departing from the scope of the present invention. In addition, many modifications may be made to adapt a particular situation or material to the teachings of the present invention without departing from its scope. Therefore, it is intended that the present invention not be limited to the particular embodiment disclosed, but that the present invention will include all embodiments falling within the scope of the appended claims.

What is claimed is:

1. A hearing improvement device comprising:

a microphone for transducing a sound field into a first electrical signal;

an amplifier for amplifying the first electrical signal into a second electrical signal; and at least one inductor for converting the second electrical signal into a magnetic field for coupling to a telecoil of a hearing aid, wherein the microphone is amplified and coupled through the at least one inductor to the hearing aid, wherein said at least one inductor comprises a plurality of coils, and wherein the at least one inductor comprises a first inductor and a second inductor that is spatially oriented differently from the first inductor.

2. The device according to claim 1, wherein the hearing aid comprises at least one of the following: a behind-the-ear (BTE) hearing, an in-the-ear (ITE) hearing aid, an in-the-canal (ITC) hearing aid, and a completely-in-the-canal (CIC) hearing aid.

3. The device according to claim 1, wherein the microphone comprises an output connected to an input of a high-pass filter, the high pass filter being used to reduce low-frequency components of an electrical signal and avoid excessive low-frequency coupling to the hearing aid.

4. The device according to claim 1, wherein the first inductor is an in-the-ear (ITE) transmit inductor and the second inductor is a behind-the-ear (BTE) transmit inductor, wherein a switch is provided to perform at least one of the following: enable the first inductor and disable the second inductor, enable the second inductor and disable the first inductor, enable the first and second inductors, and disable the first and second inductors.

5. The device according to claim 1, wherein the magnetic field emanating from the hearing improvement device comprise approximately 30 mA/meter at 1 kHz, wherein 1 kHz lies in range of frequencies comprising human speech.

6. The device according to claim 1, wherein the hearing improvement device is adapted to operate on an ear of a user by an earhook, wherein the hearing improvement device is positioned at one of the following: adjacent a user's outer ear and adjacent the user's head.

7. The device according to claim 1, wherein the hearing improvement device comprises at least one of the following: an in-the-ear (ITE) transmit inductor and a behind-the-ear (BTE) transmit inductor positioned to magnetically couple with a vertically-oriented telecoil located within at least one of the following: an ITE hearing aid and a BTE hearing aid, wherein lines of magnetic flux generated by at least one of the following: the ITE transmit inductor and the BTE transmit inductor are arranged primarily vertically in a region within which at least one of the following: the ITE hearing aid and the BTE hearing aid is located to optimize interaction with the vertically oriented telecoil located within at least one of the following: the ITE hearing aid and the BTE hearing aid.

8. The device according to claim 1, wherein the at least one inductor comprises at least one of the following: an in-the-ear (ITE) transmit inductor and a behind-the-ear (BTE) transmit inductor positioned to magnetically couple with a vertically-oriented telecoil located within at least one of the following: an ITE hearing aid and a BTE hearing aid, wherein field strength of at least one of the following: the ITE transmit inductor and the BTE transmit inductor are maximized by providing a core of at least one of the following: the ITE transmit inductor and the BTE transmit inductor being sized to be contained within a limitation of space and orientation available in at least one of the following: behind a user's outer ear and between the user's outer ear and the user's head.

9. The device according to claim 1, wherein the at least one inductor comprises at least one of the following: an in-the-ear (ITE) transmit inductor and a behind-the-ear (BTE) transmit inductor positioned to magnetically couple with a vertically-oriented telecoil located within at least one of the following: an ITE hearing aid and a BTE hearing aid, wherein at least one of the following: the ITE transmit inductor and the BTE transmit inductor comprises a coil, wherein wire gauge and number of turns of the coil are chosen to give inductance and resistance values allowing peak current, wherein peak current comprises a level of current sufficient to drive an iron core of at least one of the following: the ITE transmit inductor and the BTE transmit inductor to a saturation edge.

10. The device according to claim 1, wherein the at least one inductor comprises at least one of the following: an in-the-ear (ITE) transmit inductor and a behind-the-ear (BTE) transmit inductor positioned to magnetically couple with a vertically-oriented telecoil located within at least one of the following: an ITE hearing aid and a BTE hearing aid, wherein at least one of the following: the ITE transmit inductor and the BTE transmit inductor comprises a coil, the coil comprising windings, wherein the windings of at least one of the following: the ITE transmit inductor and the BTE transmit inductor are used for coupling a telecoil of at least one of the following: the ITE hearing aid and the BTE hearing aid.

11. The device according to claim 1, wherein the at least one inductor comprises at least one of the following: an in-the-ear (ITE) transmit inductor and a behind-the-ear (BTE) transmit inductor positioned to magnetically couple with a vertically-oriented telecoil located within at least one of the following: an ITE hearing aid and a BTE hearing aid, wherein at least one of the following: the ITE transmit inductor and the BTE transmit inductor comprises a coil, the coil comprising windings, wherein at least one of the following: the ITE transmit inductor and the BTE transmit inductor are divided into two windings spaced a distance apart by a winding gap and the two windings are positioned on a common core, wherein the two windings are adapted to improve uniformity of the magnetic fields induced by at least one of the following: the ITE transmit inductor and the BTE transmit inductor.

12. The device according to claim 1, wherein the at least one inductor comprises at least one of the following: an in-the-ear (ITE) transmit inductor and a behind-the-ear (BTE) transmit inductor positioned to magnetically couple with a vertically-oriented telecoil located within at least one of the following: an ITE hearing aid and a BTE hearing aid, wherein at least one of the following: the ITE transmit inductor and the BTE transmit inductor comprises a coil, the coil comprising windings, wherein the windings of at least one of the following: the ITE transmit inductor and the BTE transmit inductor extend as close as practical to an end of the core to maintain a uniform field near ends of the core.

13. The device according to claim 1, wherein the at least one inductor comprises an inductor pair positioned to magnetically couple with a vertically-oriented telecoil located within at least one of the following: an ITE hearing aid and a BTE hearing aid, wherein at least one of inductors of the inductor pair comprises a coil comprising at least two windings spaced a distance apart by winding gaps, wherein the winding gaps of each inductor of the inductor pair permits inductors to overlap within respective winding gaps to minimize thickness of the inductor pair.

14. The device according to claim 1, wherein the hearing improvement device produces a flat frequency response at an output of a receiving telecoil, wherein frequency-dependent drive voltage response compensates for a combined frequency response, and wherein a transmit inductor drive voltage produces a flat receiving telecoil frequency response, and wherein overall magnetic coupling response is uniform over a speech frequency range.

15. The device according to claim 1, wherein the at least one inductor comprises an inductor pair, each inductor of the inductor pair comprises at least two windings spaced a distance apart by a winding gap, wherein the winding gaps of each inductor of the inductor pair permit one inductor of the inductor pair to overlap another inductor of the inductor pair at respective winding gaps of each inductor, wherein the overlapped inductors avoid buildup of field strength near a center of each inductor that would occur with a continuous winding, and wherein the overlapped inductors provide a magnetic field adapted to couple to a variety of hearing aids types comprising a range of receiving telecoil positions.

16. The device according to claim 1, wherein the hearing improvement device is positioned adjacent to the hearing aid, the hearing improvement device being located behind an ear and next to the head of a user providing coupling of a magnetic field generated by a transmit inductor coil within the hearing improvement device to a receiving telecoil located within the hearing aid having uniform magnetic coupling strength over a range of telecoil positions within the hearing aid.

17. The device according to claim 1, wherein the hearing aid is one of connected via a wired connection to the hearing improvement device and connected wirelessly to the hearing improvement device.

18. The device according to claim 1, wherein the hearing improvement device is adapted to connect to one of one earphone and two earphones.

19. A method for processing signals, the method comprising:

transducing a sound field into a first electrical signal;

amplifying the first electrical signal into a second electrical signal; and converting the second electrical signal into a magnetic field for coupling to a telecoil of a hearing aid, wherein said converting is performed via at least a first inductor and a second inductor that is spatially oriented differently from the first inductor.

20. The method according to claim 19, further comprising filtering the first electrical signal prior to the amplifying.

21. The method according to claim 20, wherein said filtering comprises high-pass filtering that reduces low-frequency components of the first electric signal.

22. A hearing improvement device comprising:

a selector that enables selection of at least one of the following: a first sound field and a second sound field;

a microphone for transducing the selected sound field into a first electrical signal;

an amplifier for amplifying the first electrical signal into a second electrical signal; and at least one inductor for converting the second electrical signal into a magnetic field for coupling to a telecoil of a hearing aid, wherein the microphone is amplified and coupled through the at least one inductor to the hearing aid, wherein said at least one inductor comprises a plurality of coils, and wherein said at least one inductor comprises a first inductor and a second inductor that is spatially oriented differently from the first inductor.

23. The hearing improvement device according to claim 22, wherein the selector selects the first sound field or the second sound field based on signal strength of the first sound field and the second sound field.

24. A hearing improvement device comprising:

a microphone for transducing a sound field into a first electrical signal;

an amplifier for amplifying the first electrical signal into a second electrical signal; and at least one inductor for converting the second electrical signal into a magnetic field for coupling to a telecoil of a hearing aid, wherein the microphone is amplified and coupled through the at least one inductor to the hearing aid, and wherein the at least one inductor comprises two inductors, wherein the first inductor is an in-the-ear (ITE) transmit inductor and the second inductor is a behind-the-ear (BTE) transmit inductor, wherein a switch is provided to at least one of enable the first inductor and disable the second inductor, enable the second inductor and disable the first inductor, enable the first and second inductors, and disable the first and second inductors.

25. A hearing improvement device comprising:

a microphone for transducing a sound field into a first electrical signal;

an amplifier for amplifying the first electrical signal into a second electrical signal; and at least one inductor for converting the second electrical signal into a magnetic field for coupling to a telecoil of a hearing aid, wherein the microphone is amplified and coupled through the at least one inductor to the hearing aid, and wherein the at least one inductor comprises at least one of the following: an in-the-ear (ITE) transmit inductor and a behind-the-ear (BTE) transmit inductor positioned to magnetically couple with a vertically-oriented telecoil located within at least one of the following: an ITE hearing aid and a BTE hearing aid, wherein at least one of the following: the ITE transmit inductor and the BTE transmit inductor comprises a coil, wherein wire gauge and number of turns of the coil are chosen to give inductance and resistance values allowing peak current, wherein peak current comprises a level of current sufficient to drive an iron core of at least one of the following: the ITE transmit inductor and the BTE transmit inductor to a saturation edge.

26. A hearing improvement device comprising:

a microphone for transducing a sound field into a first electrical signal;

an amplifier for amplifying the first electrical signal into a second electrical signal; and at least one inductor for converting the second electrical signal into a magnetic field for coupling to a telecoil of a hearing aid, wherein the microphone is amplified and coupled through the at least one inductor to the hearing aid, and wherein the at least one inductor comprises at least one of the following: an in-the-ear (ITE) transmit inductor and a behind-the-ear (BTE) transmit inductor positioned to magnetically couple with a vertically-oriented telecoil located within at least one of the following: an ITE hearing aid and a BTE hearing aid, wherein at least one of the following: the ITE transmit inductor and the BTE transmit inductor comprises a coil, the coil comprising windings, wherein at least one of the following: the ITE transmit inductor and the BTE transmit inductor are divided into two windings spaced a distance apart by a winding gap and the two windings are positioned on a common core, wherein the two windings are adapted to improve uniformity of the magnetic fields induced by at least one of the following: the ITE transmit inductor and the BTE transmit inductor.

27. A hearing improvement device comprising:

a microphone for transducing a sound field into a first electrical signal;

an amplifier for amplifying the first electrical signal into a second electrical signal; and at least one inductor for converting the second electrical signal into a magnetic field for coupling to a telecoil of a hearing aid, wherein the microphone is amplified and coupled through the at least one inductor to the hearing aid, and wherein the at least one inductor comprises at least one of the following: an in-the-ear (ITE) transmit inductor and a behind-the-ear (BTE) transmit inductor positioned to magnetically couple with a vertically-oriented telecoil located within at least one of the following: an ITE hearing aid and a BTE hearing aid, wherein at least one of the following: the ITE transmit inductor and the BTE transmit inductor comprises a coil, the coil comprising windings, wherein the windings of at least one of the following: the ITE transmit inductor and the BTE transmit inductor extend as close as practical to an end of the core to maintain a uniform field near ends of the core.

28. A hearing improvement device comprising:

a microphone for transducing a sound field into a first electrical signal;

an amplifier for amplifying the first electrical signal into a second electrical signal; and at least one inductor for converting the second electrical signal into a magnetic field for coupling to a telecoil of a hearing aid, wherein the microphone is amplified and coupled through the at least one inductor to the hearing aid, and wherein the at least one inductor comprises an inductor pair positioned to magnetically couple with a vertically-oriented telecoil located within at least one of the following: an ITE hearing aid and a BTE hearing aid, wherein at least one of inductors of the inductor pair comprises a coil comprising at least two windings spaced a distance apart by winding gaps, wherein the winding gaps of each inductor of the inductor pair permits inductors to overlap within respective winding gaps to minimize thickness of the inductor pair.

29. A hearing improvement device comprising:

a microphone for transducing a sound field into a first electrical signal;

an amplifier for amplifying the first electrical signal into a second electrical signal; and at least one inductor for converting the second electrical signal into a magnetic field for coupling to a telecoil of a hearing aid, wherein the microphone is amplified and coupled through the at least one inductor to the hearing aid, and wherein the hearing improvement device produces a flat frequency response at an output of a receiving telecoil, wherein frequency-dependent drive voltage response compensates for a combined frequency response, and wherein a transmit inductor drive voltage produces a flat receiving telecoil frequency response, and wherein overall magnetic coupling response is uniform over a speech frequency range.

30. A hearing improvement device comprising:

a microphone for transducing a sound field into a first electrical signal;

an amplifier for amplifying the first electrical signal into a second electrical signal; and at least one inductor for converting the second electrical signal into a magnetic field for coupling to a telecoil of a hearing aid, wherein the microphone is amplified and coupled through the at least one inductor to the hearing aid, and wherein the at least one inductor comprises an inductor pair, each inductor of the inductor pair comprises at least two windings spaced a distance apart by a winding gap, wherein the winding gaps of each inductor of the inductor pair permit one inductor of the inductor pair to overlap another inductor of the inductor pair at respective winding gaps of each inductor, wherein the overlapped inductors avoid buildup of field strength near a center of each inductor that would occur with a continuous winding, and wherein the overlapped inductors provide a magnetic field adapted to couple to a variety of hearing aids types comprising a range of receiving telecoil positions.

* * * * *